US011692342B2

(12) United States Patent
Espinosa

(10) Patent No.: US 11,692,342 B2
(45) Date of Patent: Jul. 4, 2023

(54) CONCRETE ANCHOR BODIES AND PLUGS

(71) Applicant: CETRES HOLDINGS, LLC, Jackson, WY (US)

(72) Inventor: Thomas M. Espinosa, Snohomish, WA (US)

(73) Assignee: CETRES HOLDINGS, LLC, Jackson, WY (US)

( * ) Notice: Subject to any disclaimer, the term of this patent is extended or adjusted under 35 U.S.C. 154(b) by 38 days.

(21) Appl. No.: 16/889,894

(22) Filed: Jun. 2, 2020

(65) Prior Publication Data

US 2020/0407969 A1 Dec. 31, 2020

Related U.S. Application Data

(62) Division of application No. 15/854,285, filed on Dec. 26, 2017, now Pat. No. 10,781,586, which is a (Continued)

(51) Int. Cl.

| | |
|---|---|
| ***E04B 1/41*** | (2006.01) |
| ***E04G 15/04*** | (2006.01) |
| ***E04C 5/06*** | (2006.01) |

(52) U.S. Cl.

CPC ..... *E04B 1/4121* (2013.01); *E04C 5/0645* (2013.01); *E04G 15/04* (2013.01)

(58) Field of Classification Search

CPC ..... E04G 15/04; E04B 1/4121; E04B 1/4114; E04B 1/41

See application file for complete search history.

(56) References Cited

U.S. PATENT DOCUMENTS 1,185,765 A * 6/1916 Brooks ..... E04B 1/4121 52/704
1,960,728 A 5/1934 Cannon
(Continued)

FOREIGN PATENT DOCUMENTS

BE 501092 A 2/1951
CA 2999555 A1 * 9/2018 ..... E04B 1/4121
(Continued)

OTHER PUBLICATIONS

Notification of Transmittal of the International Search Report and Written Opinion of the International Searching Authority; dated Apr. 13, 2017, PCT US2017/017419.
(Continued)

*Primary Examiner* — Michael Safavi
(74) *Attorney, Agent, or Firm* — Fresh IP PLC

(57) ABSTRACT

An anchor for being embedded in concrete for attachment to a fastener to support a load comprises a plug having a main body portion extending upwardly from a base portion, the plug for being attached to a form board prior to pouring of concrete, the plug having an end portion disposed a distance from the form board; and an anchor body attached to the end portion. The plug is separable from the anchor body and removable from the concrete after the concrete is cured, leaving the anchor body embedded in the concrete, the plug providing a void in the concrete after removal to provide an access opening for a threaded portion of a fastener to attach to the anchor body.

26 Claims, 93 Drawing Sheets

Related U.S. Application Data division of application No. 15/429,345, filed on Feb. 10, 2017, now Pat. No. 10,538,910.

(60) Provisional application No. 62/294,231, filed on Feb. 11, 2016.

(56) References Cited

U.S. PATENT DOCUMENTS

| | | | | |
|---|---|---|---|---|
| 2,218,099 | A | 10/1940 | Schenk | |
| 2,305,252 | A | 12/1942 | Hayden | |
| 2,366,401 | A | 1/1945 | Haskel | |
| 3,438,161 | A | 4/1969 | Koch | |
| 3,557,274 | A | 1/1971 | Kowel | |
| 3,599,379 | A | 8/1971 | Tuska | |
| 3,685,782 | A | 8/1972 | Kowell | |
| 3,829,540 | A | 8/1974 | Cox | |
| 3,833,706 | A * | 9/1974 | Edwards | E04C 5/12 52/223.13 |
| 3,889,916 | A | 6/1975 | Ilukowicz | |
| 3,918,345 | A | 11/1975 | Phipard, Jr. | |
| 3,933,336 | A * | 1/1976 | Tolf, Jr. | E04G 15/04 249/177 |
| 4,084,780 | A | 4/1978 | Mess | |
| 4,211,048 | A | 7/1980 | Naka | |
| 4,211,049 | A | 7/1980 | Fischer | |
| 4,248,844 | A | 2/1981 | Ramsey, Jr | |
| 4,368,606 | A | 1/1983 | Hoshino | |
| 4,747,727 | A | 5/1988 | Berchtold | |
| 5,468,105 | A | 11/1995 | Iwamoto | |
| 5,653,078 | A | 8/1997 | Kies | |
| 6,269,591 | B1 * | 8/2001 | Kelly | E06B 1/70 49/482.1 |
| 7,448,172 | B1 | 11/2008 | Knodel | |
| 9,303,399 | B2 | 4/2016 | Espinosa | |
| 10,384,085 | B1 * | 8/2019 | Aleksovski | A62B 35/0068 |
| 2005/0044809 | A1 * | 3/2005 | Thompson | E04B 1/4114 52/223.13 |
| 2007/0134972 | A1 | 6/2007 | Hoy | |
| 2009/0095211 | A1 | 4/2009 | Johns | |
| 2014/0026515 | A1 * | 1/2014 | Espinosa | E04B 1/4121 52/700 |
| 2014/0157717 | A1 | 6/2014 | Espinosa | |
| 2014/0326853 | A1 * | 11/2014 | Titcomb | F16G 11/12 29/897.34 |
| 2016/0230380 | A1 * | 8/2016 | Mahrenholtz | E04B 1/4121 |

FOREIGN PATENT DOCUMENTS

| | | | | |
|---|---|---|---|---|
| CH | 691001 | A5 * | 3/2001 | E04G 15/04 |
| DE | 2355799 | A1 * | 5/1975 | E04B 1/4121 |
| DE | 9302305 | U1 * | 4/1993 | E04B 1/4121 |
| DE | 4341329 | A1 * | 6/1995 | E04B 1/4121 |
| DE | 19700280 | A1 | 7/1997 | |
| DE | 19711537 | A1 * | 10/1998 | E01F 15/0476 |
| DE | 19923684 | A1 * | 12/1999 | E04B 1/4121 |
| DE | 19854192 | C1 * | 5/2000 | E04G 15/04 |
| EP | 1045087 | A1 * | 10/2000 | B28B 23/005 |
| EP | 2927382 | A1 * | 10/2015 | E04B 1/4121 |
| GB | 2133103 | A * | 7/1984 | E04B 1/4121 |
| KR | 200419724 | Y1 * | 6/2006 | E04B 1/4121 |
| WO | WO-9513436 | A1 * | 5/1995 | E04B 1/4121 |
| WO | WO-9516140 | A1 * | 6/1995 | E04G 15/04 |
| WO | WO-2012129177 | A1 * | 9/2012 | B28B 23/005 |
| WO | WO-2014025760 | A2 * | 2/2014 | E04B 1/4114 |

OTHER PUBLICATIONS

EPO, Supplementary Search Report, EP 17750850.4, dated Aug. 20, 2019.

* cited by examiner

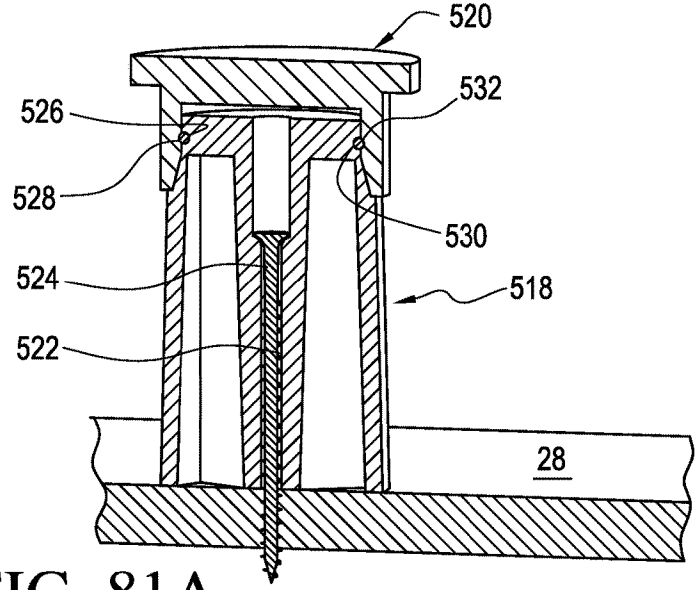
FIG. 81A
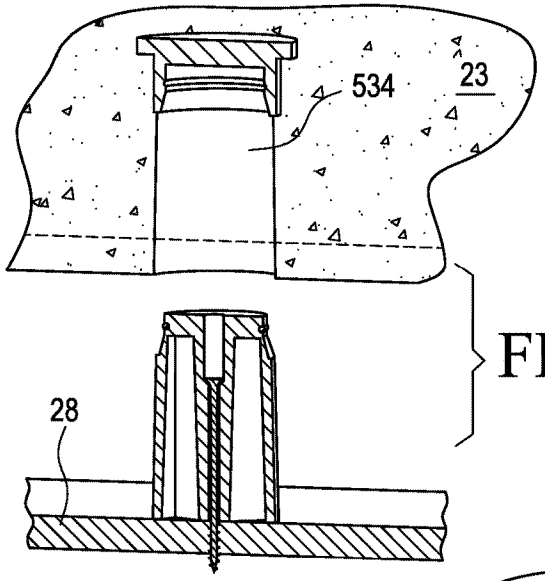
FIG. 81B
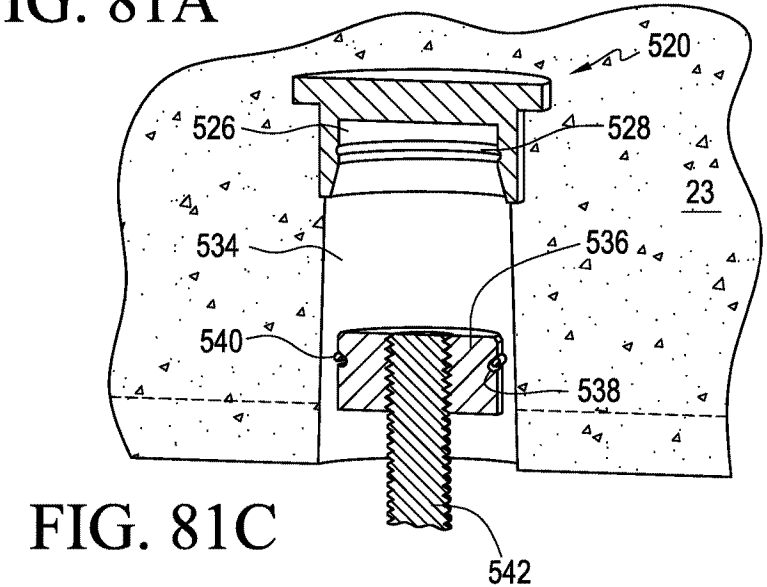
FIG. 81C
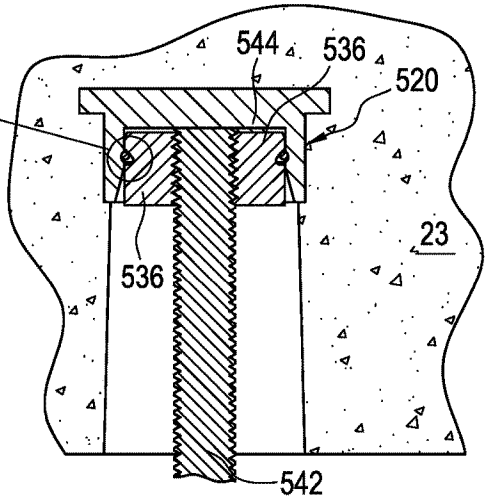
FIG. 81D
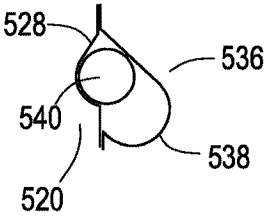
FIG. 81E
FIG. 81E

CONCRETE ANCHOR BODIES AND PLUGS

RELATED APPLICATIONS

This is a divisional application of application Ser. No. 15/854,285, filed Dec. 26, 2017, which is a divisional application of application Ser. No. 15/429,345, filed Feb. 10, 2017, which is nonprovisional application of Provisional Application Ser. No. 62/294,231, filed Feb. 11, 2016, all of which afore-mentioned applications are hereby incorporated by reference.

FIELD OF THE INVENTION

The present invention is generally directed to an anchor embedded in a concrete structure for transferring load to the concrete structure, and particularly to placing the anchor within the concrete structure and be accessible for connection to a load.

SUMMARY OF THE INVENTION

The present invention provides an anchor for being embedded in concrete for attachment to a fastener to support a load, comprising a plug having a main body portion extending upwardly from a base portion, the plug for being attached to a form board prior to pouring of concrete, the plug having an end portion disposed a distance from the form board; and an anchor body attached to the end portion. The plug is separable from the anchor body and removable from the concrete after the concrete is cured, leaving the anchor body embedded in the concrete, the plug providing a void in the concrete after removal to provide an access opening for a threaded portion of a fastener to attach to the anchor body.

The present invention also provides a plug for forming threads in concrete for attachment to a fastener to support a load, the plug for attachment to a form board prior to pouring of concrete, the plug including an end portion disposed a distance from the form board. The end portion is threaded for molding threads in the concrete. The plug is removable from the concrete after the concrete is cured, leaving a mold of the threads in the concrete, the plug providing a void in the concrete after removal from the concrete to provide an access opening for a threaded portion of a fastener to attach to the threads molded in the concrete.

The present invention further provides an anchor for being embedded in concrete for attachment to a fastener to support a load, comprising a plug having a main body and a base attached to the main body, the base for attachment to a form board prior to pouring of concrete, the main body including an end portion disposed a distance from the form board; an anchor body attached to the end portion; the main body including an opening extending from the base to the end portion, the opening providing an access opening for a threaded portion of a fastener to attach to the anchor body embedded in the concrete after the base is removed after the concrete has cured.

A plug for forming an impression in concrete for attachment to a fastener to support a load, the plug for attachment to a form board prior to pouring of concrete, the plug including an end portion disposed a distance from the form board; the end portion including a first circumferential groove and a removable ring partly disposed in the groove, the ring for molding a circular groove in the concrete. The plug is removable from the concrete after the concrete is cured, leaving a mold of the ring in the concrete, the plug providing a void in the concrete after removal to provide an access opening for a cylindrical body with a second circumferential groove with a locking ring to attach to the first circumferential groove in the concrete, the cylindrical body being attached to a fastener for securing a load.

BRIEF DESCRIPTION OF THE DRAWINGS

FIG. 81A is a perspective cross-sectional view of a plug attached to an anchor body with cooperating grooves and a compressible ring.

FIG. 81B is a perspective cross-sectional view of the plug of FIG. 81A embedded in concrete, showing the plug removed from the concrete and the anchor body remaining in the concrete.

FIG. 81C is a perspective cross-sectional view of the anchor body embedded with the plug removed, showing an anchor rod attached to a cylindrical nut with a locking groove and ring.

FIG. 81D is cross-sectional view of the anchor body embedded in concrete with the plug removed, showing the cylindrical nut attached to the anchor body with locking grooves and ring.

FIG. 81E is an enlarged cross-sectional view of the locking grooves and ring.

FIG. 83D is a cross-sectional view of the cylindrical nut attached to the grooves in the concrete after the plug is removed from the concrete.

FIG. 84A is a perspective cross-sectional view of a plug attached to a nut with a cap.

FIG. 84B is a perspective view of the plug of FIG. 84A.

FIG. 84C is a perspective cross-sectional view of the plug of FIG. 84A embedded in concrete, showing a threaded rod attached to the nut.

FIG. 84D is a side elevational view of the plug of FIG. 84A, showing a breakout cone generated by the nut when subjected to a downward load.

FIG. 84E is bottom perspective view of the plug of FIG. 84A, showing the nut exposed below the cap.

FIG. 85A is a perspective cross-sectional view of a plug attached to multiple nuts with different diameter threaded openings covered with a cap.

FIG. 85B is a top perspective view of the plug of FIG. 85A.

FIG. 85C is a perspective cross-sectional view of the plug of FIG. 85A embedded in concrete, showing a threaded rod attached to the smaller diameter nut.

FIG. 85D is a top perspective view of the plug of FIG. 85A, showing slots in the cap.

FIG. 86A is a perspective cross-sectional view of a base portion of a plug, showing a weakened area around a screw that attaches the plug to a form board.

FIG. 86B is a perspective cross-sectional view of the plug of FIG. 86A embedded in concrete, showing the form board, the weakened area around each screw separated from the plug, and staying attached to the form board.

Figure 87A:
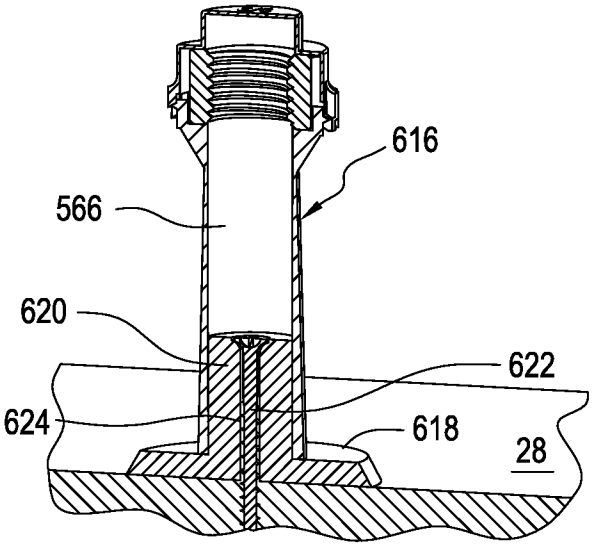

FIG. 87A is perspective cross-sectional view of a plug, showing a base attached to the main body of the plug by a close fit.

Figure 87B:
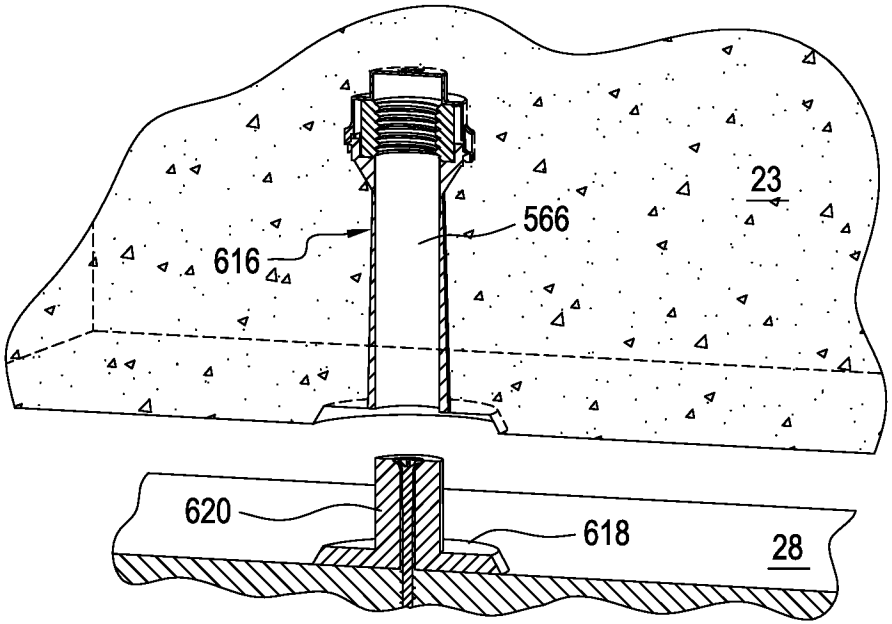

FIG. 87B is a perspective cross-sectional view of the plug of FIG. 87A embedded in concrete, showing the base removed from the plug and remaining attached to the form board.

Figure 88B:
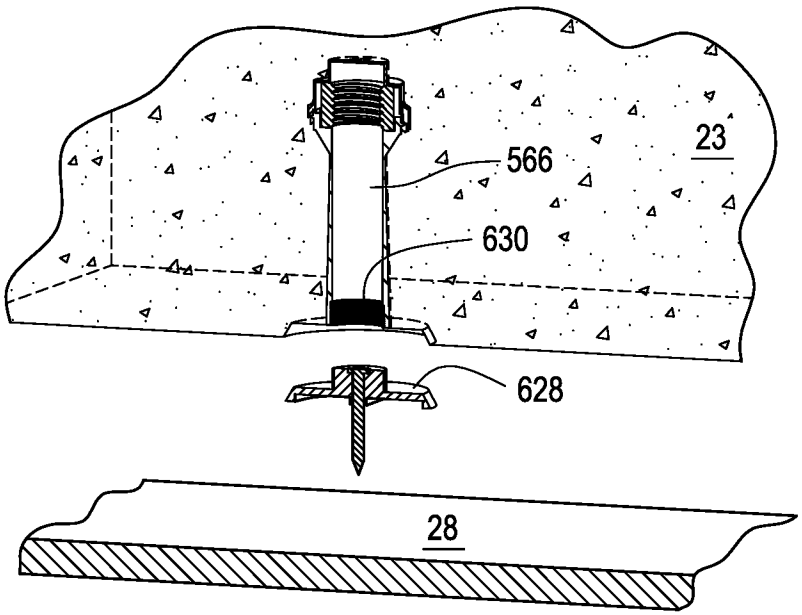
Figure 88A:
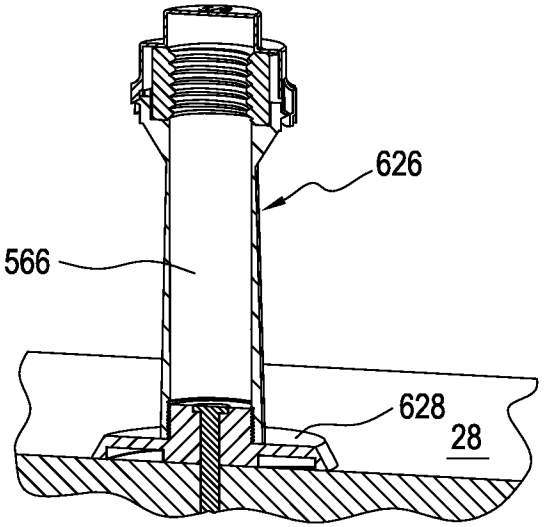

FIG. 88A is a perspective cross-sectional view of a plug with a base threaded to a bottom portion of the plug.

FIG. 88B shows the plug of FIG. 88A embedded in concrete, showing the form board separated from the concrete and the base unscrewed from the plug.

FIGS. 89A-91B are perspective cross-sectional views of a plug, showing various methods of attaching the plug to the form board that allows the attaching screw to remain attached to the form board when the form board is removed from the cured concrete.

DETAILED DESCRIPTION OF THE INVENTION

Figure 1:
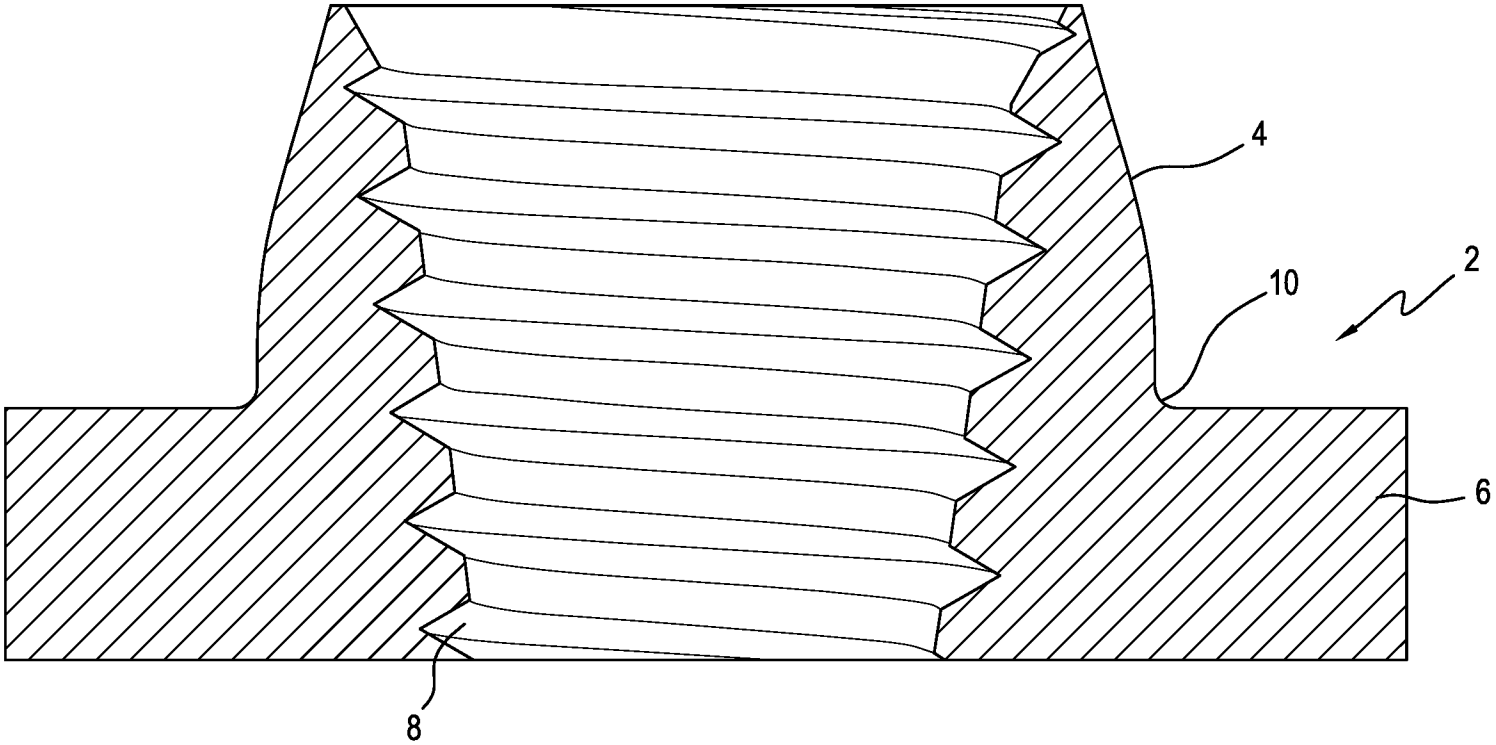
FIG. 1 shows a cross-sectional view of an anchor body with tapered threads embodying the present invention.

FIG. 1 shows an anchor body 2 formed from a metal flat plate or bar. Through form drilling, friction heats up, softens and displaces material through the thickness of the plate, forming an opening through the plate and the boss section 4 as one piece with the base section 6. Tapered threads 8 are made by form threading. A radius 10 is provided where the boss section meets the base section. The boss section 4 is tapered and circular in cross-section.

Figure 2:
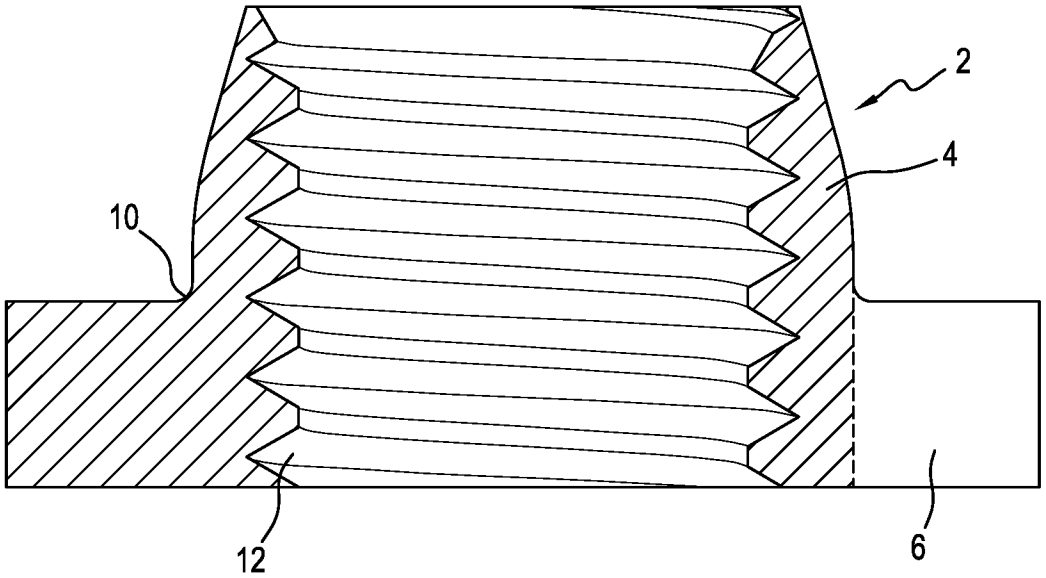
FIG. 2 shows a cross-sectional view of an anchor body with straight threads embodying the present invention.

FIG. 2 shows the anchor body 2 of FIG. 1 with straight threads 12. The base section 6 at the bottom of the boss section makes a 1:1 ratio with the thickness of the base section. The anchor body is a single piece anchor, the threaded portion and the bearing portion being in one piece. The anchor 2 works with the boss section 4 facing any direction, either toward or away from the direction of the load. The anchor 2 advantageously provides the threads 12 to be long enough to create the required thread bearing area without increasing the thickness of the base section 6. The anchor advantageously provides thread engagement length greater than the thickness of the base section 6.

Figure 3:
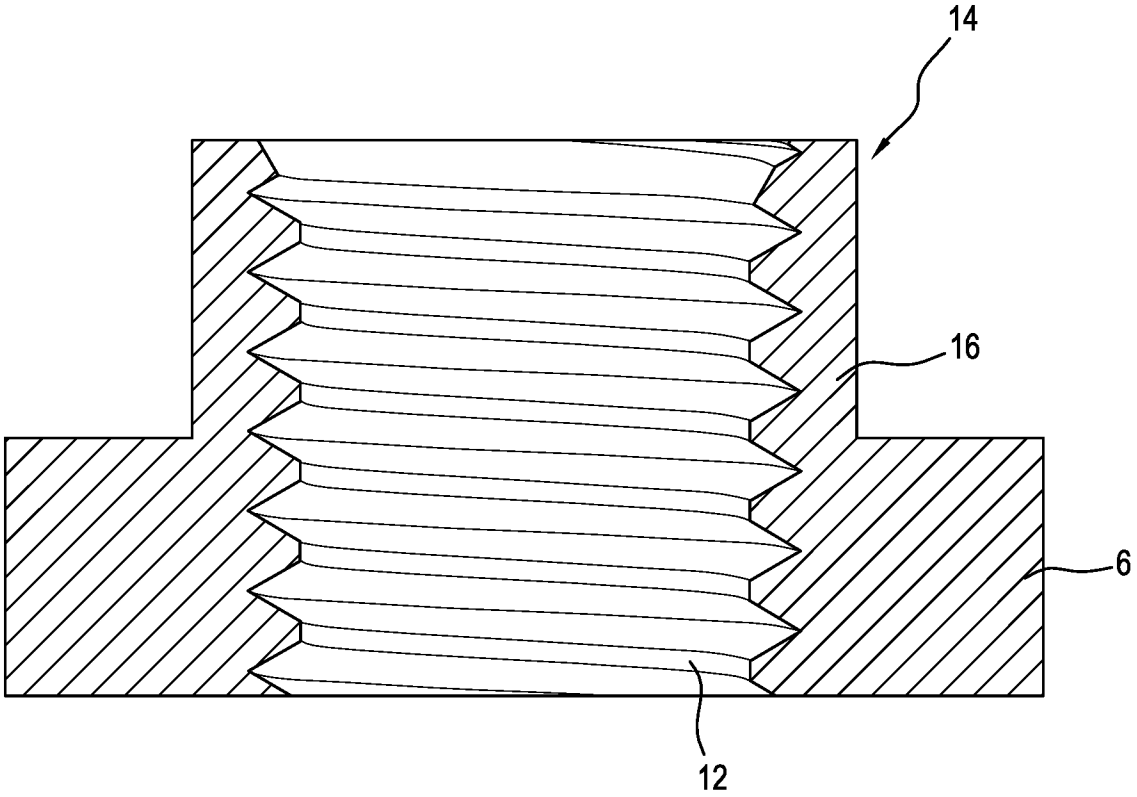
FIG. 3 shows a cross-sectional view of another anchor body embodying the present invention.

FIG. 3 shows an anchor body 14 formed from form drilling and form threading, as in the anchor 2. The boss section 16 has no circular cross-section and is not tapered. A right angle transition (no radius) is formed at the corner of the boss section and the base section 6. Straight threads 12 are formed from form threading.

Figure 4:
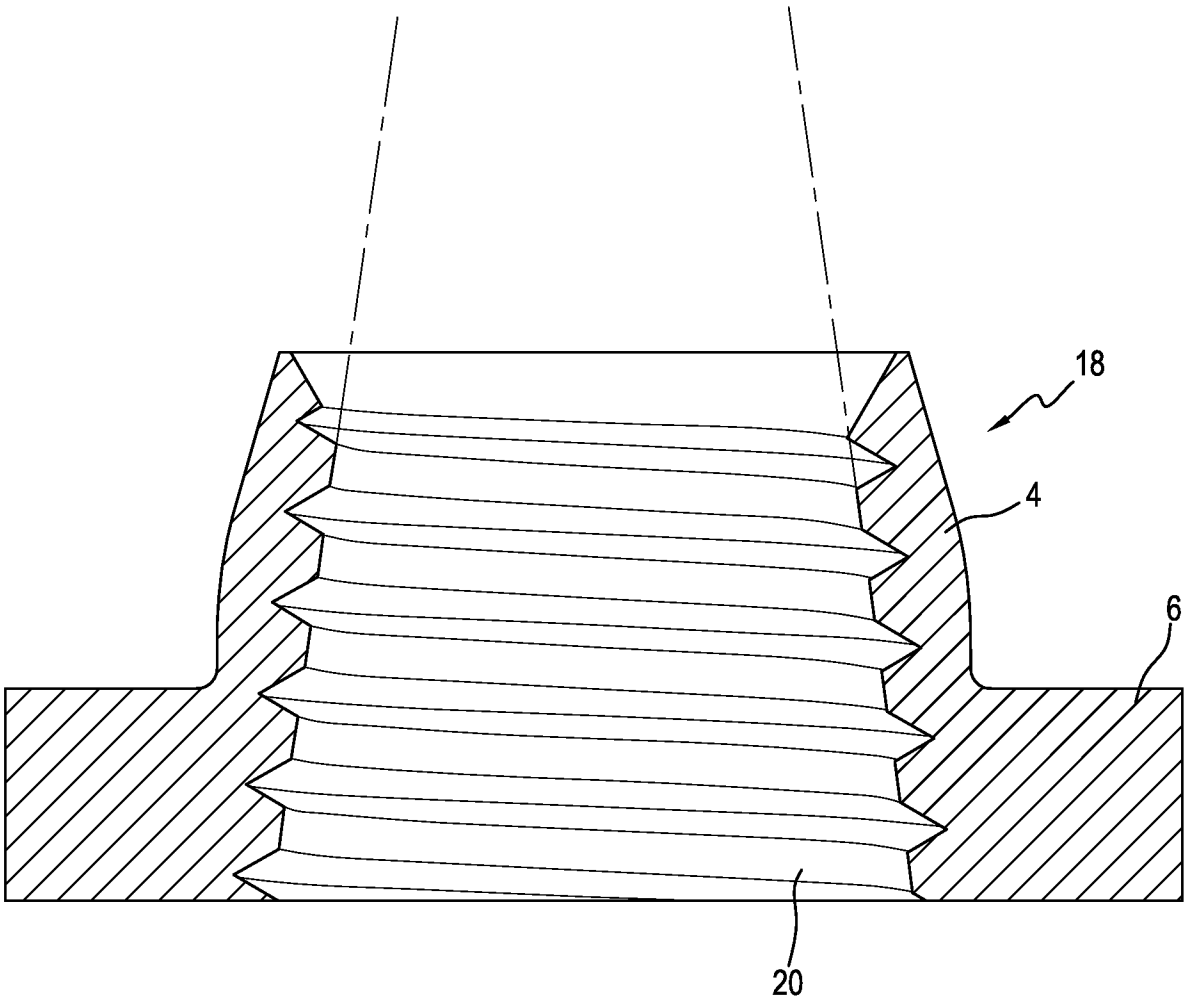
FIG. 4 shows a cross-sectional view of yet another anchor body embodying the present invention.

FIG. 4 shows an anchor body 18 similar to the anchor 2 but with reverse tapered threads 20.

Figure 5A:
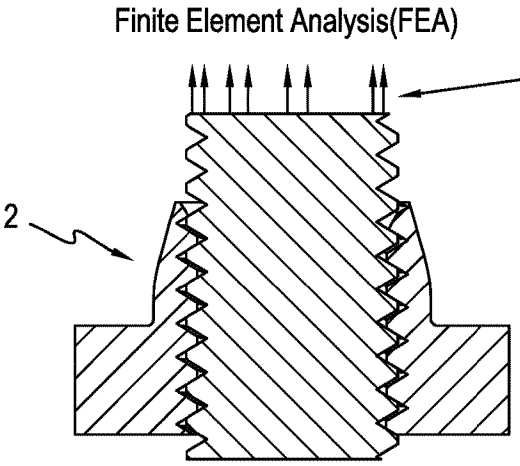
FIGS. 5A-5D show finite element analysis of the anchor body shown in FIG. 2.
Figure 5B:
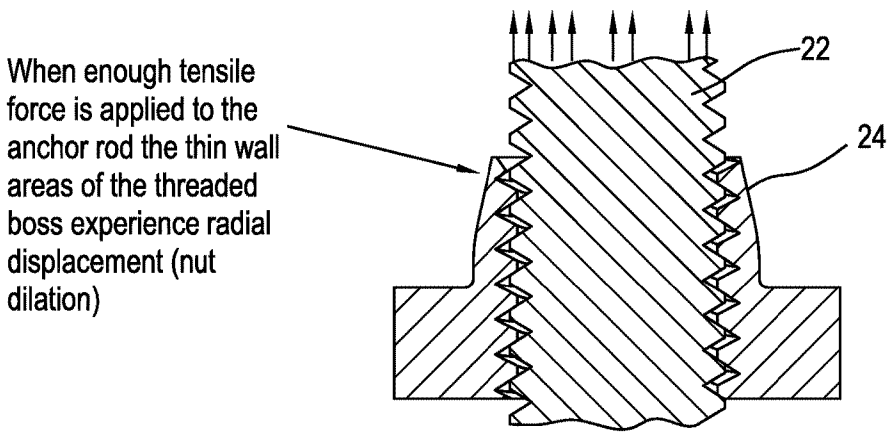
Figure 5C:
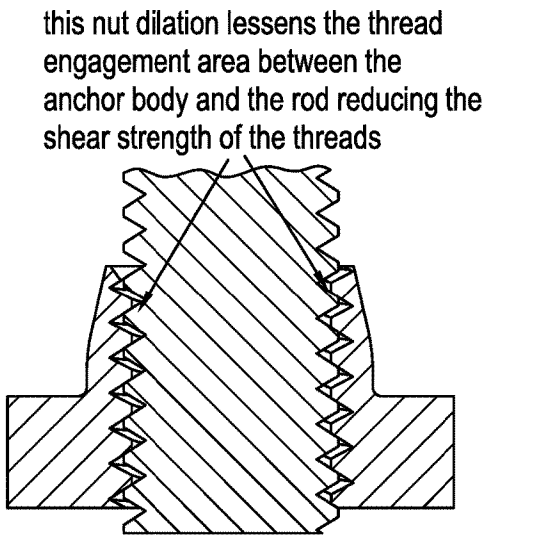

FIGS. 5A-5C show the anchor body 2 with straight threads 12 attached to a threaded rod 22, which is subjected to tensile force. The thin wall portion 24 tends to spread radially outwardly, decreasing the area of engagement of the threads 12 with threaded rod 22.

Figure 5D:
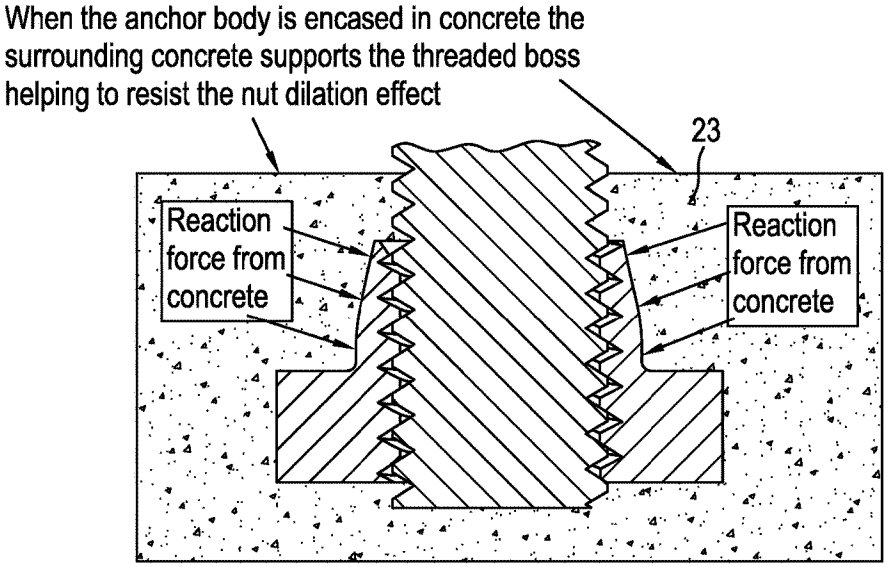

FIG. 5D shows the thin wall portion 24 being subject to compression force within the concrete 23 toward the threaded rod due to the tapered shape of the boss section 4, thereby maintaining full contact of the threads 12 with the threaded rod 22.

Figure 6B:
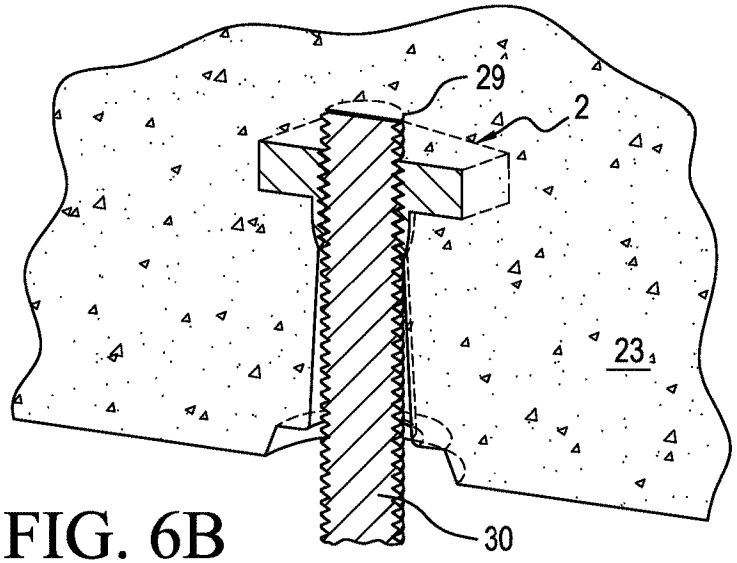
FIG. 6B is a perspective cross-sectional view of FIG. 6A after the plug is removed from the concrete and showing a threaded rod attached to the anchor body for supporting a load.
Figure 6D:
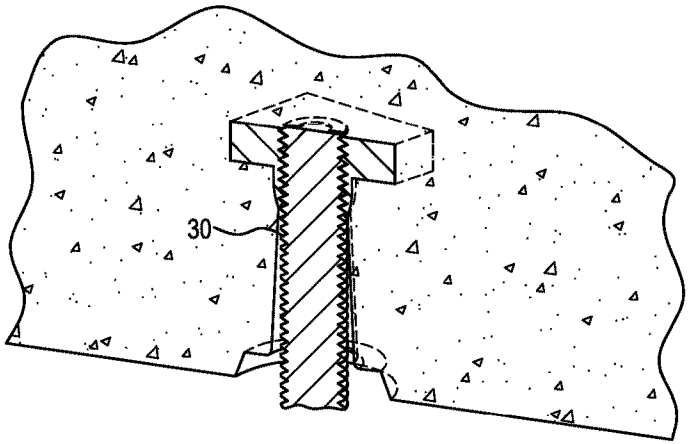
FIG. 6D is a perspective cross-sectional view of FIG. 6C after the plug is removed from the concrete and showing a threaded rod attached to the anchor body for supporting a load.
Figure 6A:
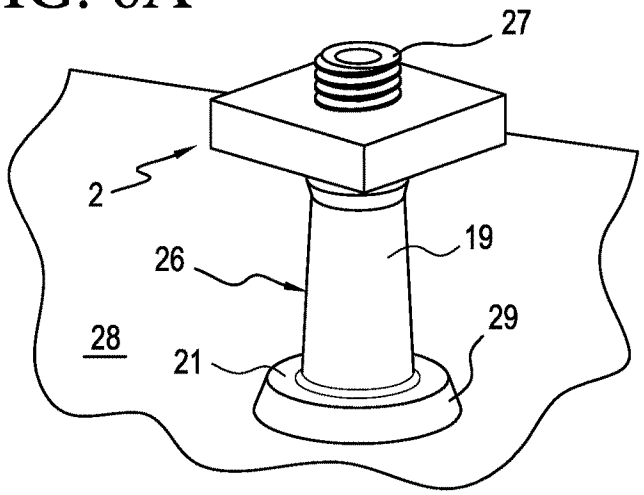
FIG. 6A is a perspective view of an anchor body shown in FIG. 2 attached to a plug embodying the present invention.

FIG. 6A shows the anchor body 2 attached to a plastic plug 26 for attachment to a form board 28 prior to concrete being poured. The plug positions the anchor at a sufficient depth in the concrete where a breakout cone meets or exceeds the required strength to carry a load. The plug has a main body portion 19 in the shape of a column 19 extending upwardly from a base portion 21. The exterior shape of the main body portion 19 is tapered, such as conical shaped, for easy removal from the concrete. The exterior surface 29 of the side wall of the base portion 21 is also tapered or conical shaped. The plug has a threaded portion 27 that mates with the threads 12 of the anchor to seal the threads 12 from the concrete. A portion of the threaded portion 27 extends past the top surface of the anchor 2 to form the concrete.

FIG. 6B is a cross-section view through the anchor body 2 embedded in concrete 23 with a threaded rod 30 attached to the anchor 2 after the plug 26 has been removed, along with the form board 28 after the concrete 23 has cured. The fastener 30 extends past the top part of the anchor 2 into a threaded cavity 29 formed by the threaded portion 27.

Figure 6C:
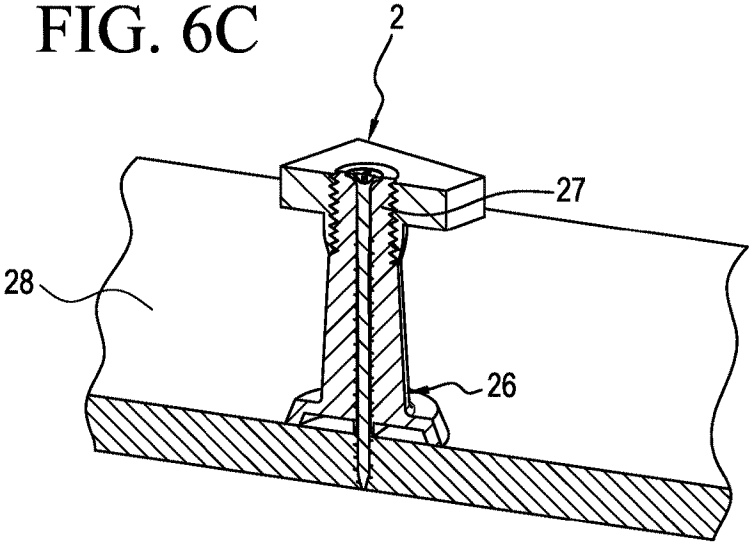
FIG. 6C is a perspective cross-sectional view of the anchor body of FIG. 2 attached to the plug of FIG. 6A without the plug extending past the top of the anchor body.

FIG. 6C is a cross-sectional view of the plug and the anchor body of FIG. 6A, except that the threaded portion 27 does not extend past the top surface of the anchor body 2. The plug includes a central opening for receiving a screw or nail for attachment of the plug to the form board.

FIG. 6D shows the plug 26 embedded in concrete 23, with the plug 26 removed after the concrete cured and the fastener 30 attached to the anchor body 2.

Figure 7:
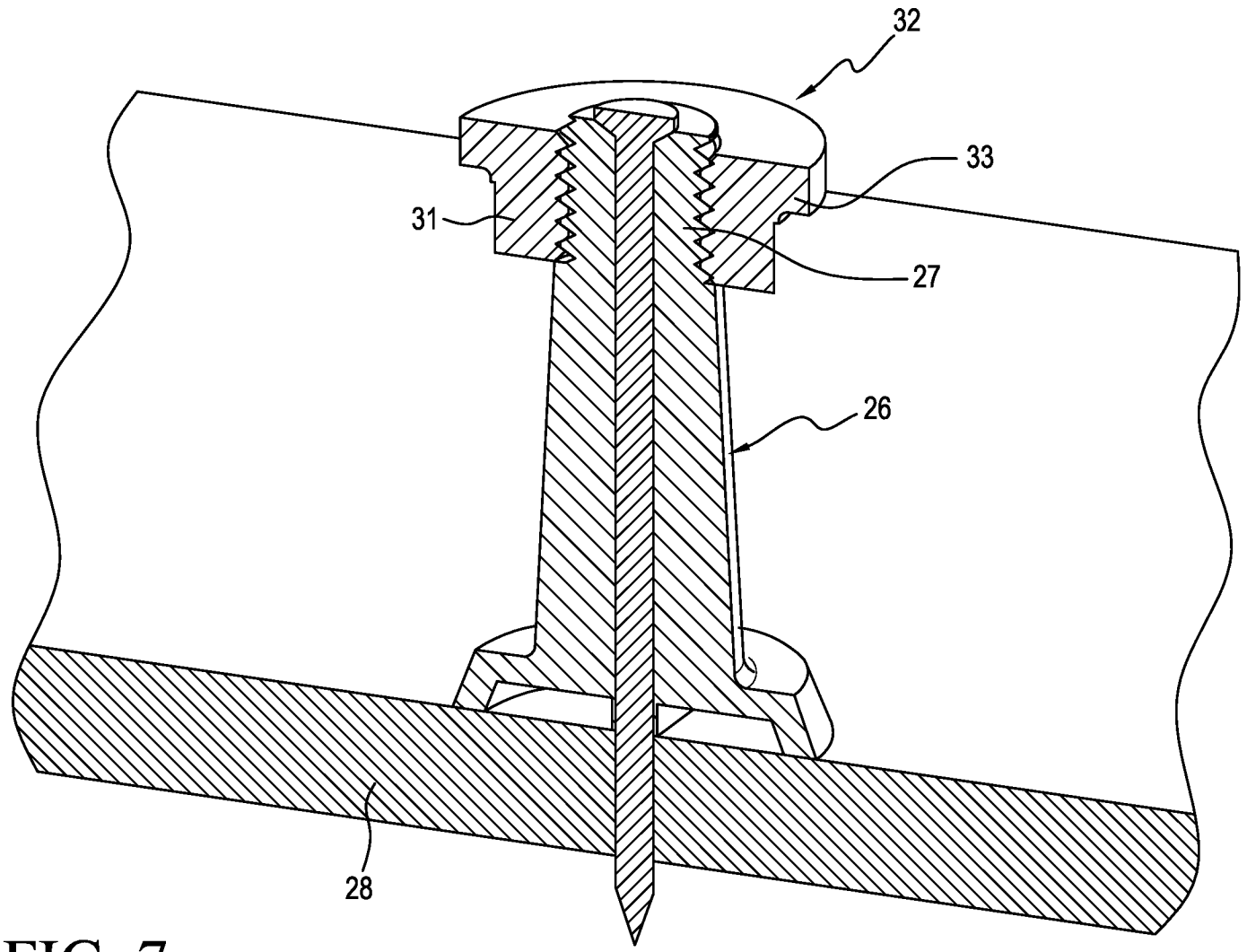
FIG. 7 is a perspective cross-sectional view of a plug attached to another anchor body made of a nut integrated with a flange or washer.

FIG. 7 shows an anchor body 32 supported by the plug 26. The anchor body is a nut body portion 31 with an integrated washer or flange portion 33.

Figure 8A:
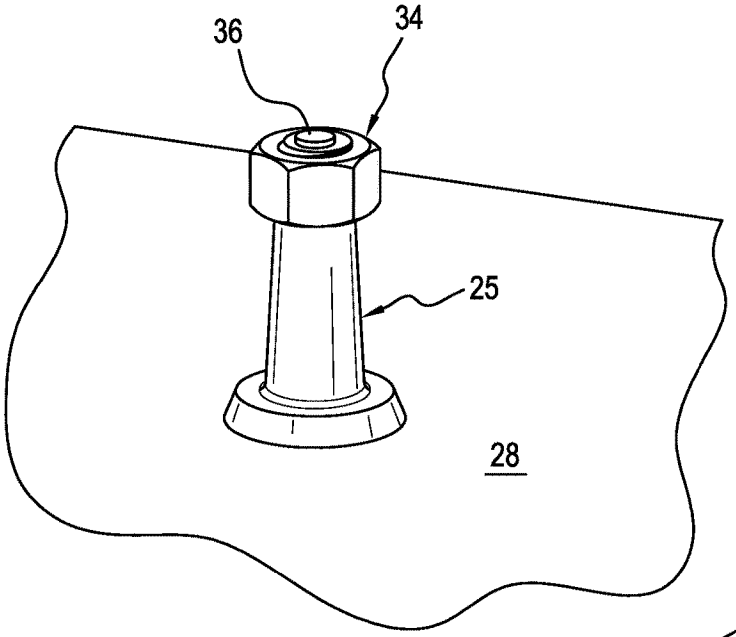
FIG. 8A is a perspective view of the plug shown in FIG. 7 attached to a nut used as an anchor body.

FIG. 8A shows a plug 25 supporting a nut 34, which is used as an anchor body to be embedded in concrete at a location that will generate a sufficient breakout cone to support the load designed for it. A nail secures the plug to the form board 28.

Figure 8B:
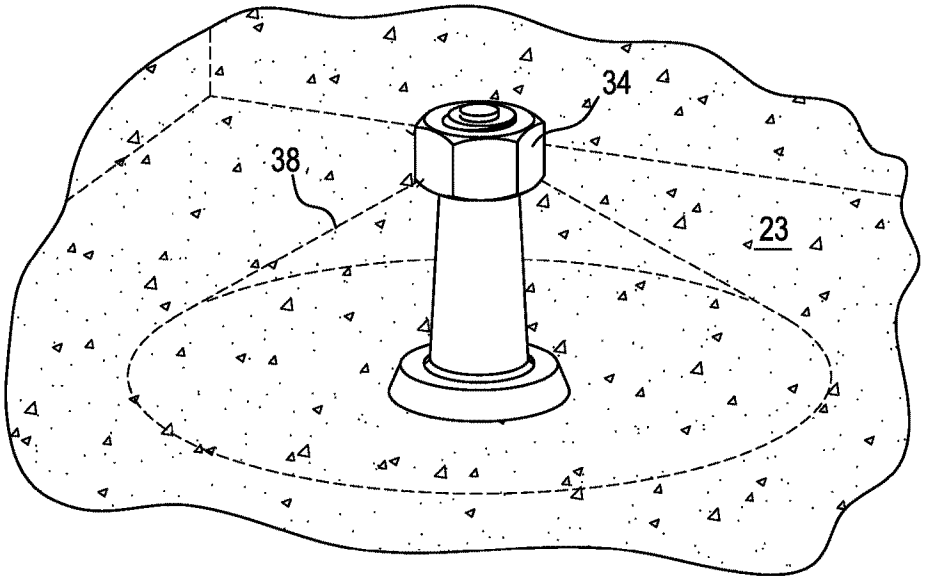
FIG. 8B is a perspective view of the plug of FIG. 8A embedded in concrete, showing a breakout cone generated by the nut attached to an anchor rod supporting a load below.

FIG. 8B shows the nut 34 embedded in concrete 23 and the breakout cone 38 in the concrete 23 that the nut 34 will create when placed under a load.

Figure 9:
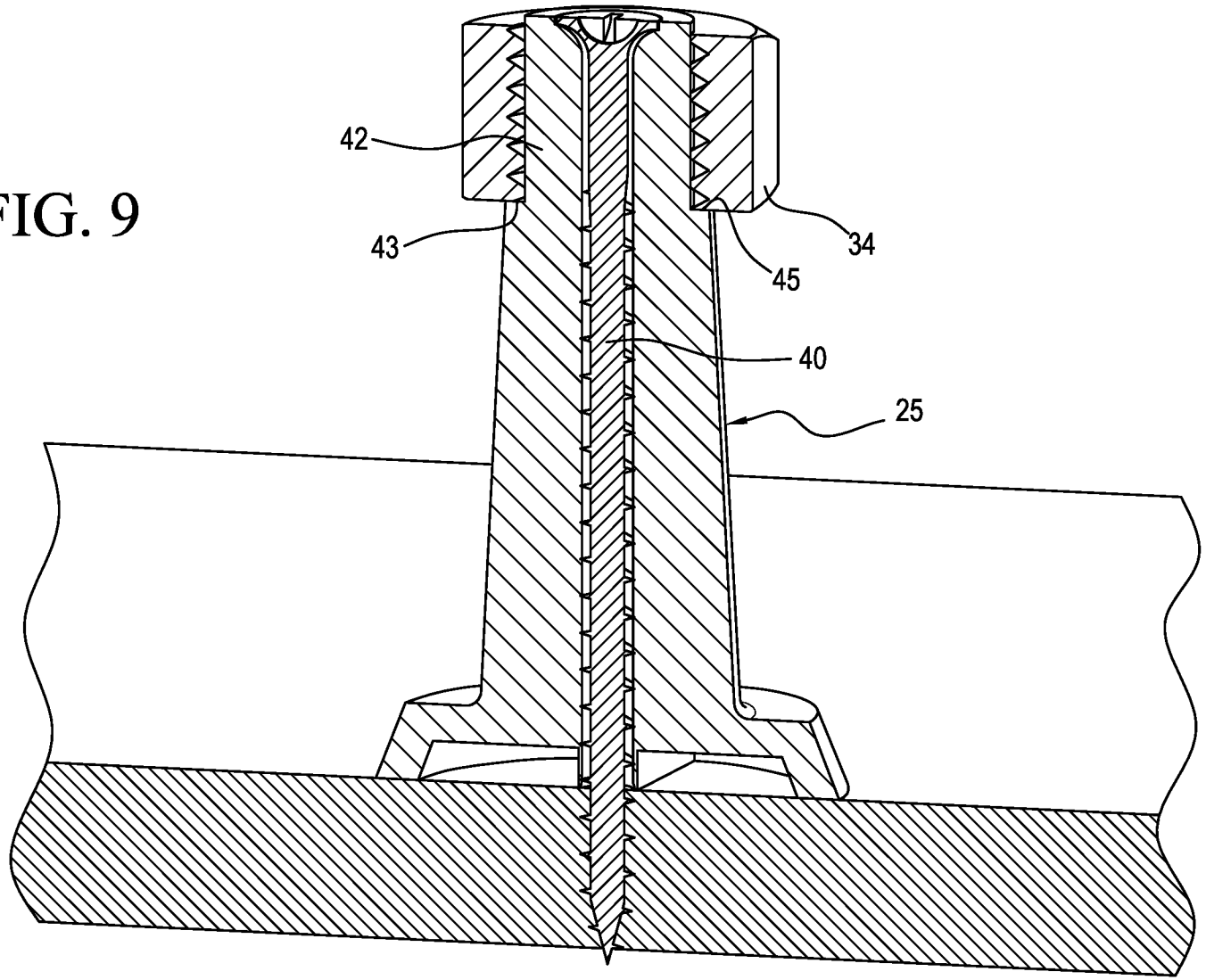
FIG. 9 is a perspective cross-sectional view of another plug attached to a nut used as an anchor body.

FIG. 9 is cross-sectional view of the plug 25 shown in FIG. 8A. A screw 40 is used to secure the plug to the form board. The plug 25 includes a smooth cylindrical portion 42 attached with interference/friction fit with the nut anchor body 34. The plug 25 is similar to the plug 26. The shoulder 43 is in sealing contact with the bottom surface 45 of the nut to seal out the concrete.

Figure 10:
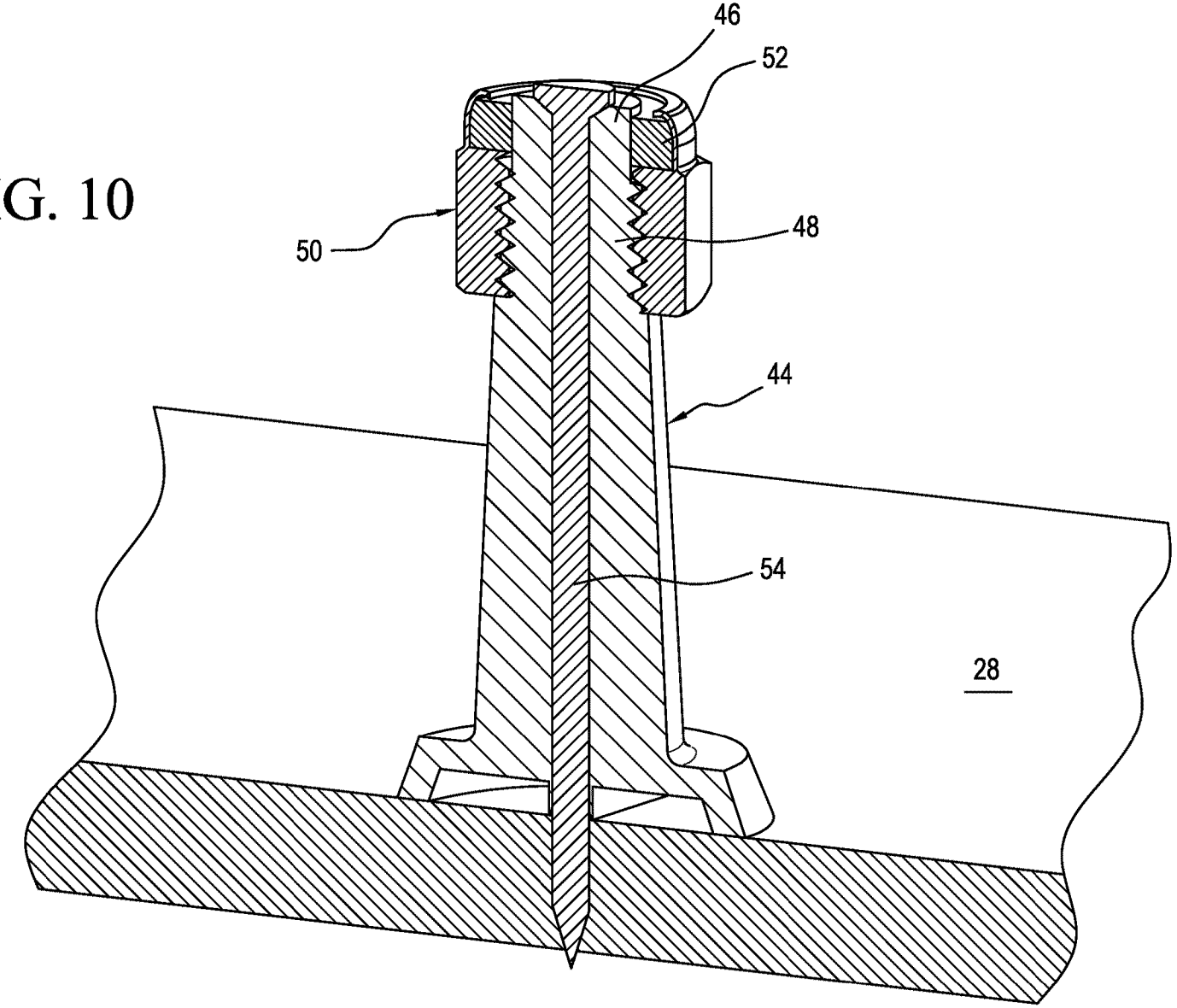
FIG. 10 is a perspective cross-sectional view of another embodiment of a plug attached to a Nylon locknut used as an anchor body.

FIG. 10 shows a plug 44 with a smooth cylindrical portion 46 and a threaded portion 48. A Nylon lock nut 50 used as an anchor body includes a Nylon washer 52 in sealing attachment to the smooth portion 46. The Nylon lock nut is conventional. A nail 54 attaches the plug to the form board 28. The plug 44 is similar to the plug 26.

Figure 11:
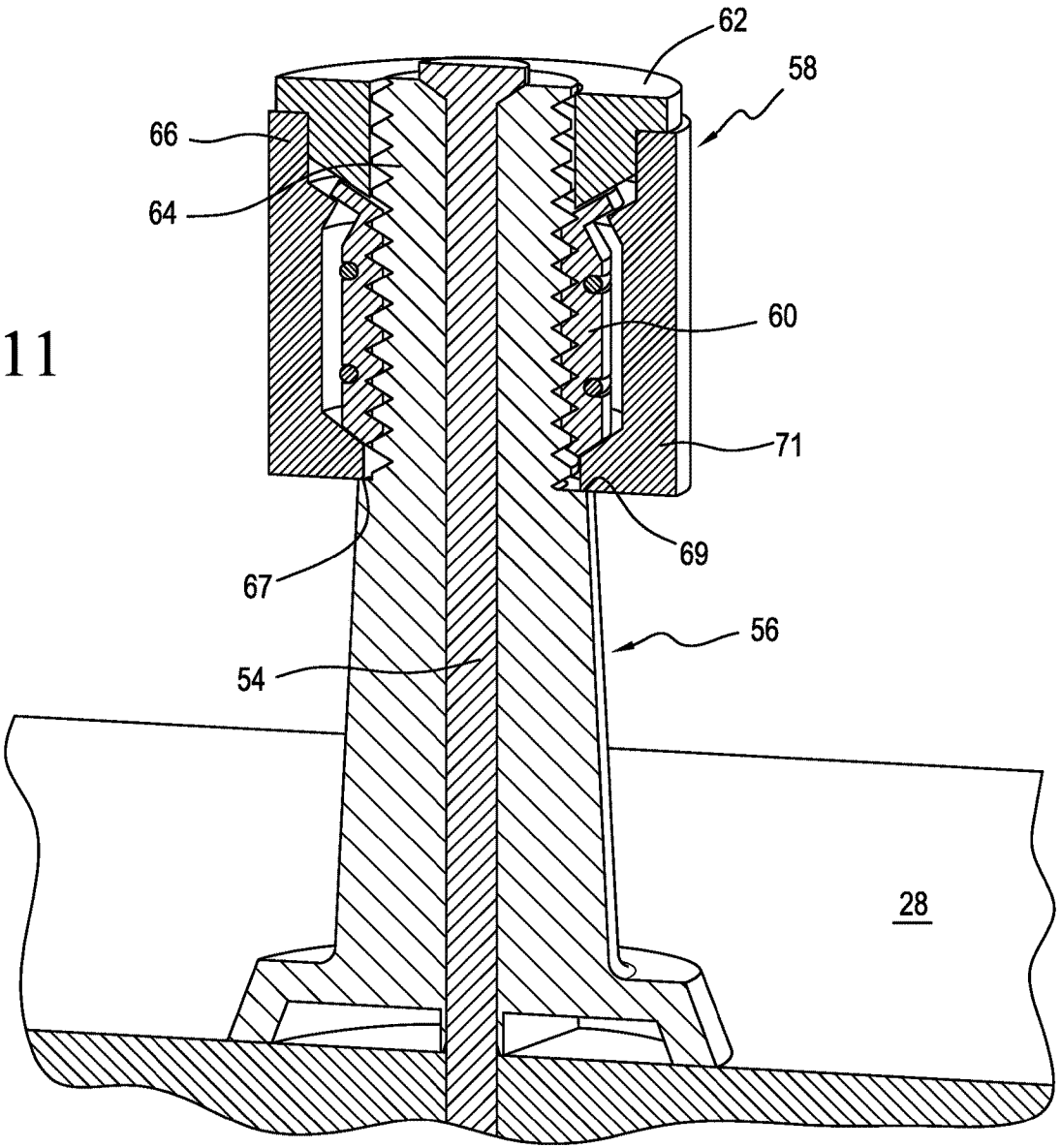
FIG. 11 is a perspective cross-sectional view of the plug shown in FIG. 7 attached to split nut used an anchor body.

FIG. 11 shows a plug 56 attached to a split nut 58 used as an anchor body. The split nut 58 is disclosed in U.S. Pat. No. 9,222,251, herein incorporated by reference. A nail 54 or screw attaches the plug 56 to the form board 28. The split nut sections 60 open radially when a threaded rod is pushed up into it and return to their original size when the threaded rod is pulled down, allowing for the mating of the threads of the sections and the rod. The cap 62 is in sealing attachment to the threaded portion 64 to seal out the concrete. The cap is attached to the housing 66 with screws (not shown). The shoulder 67 is in sealing contact with bottom surface of the housing 69 of the housing 71 to seal out the concrete.

Figure 12:
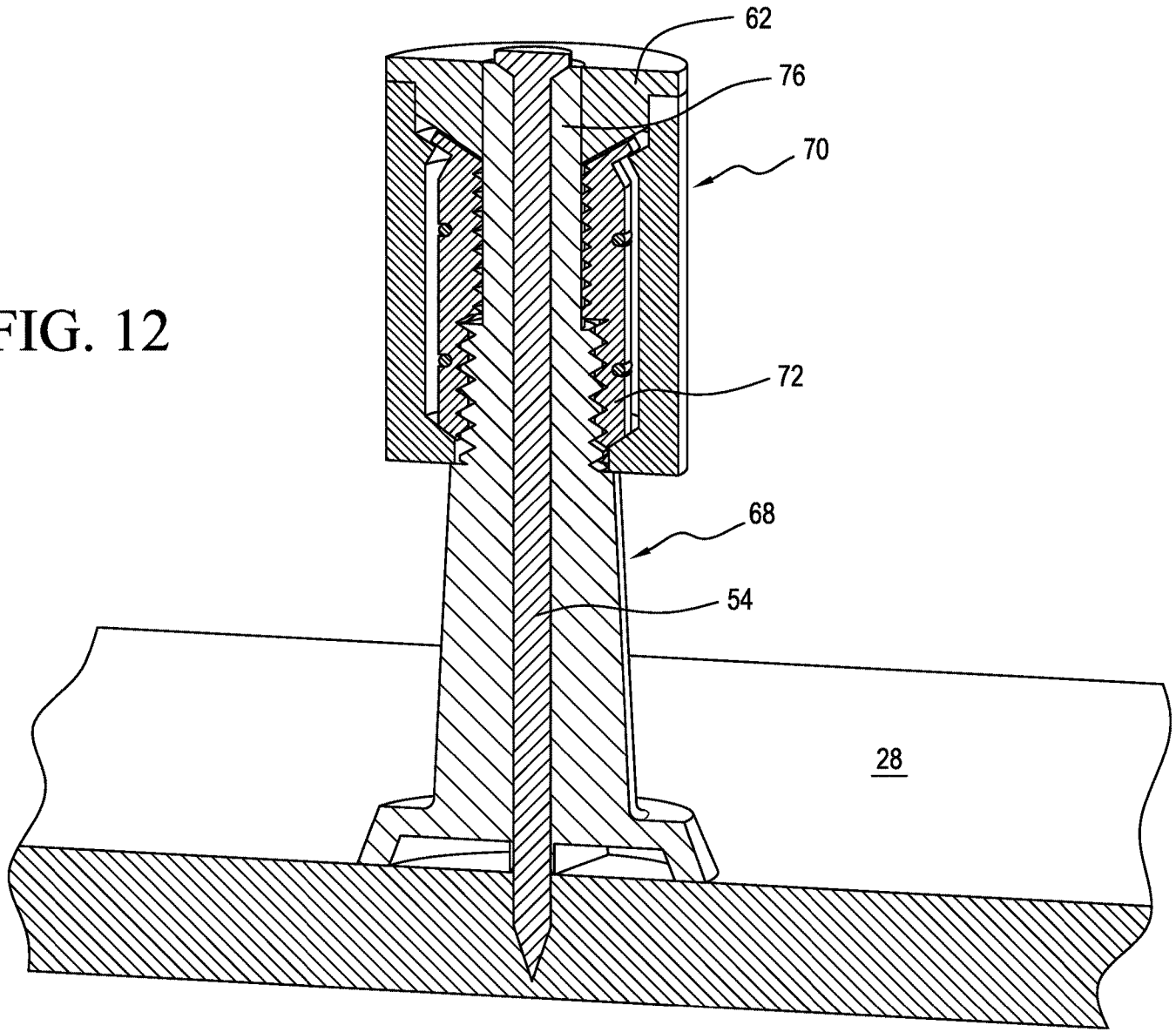
FIG. 12 is perspective cross-sectional view of another embodiment of a plug attached to a split nut having multiple size threaded bores.

FIG. 12 shows a plug 68 supporting a split nut 70 with sections 72 with multiple diameter threads 74. The cap 62 is in sealing attachment to the smooth cylindrical portion 76 to seal out the concrete. The nail 54 or screw attaches the plug 68 to the form board 28.

Figure 13C:
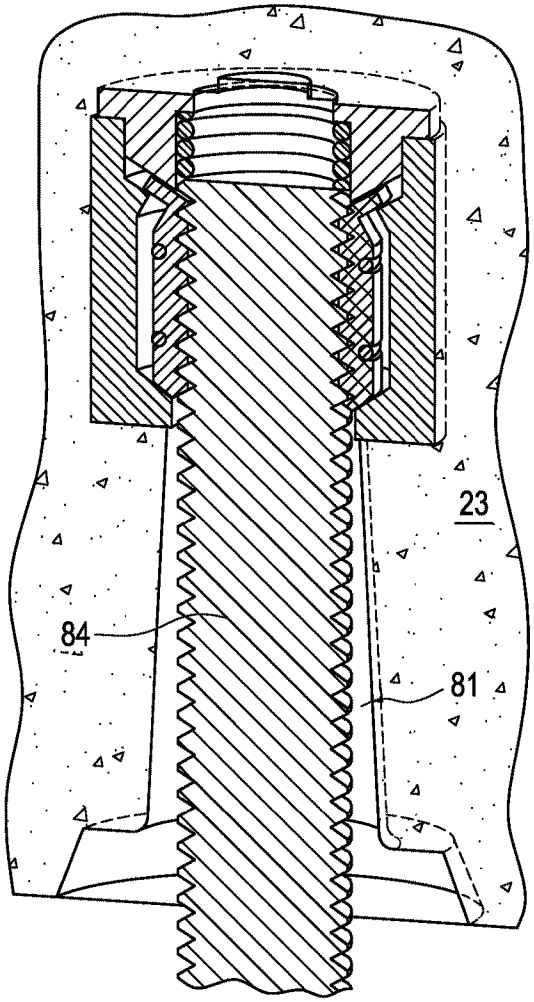
FIG. 13C is a perspective cross-sectional view of FIG. 13B showing a threaded rod attached to the split nut.
Figure 13B:
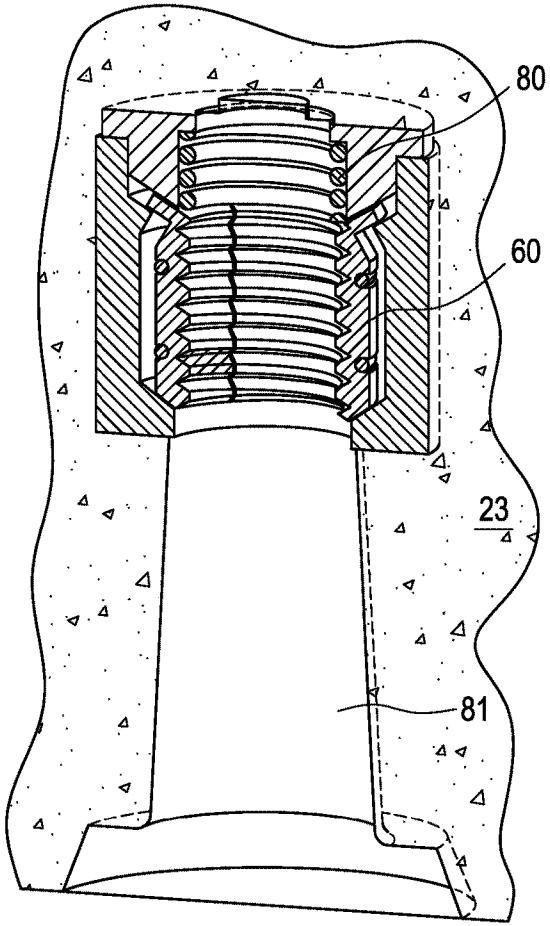
FIG. 13B is a perspective cross-sectional view of FIG. 13A showing the plug removed from the concrete.
Figure 13A:
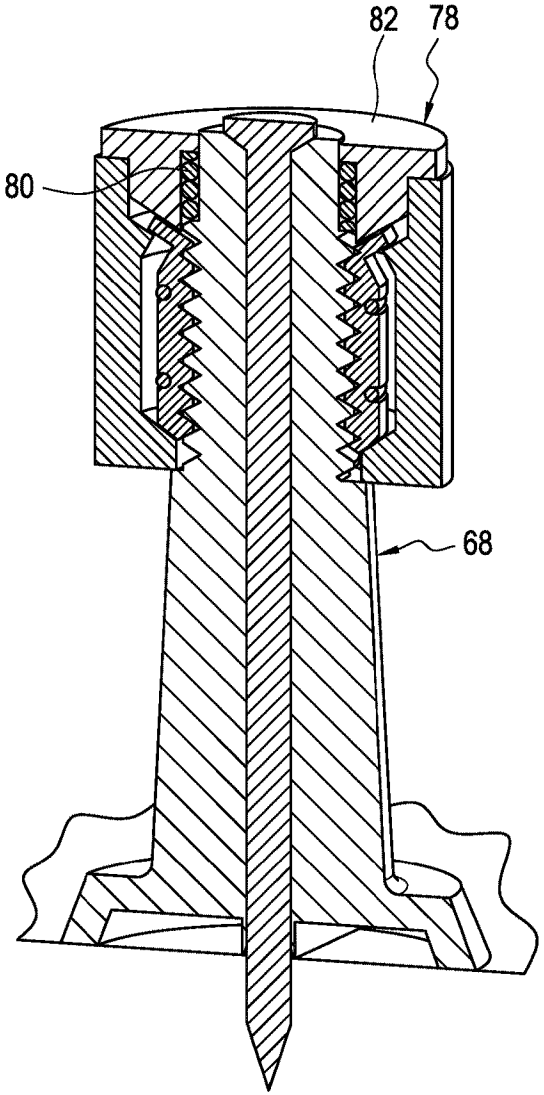
FIG. 13A is a perspective cross-sectional view of a plug attached to a split nut used as an anchor body.

FIG. 13A shows a split nut 78 with a spring 80 disposed in the cap 82 in a compressed state.

FIG. 13B shows the spring in an expanded state after the plug 68 is removed once the concrete 23 is cured. The split nut sections 60 hold the spring 80 in place. A void 81 in the concrete 23 is created after the plug 68 is removed after the concrete has cured.

FIG. 13C shows a threaded rod 84 through the void 81 in the concrete 23 and attached to the split nut sections 60 and pushing the spring 80 into a compressed state, pushing the threaded rod downwardly to help engagement between the split nut section threads and the threads of the rod.

Figure 14B:
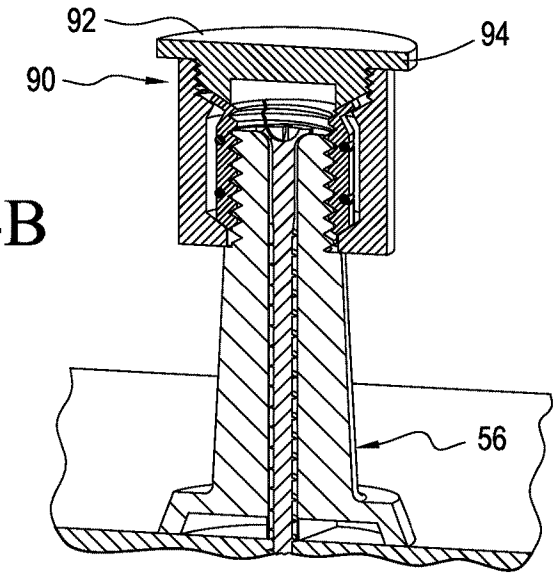
FIG. 14B is a perspective cross-sectional view of the plug of FIG. 14A attached to another embodiment of a split nut used as an anchor body.
Figure 14C:
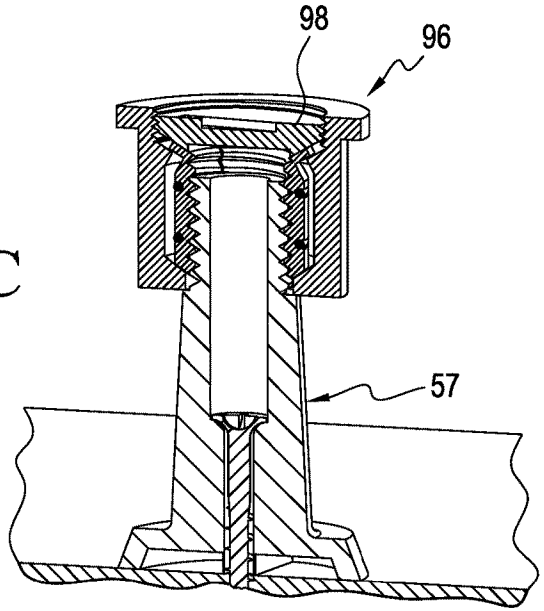
FIG. 14C is a perspective cross-sectional view of another embodiment of a plug attached to another embodiment of a split nut used as an anchor body.
Figure 14A:
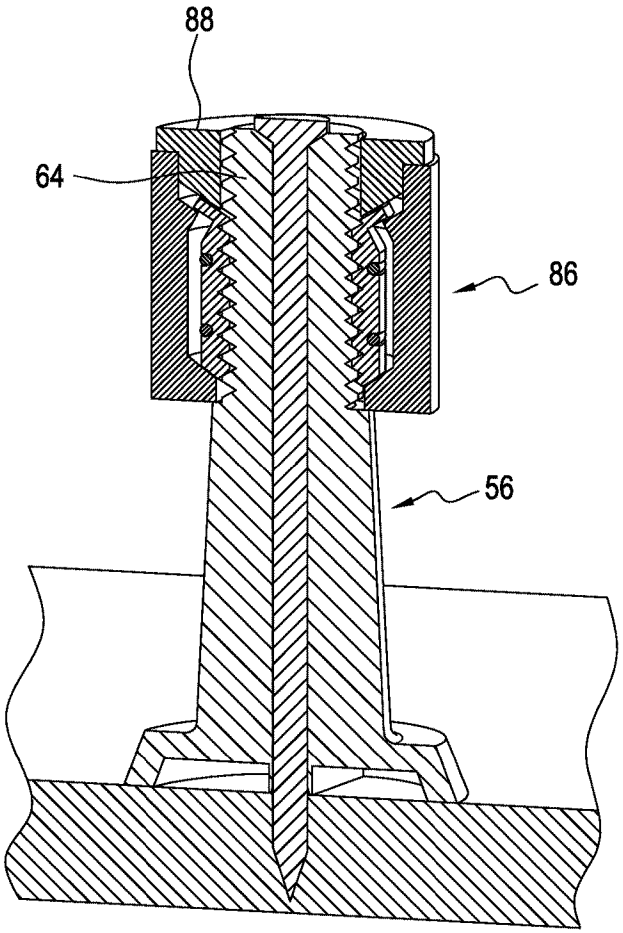
FIG. 14A is a perspective cross-sectional view of the plug of FIG. 11 attached to another embodiment of a split nut used as an anchor body.

FIG. 14A shows the plug 56 attached to a split nut 86 with a threaded cap 88, which is in sealing attachment to the plug threaded portion 64 to seal out the concrete.

FIG. 14B shows the plug 56 attached to a split nut 90 with a cap 92 without an opening on top, unlike the cap 88. The cap 92 has shoulder 94 extending radially outwardly to provide additional bearing area positioned deeper into the concrete.

FIG. 14C shows the plug 56 attached to a split nut 96 with a screwed-on cap 98.

Figure 15:
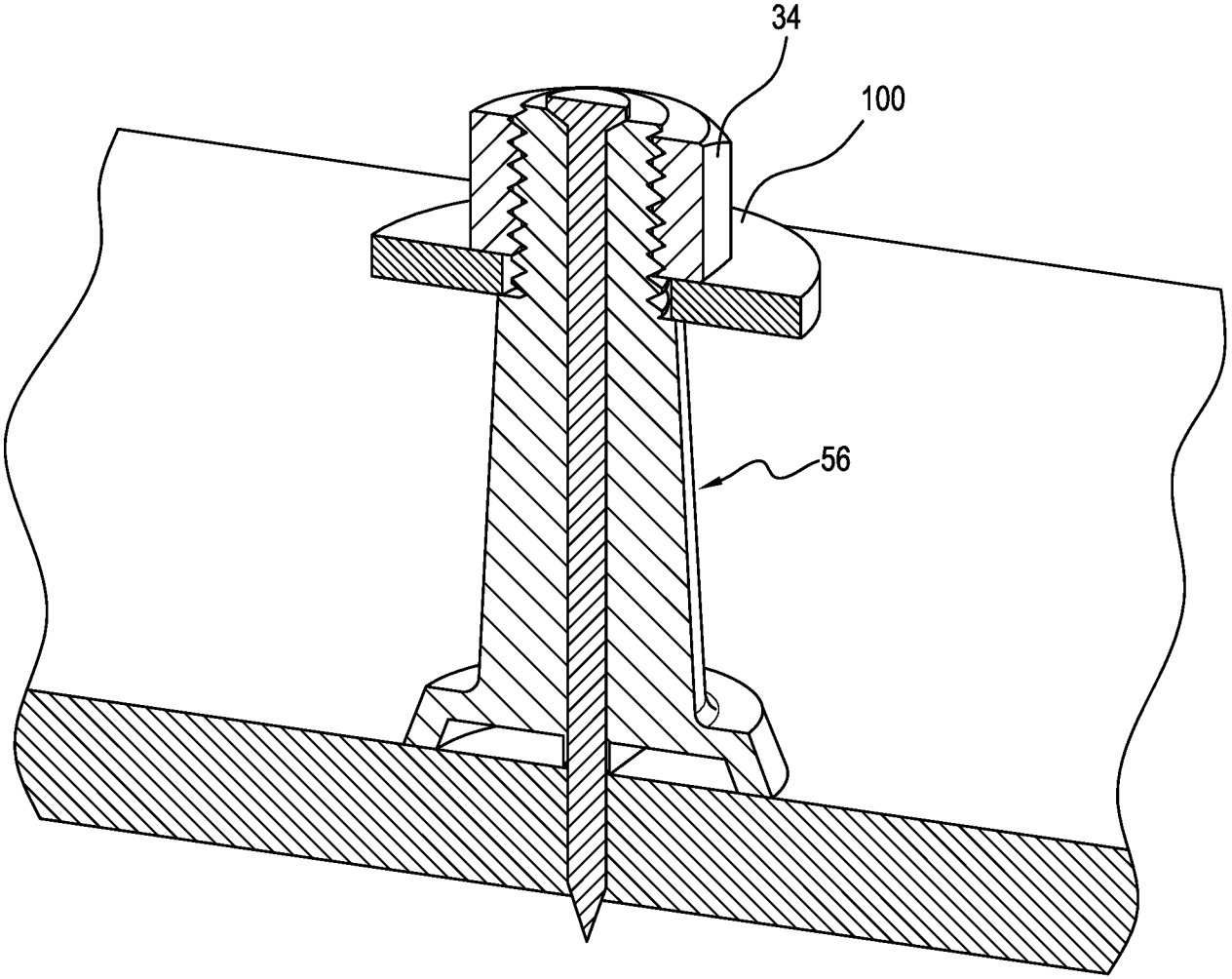
FIG. 15 is a perspective cross-sectional view of the plug of FIG. 11 attached to a nut and a washer, both cooperating as an anchor body.

FIG. 15 shows the plug 56 attached to a washer 100 and the nut 34. The washer increases the bearing area of the nut.

Figure 16:
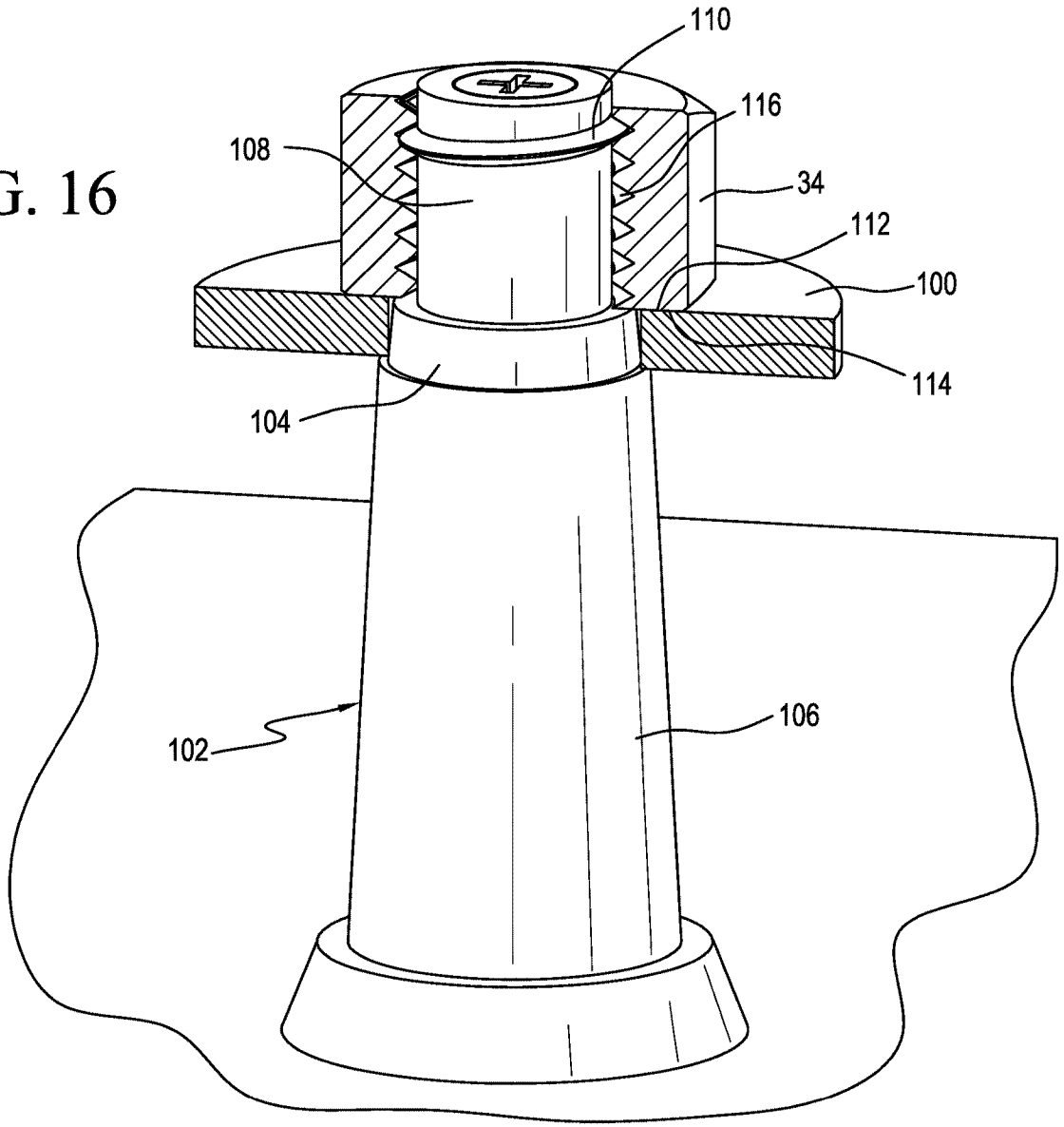
FIG. 16 is a perspective view of another embodiment of a plug attached to a nut and a washer, both shown in perspective cross-section, both cooperating as an anchor body.

FIG. 16 shows a plug 102 attached to the nut 34 and the washer 100. The plug has stepped conical portion 104 concentric with the main conical body 106. The conical portion 104 has a larger diameter portion than the diameter of the opening of the washer to help center the washer and seal the washer opening from the concrete. A cylindrical portion 108 has a single turn continuous thread 110. Engaging surfaces 112 and 114 seal the concrete out from the threads 116.

Figure 17:
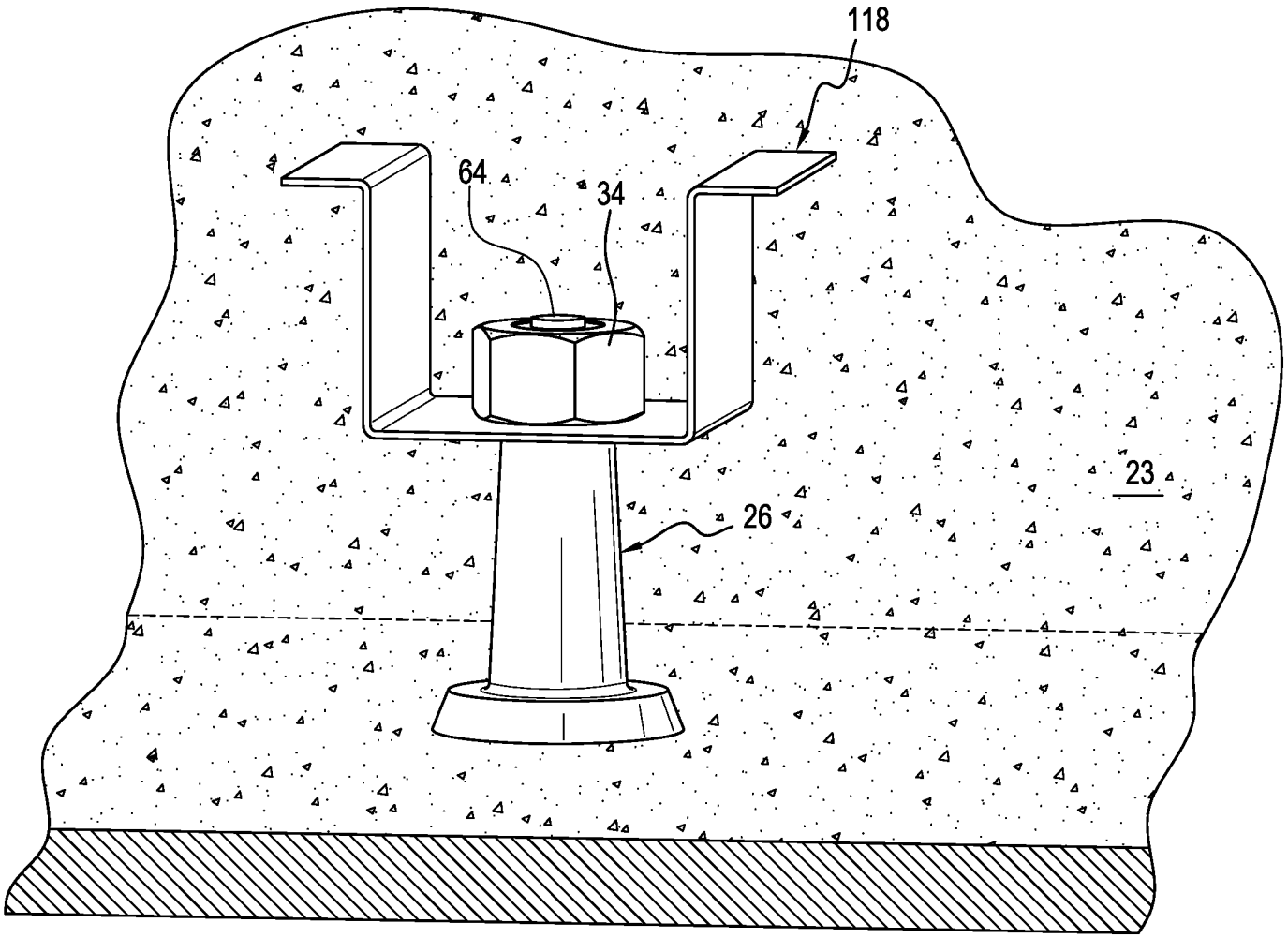
FIG. 17 is a perspective view of the plug of FIG. 11 attached to a nut and a metal bracket, both cooperating as an anchor body.

FIG. 17 shows the plug 26 attached to the nut 34 and a U-shaped metal bracket 118. The bracket 118 has an opening through which the threaded portion 64 extends. The nut 34 secures the bracket 118 to the plug 26. When the plug is removed from the cured concrete, a threaded fastener may be threaded to the nut 34 to support a load.

Figure 18:
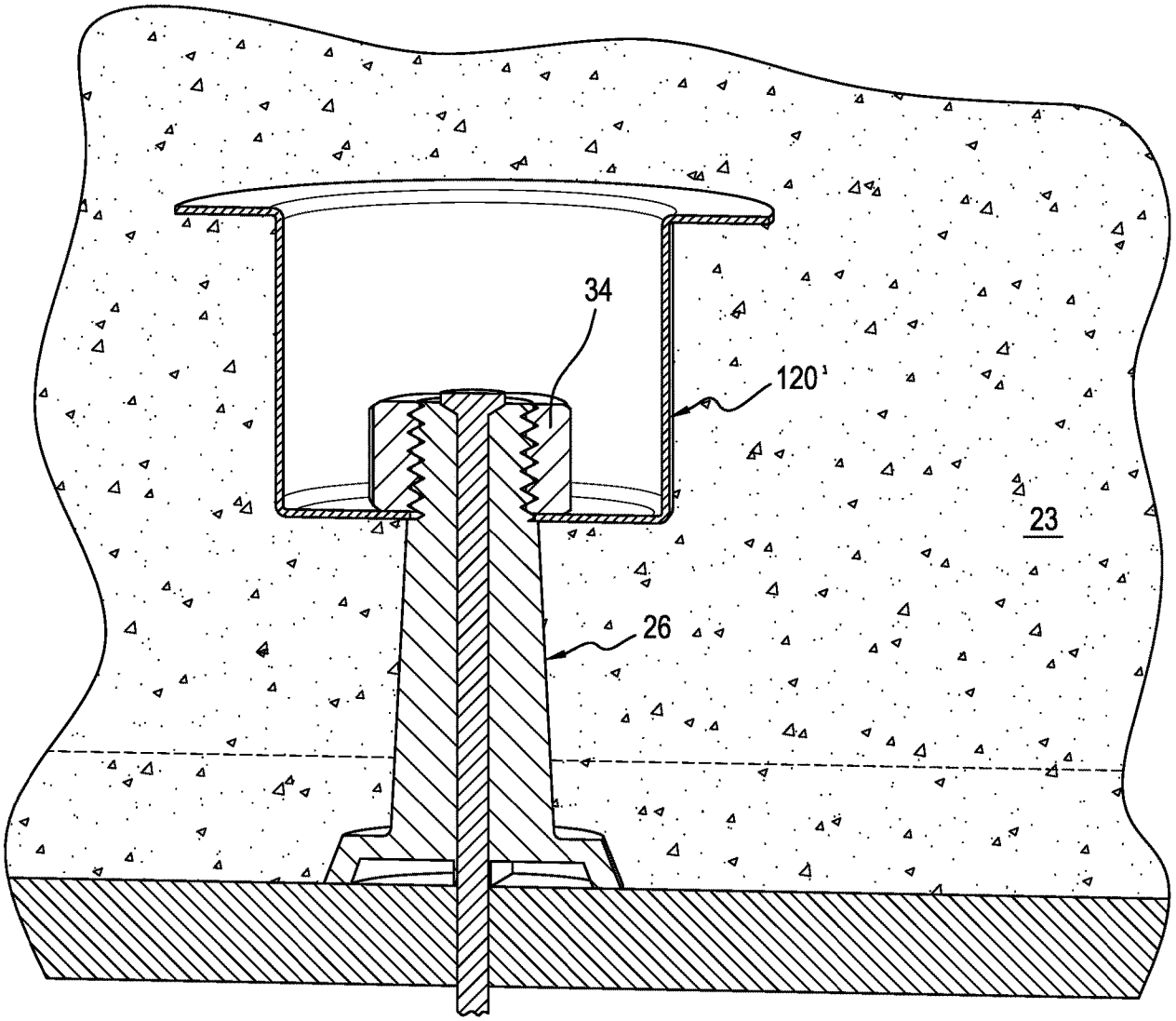
FIG. 18 is a perspective cross-sectional view of a plug shown in FIG. 17 attached to a nut and a round metal bracket.

FIG. 18 shows the plug 26 attached to the nut 34 and a cup-shaped round bracket 120.

Figure 19:
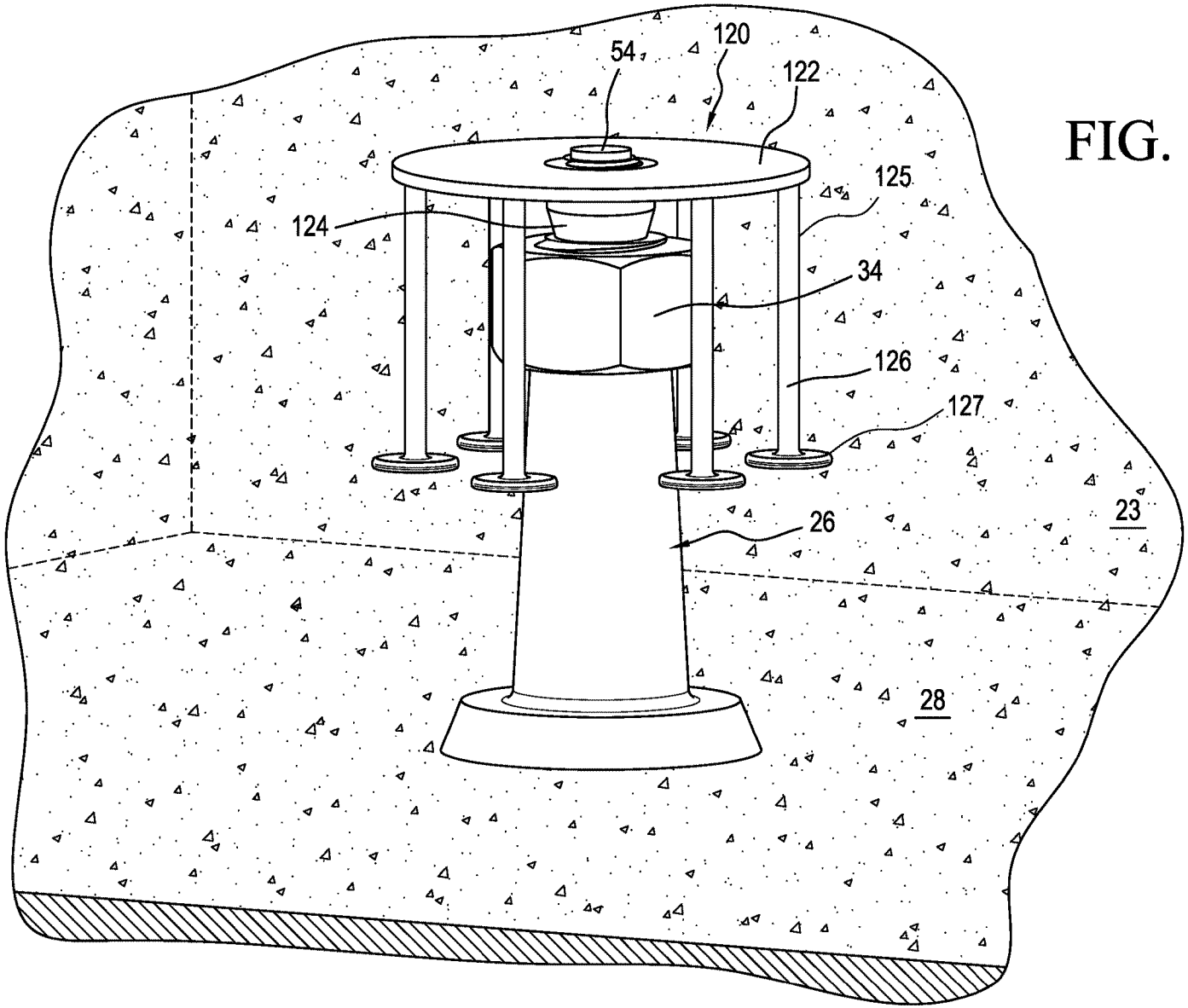
FIG. 19 is a perspective view of the plug of FIG. 18 attached to a nut and a circular stud rail assembly.

FIG. 19 shows the plug 26 attached to the nut 34 and a circular stud rail assembly 120, comprising a round metal plate 122 with a central threaded boss 124 and anchor studs 126 attached to the plate 122 around the boss 124. A threaded rod for supporting a load is threaded to the nut 34 but not to the boss 124 after the concrete has cured and the plug 26 removed. The nail 54 attaches the assembly to the form board 28. Each of the anchor studs 126 includes a rod portion 125 and a head portion 127. The anchor studs 126 are preferably arranged in a circle at the peripheral edge portion of the metal plate 122.

Figure 20:
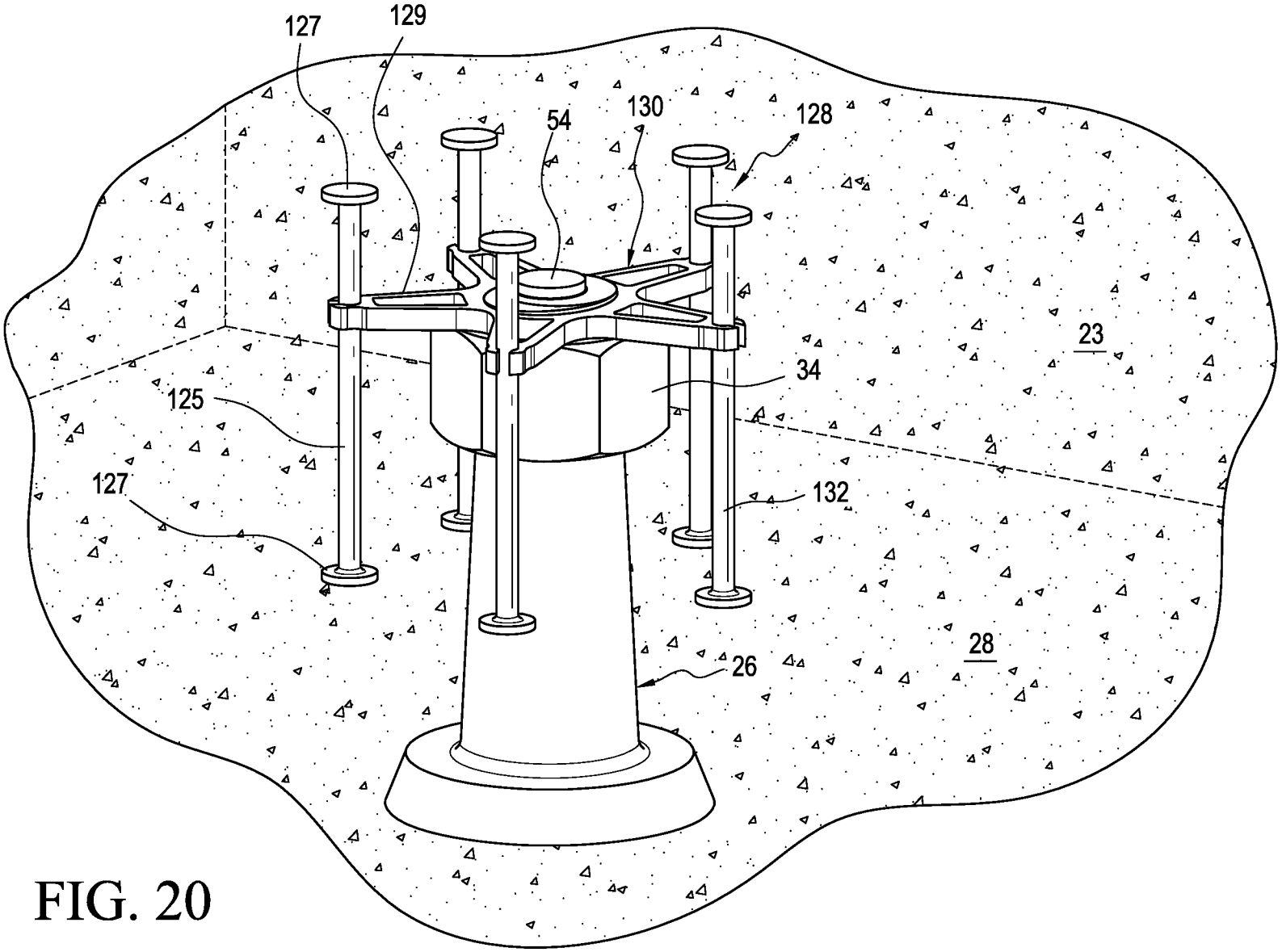
FIG. 20 is a perspective view of the plug of FIG. 18 attached to a nut and a fixture holding a plurality of double anchor studs.

FIG. 20 shows the plug attached to the nut 34 and an anchor stud assembly 128, comprising a fixture or holder 130 holding double ended anchor studs 132 around the nut 34. The nail 54 or screw attaches the plug to the form board 28. The holder 130 includes a plurality of arms 129 extending outwardly from the nut 34. Each of anchor studs 132 includes a rod portion 127 and head portions 127 attached to the respective ends of the rod portions 125. The anchor studs 132 are attached to the arms 129 at the respective rod portions 125.

Figure 21A:
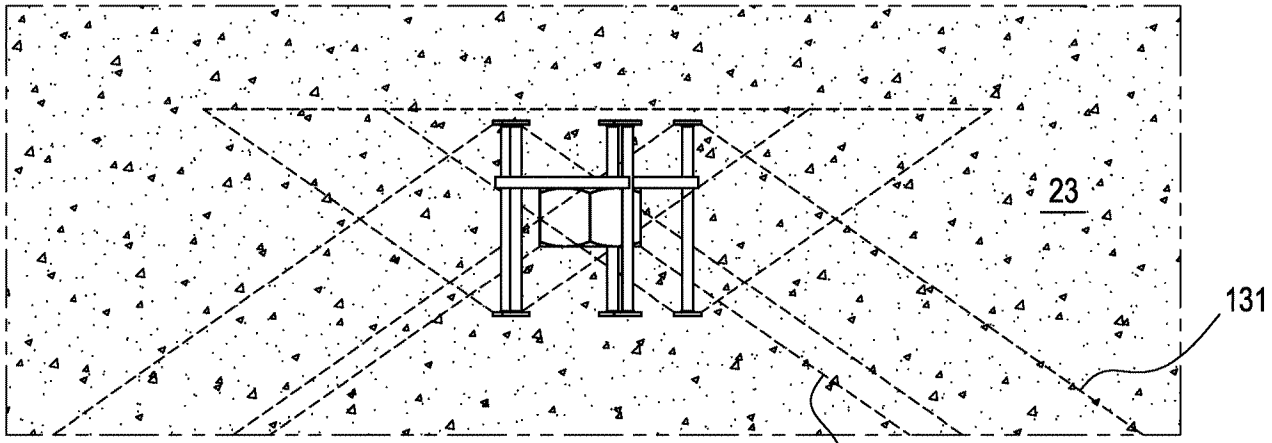
FIGS. 21A-21C show several shear cones (breakout cones) generated by the nut and the double anchor studs shown in FIG. 20 when subjected to a downward load connected to the nut.

FIG. 21A shows the shear cones generated by the anchor body shown in FIG. 20 when embedded in the concrete 23 and subject to a load. A larger effective shear cone 131 is generated with the use of the double ended studs than the shear cone 133 of the nut alone.

Figure 21B:
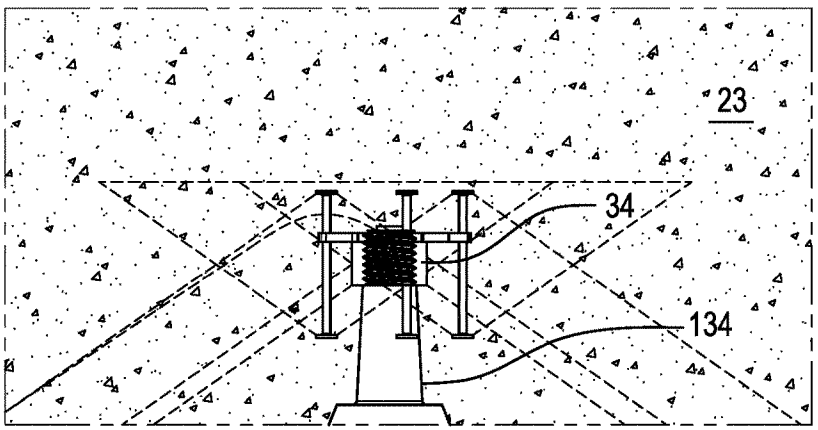

FIG. 21B shows the void 134 in the concrete 23 after the plug 26 is removed.

Figure 21C:
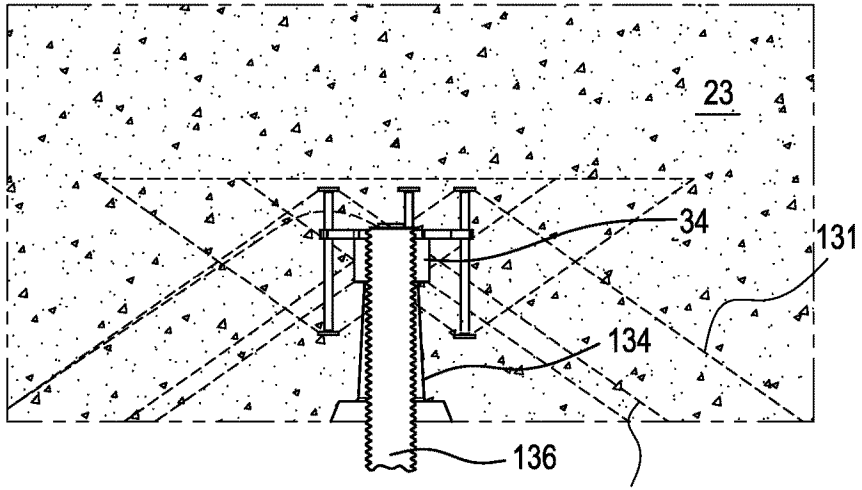

FIG. 21C shows the threaded rod or bolt 136 screwed to the nut 34. The threaded rod 136 is attached to a load (not shown) that places the rod under tension.

Figure 22:
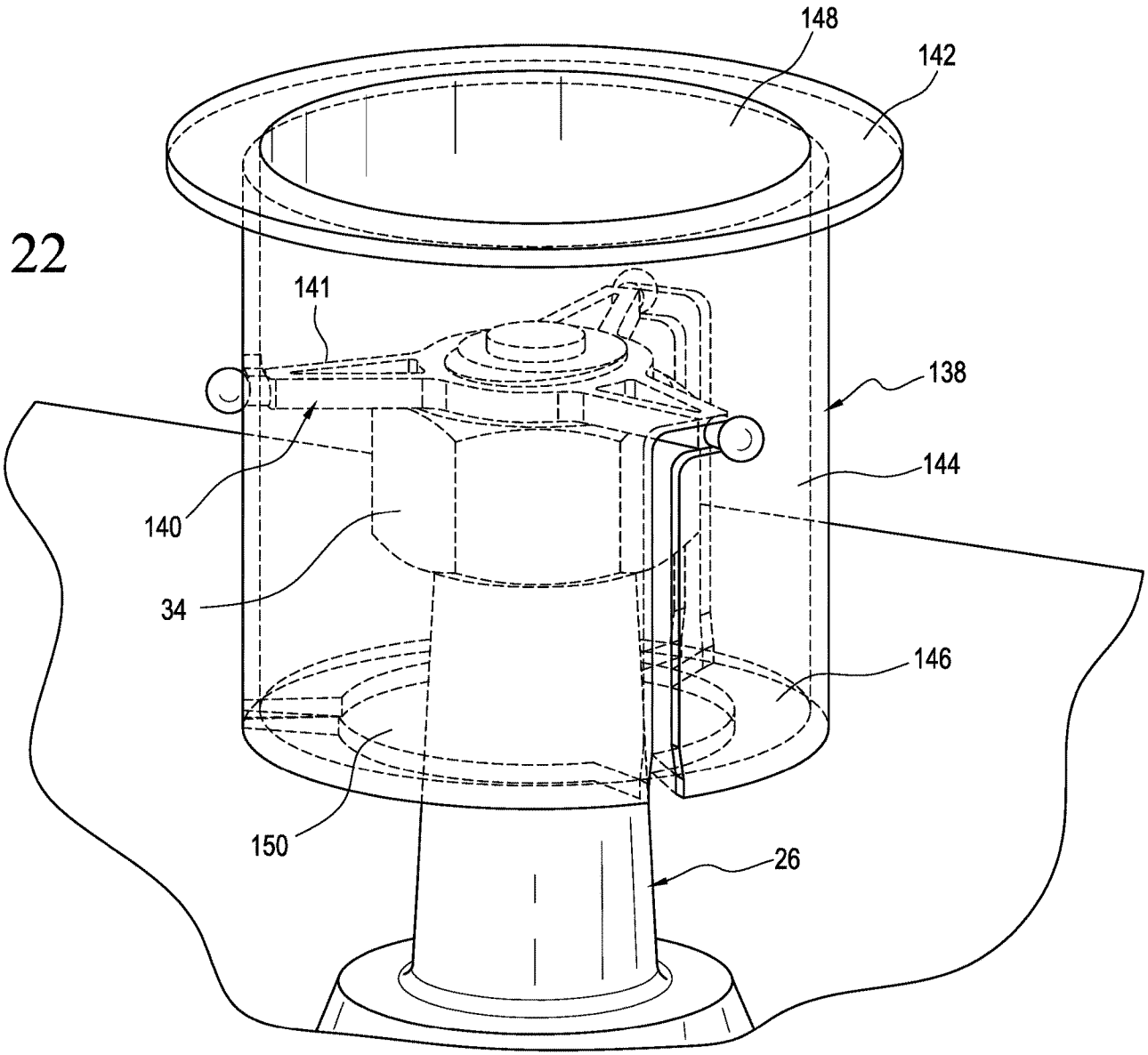
FIG. 22 is a perspective view of the plug of FIG. 18 attached to a nut and a circular metal hollow cylinder.

FIG. 22 shows the plug 26 attached to the nut 34 and a circular hollow metal cylinder 138 suspended around the plug by a fixture or holder 140. The holder 140 includes a plurality of arms 141 extending outwardly from the nut 34. The arms 141 support the hollow cylinder 138 at an intermediate portion so that the hollow cylinder 138 partly encloses the plug 26. The hollow cylinder 138 has an outer ring flange 142 extending radially outwardly from the main body 144 and inner ring flange 146 extending radially inwardly from the main body 144. Openings 148 and 150 are provided to allow the concrete to fill up the interior of the hollow cylinder 138. The flanges 142 and 146 provide bearing surfaces for anchorage.

Figure 23:
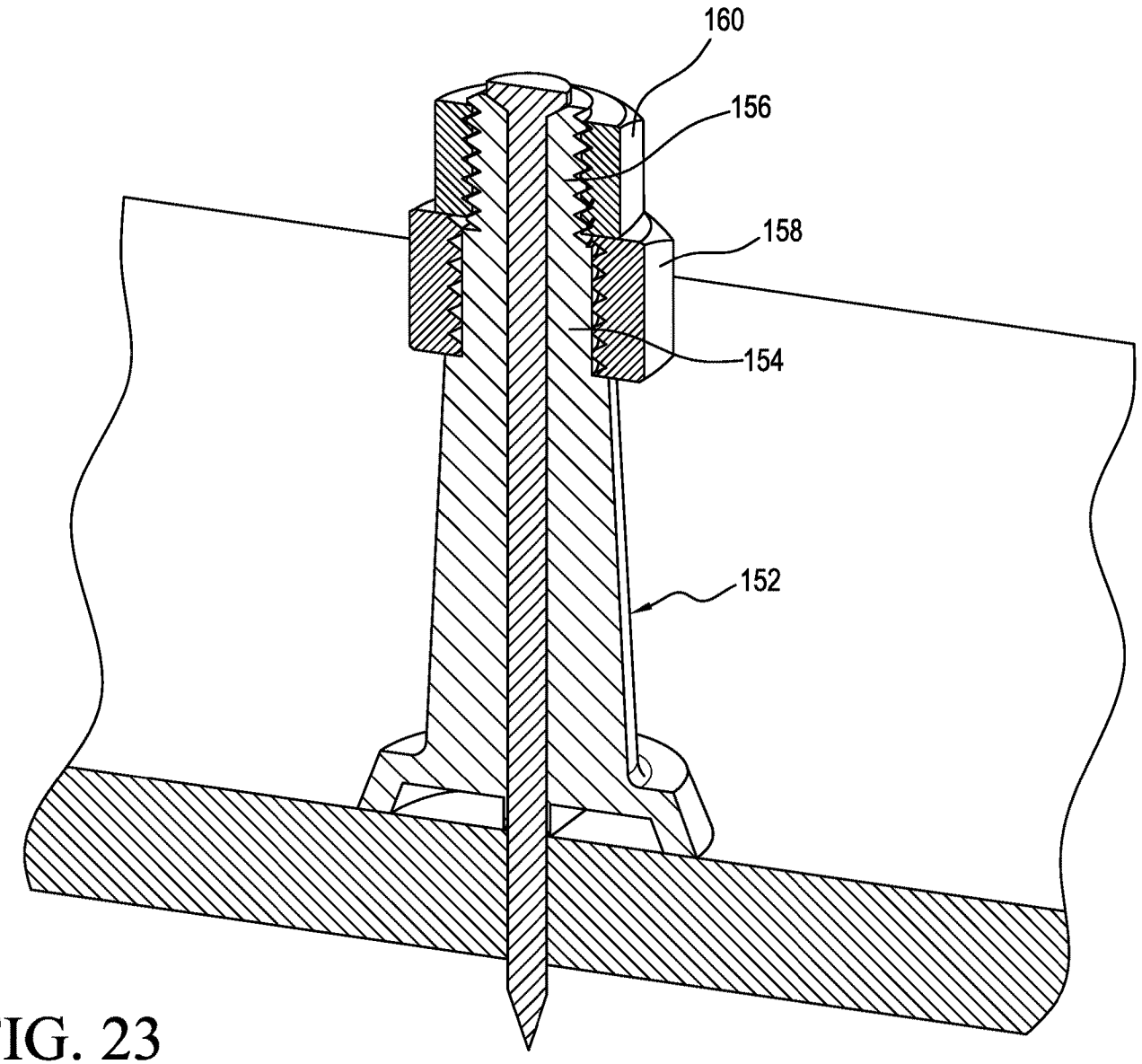
FIG. 23 is a perspective cross-sectional view of a plug attached to a plurality of nuts with different size threaded openings.

FIG. 23 shows a plug 152 with a cylindrical upper portion 154 and a threaded upper portion 156 of different diameters, the cylindrical portion 154 being smaller than the threaded portion 156. A larger nut 158 and a smaller nut 160 are sealingly attached to the cylindrical portion 154 and the threaded portion 156, respectively. The nuts 158 and 160 provide different diameter threads for use with different diameter threaded rods depending on the load requirement.

Figure 24B:
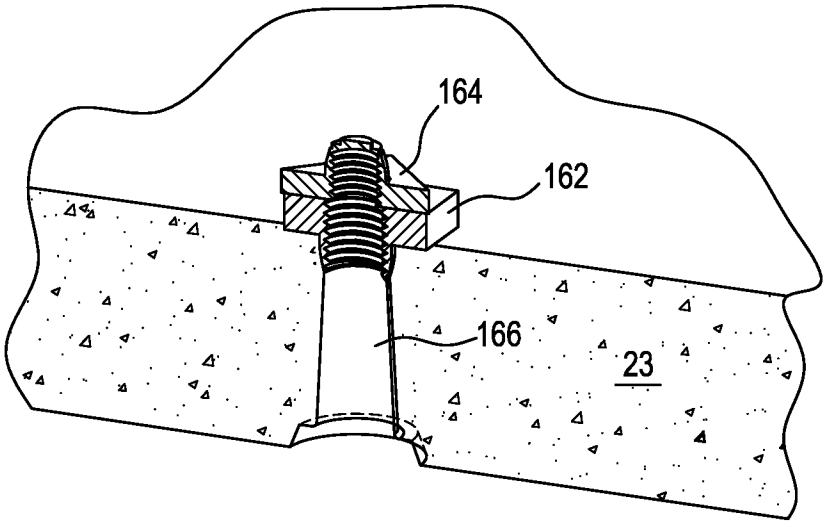
FIG. 24B is a perspective cross-sectional view of FIG. 24A after the plug is removed from the concrete.
Figure 24A:
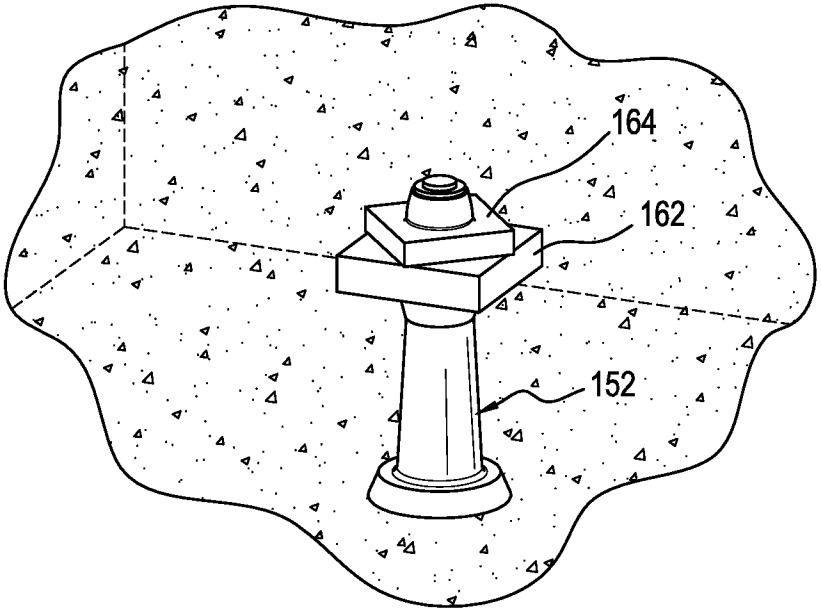
FIG. 24A is a perspective view of a plug attached to a plurality of metal plates with formed threaded openings of different sizes.

FIG. 24A shows the plug 152 attached to two formed anchor bodies 162 and 164 of different size threads. The anchor bodies 162 and 164 are the same as the anchor body 2 shown in FIG. 2. The anchor body 162 has a larger diameter thread than the anchor body 164.

FIG. 24B shows the void 166 in the concrete 23 after the plug 152 is removed.

Figure 25:
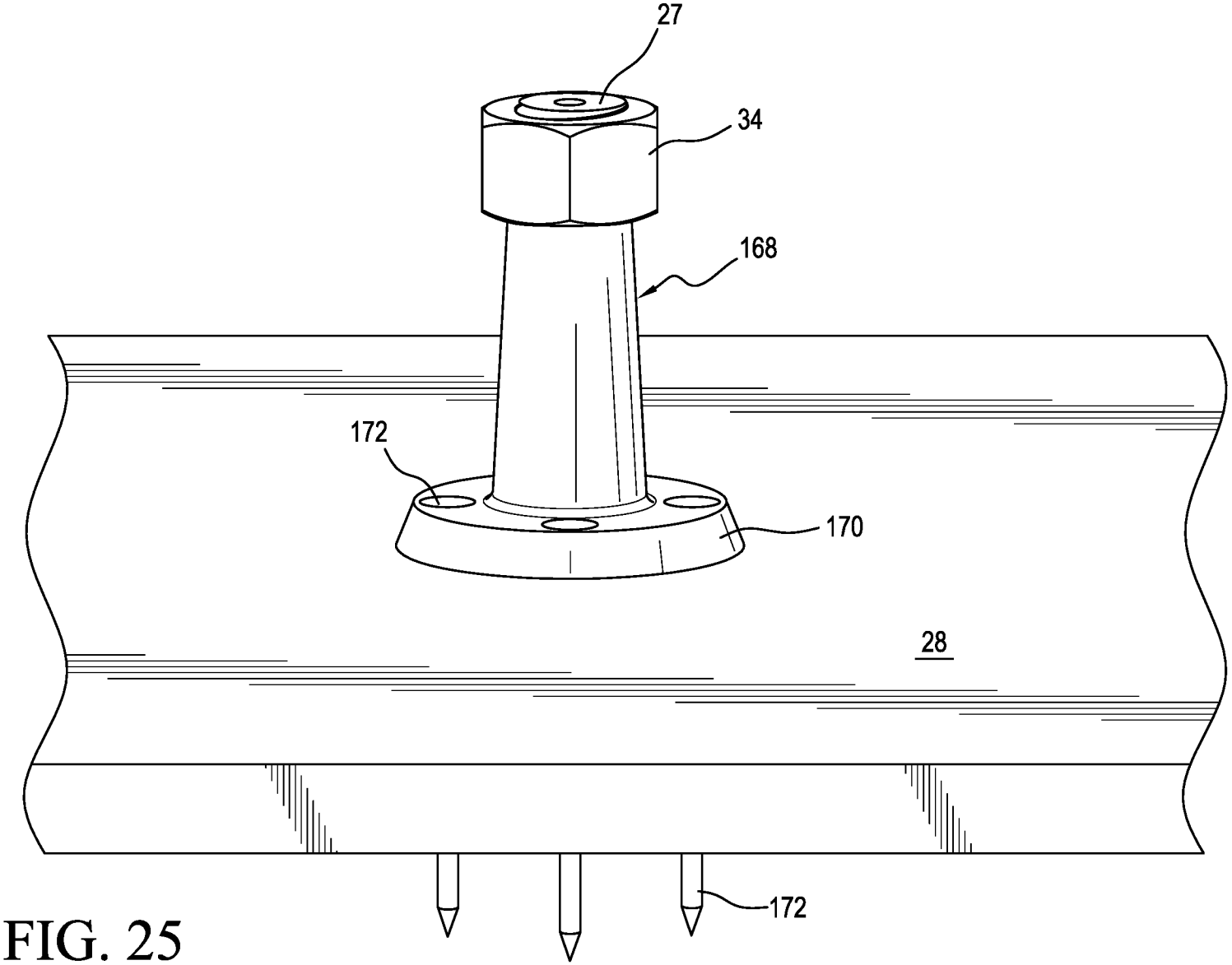
FIG. 25 is a perspective view of a plug similar to FIG. 7 or FIG. 9 showing its base portion attached to a form board.

FIG. 25 shows a plug 168 attached to the nut 34. The base portion 170 is attached with nails 172 or screws to the form board 28. The base portion 170 preferably includes openings for receiving the nails or screws.

Figure 26:
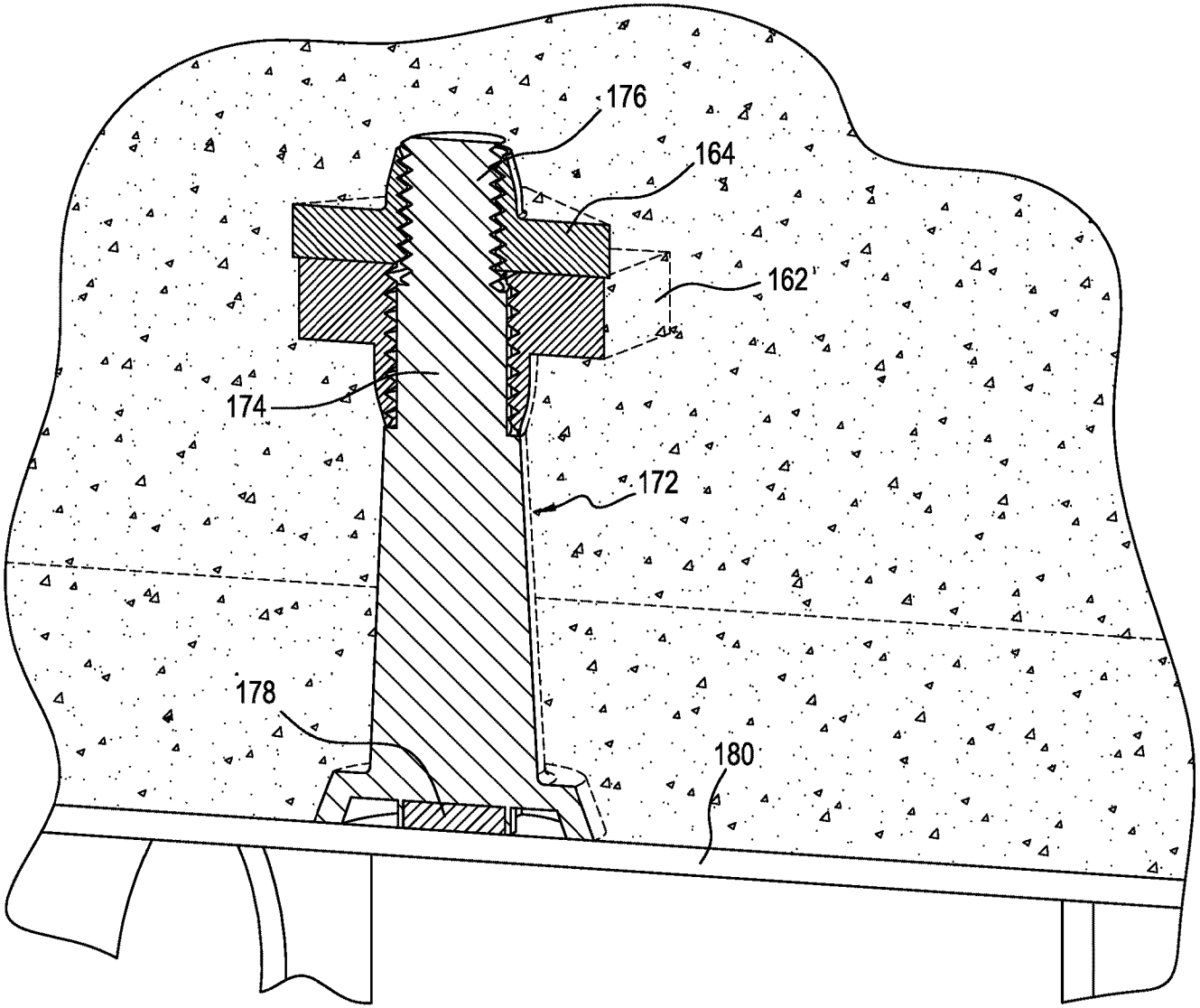
FIG. 26 is a perspective cross-sectional view of a plug attached to a metal formwork with a magnet and attached to a plurality of formed anchor bodies with different size threaded openings.

FIG. 26 shows a plug 172 attached to the formed anchor bodies 162 and 164. A cylindrical portion 174 is sealingly attached to the formed anchor body 162. A threaded portion 176 is sealingly attached to the formed anchor body 164. A magnet 178 attached to the bottom of the plug attaches the plug to a steel formwork 180.

Figure 27:
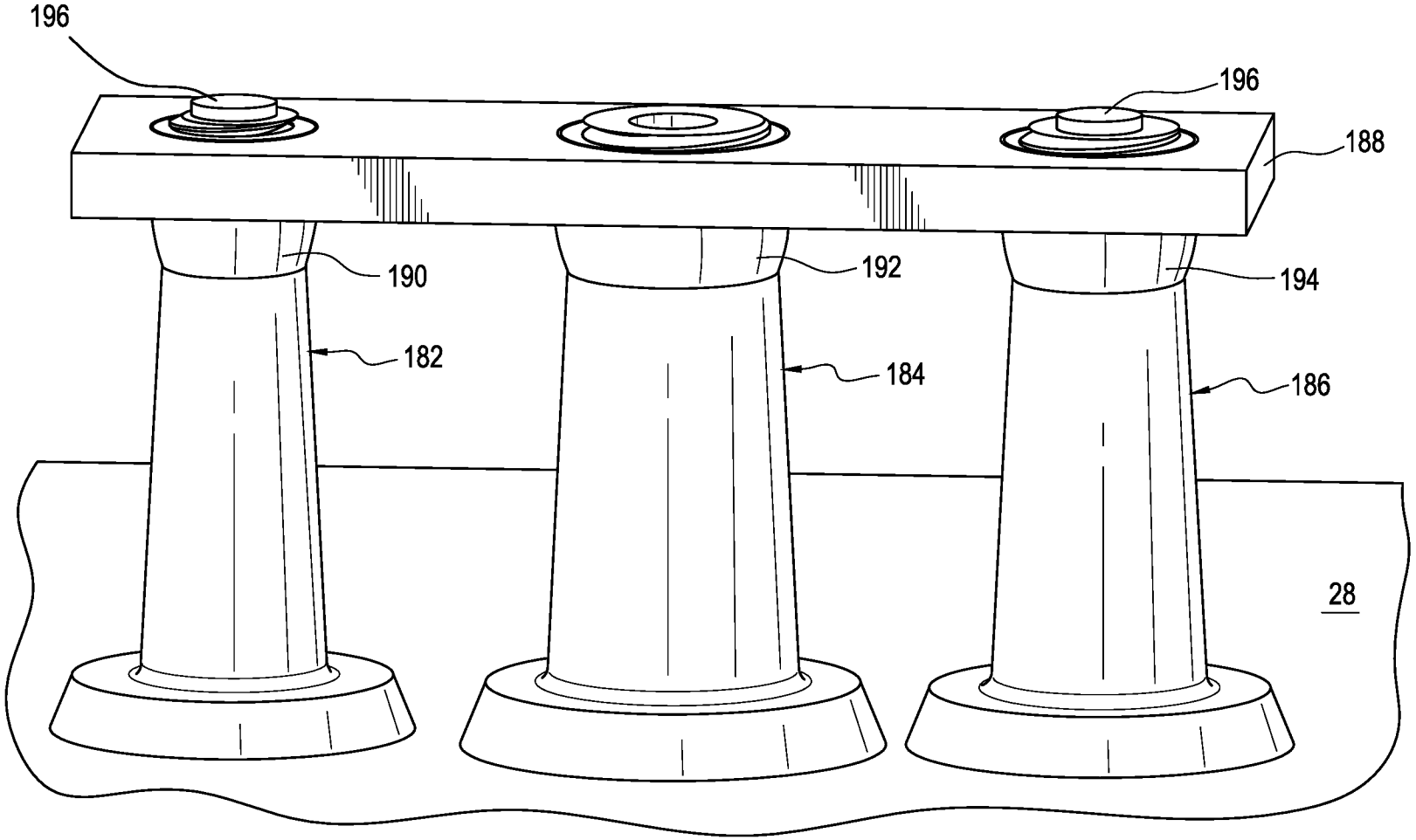
FIG. 27 is a perspective view of a plurality of plugs attached to a metal plate with formed threaded openings.

FIG. 27 shows three plugs 182, 184 and 186 having the same structural details as the plug 26 in FIG. 7. Each plug has a different color to designate thread size, type, depth and intended use of the anchor in the concrete, such as fire, HVAC, structural, etc. The plugs are attached to an anchor body 188 with three respective formed boss sections 190, 192 and 194 and respective formed threads. Nails 196 or screws attach the plugs to the form board 28. The plugs can remain in place until needed. The bottom of the plug will be visible to the user after the form board is removed when the concrete has cured.

Figure 28:
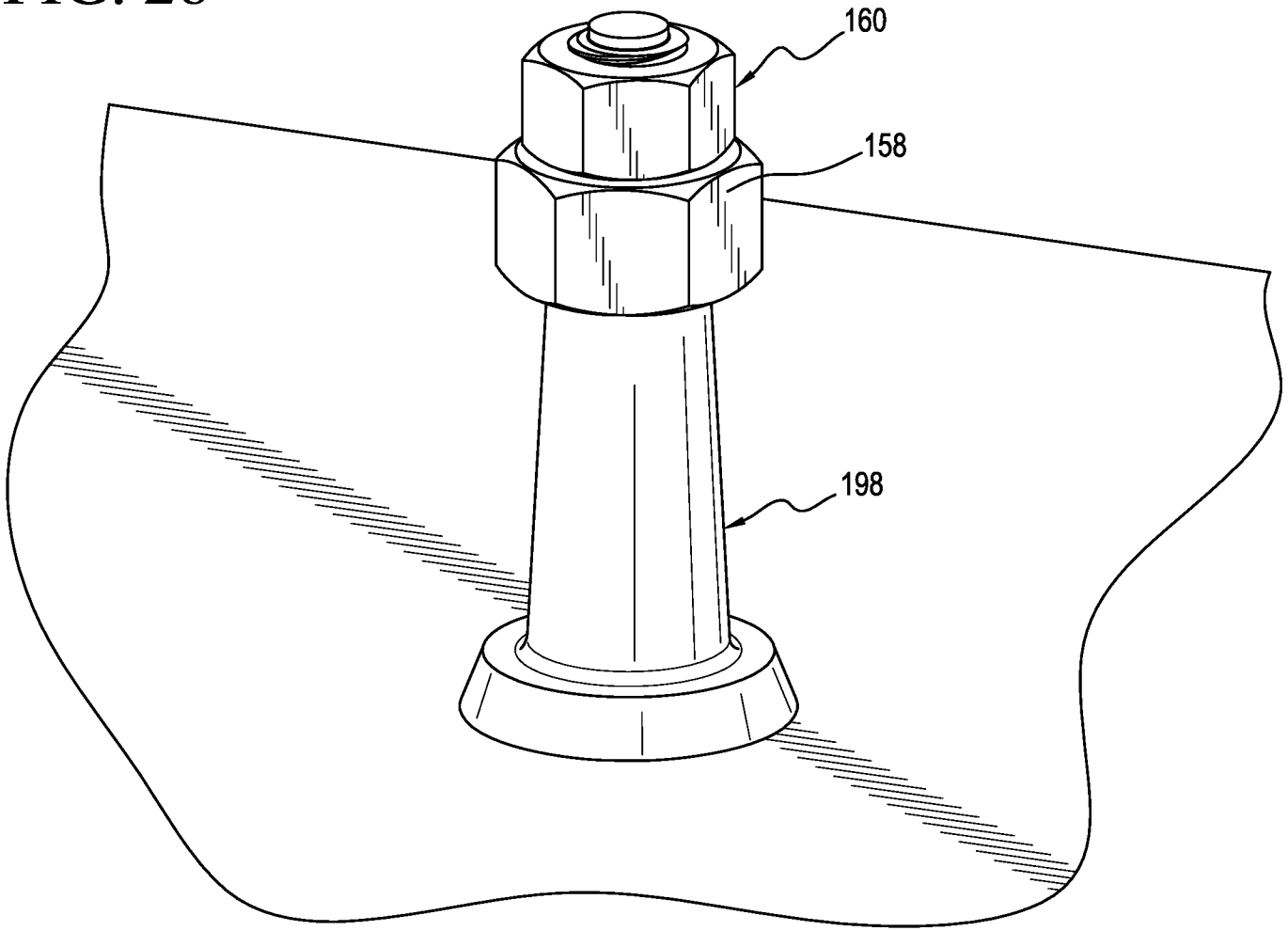
FIG. 28 is a perspective view of a plug similar to the plug shown in FIG. 23 but made of metal.
Figure 29:
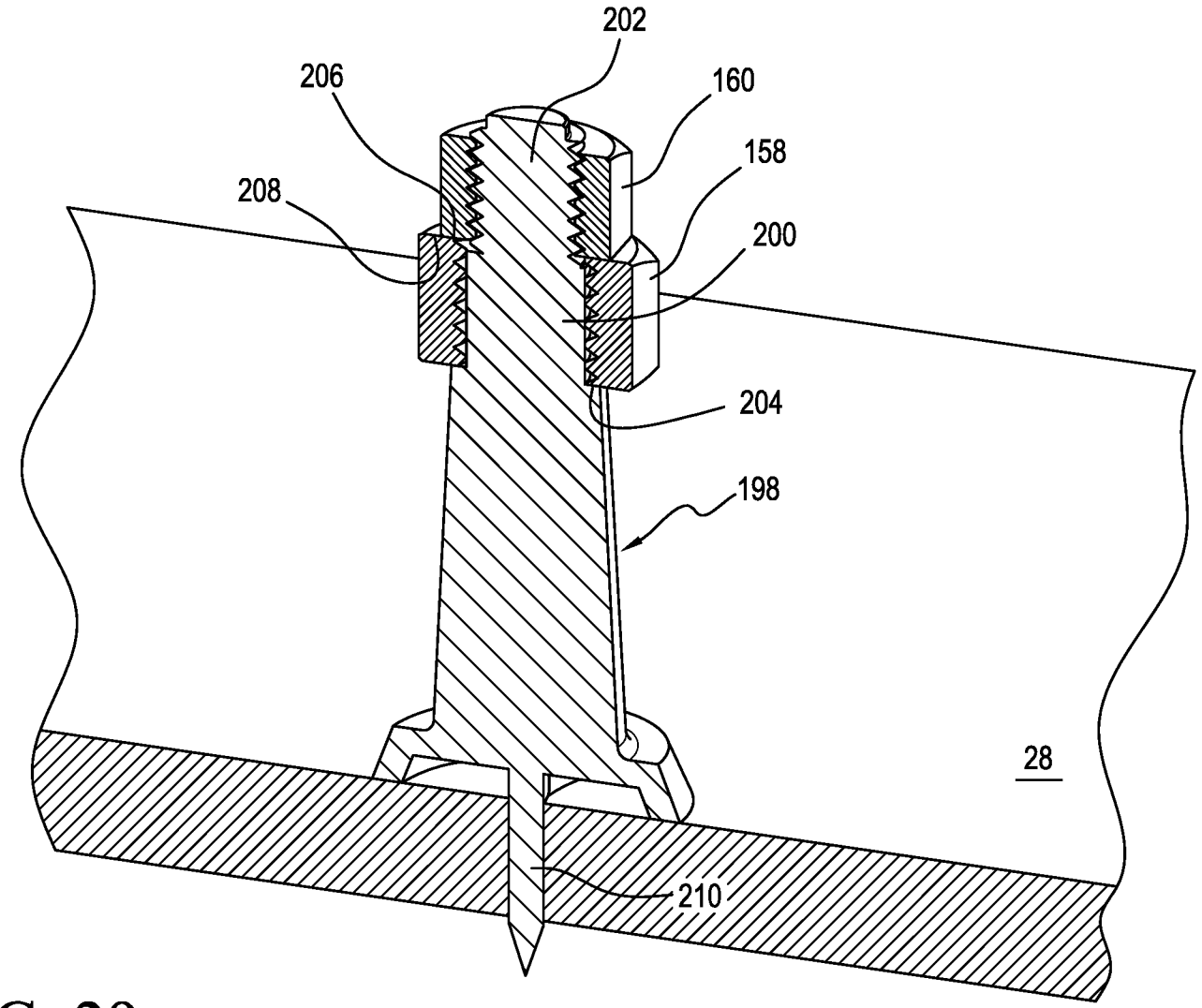
FIG. 29 is perspective cross-sectional view of a metallic plug with an integrated fastener for attaching to a form board.

FIGS. 28 and 29 show a metallic plug 198 attached to the nuts 158 and 160. A cylindrical portion 200 is attached to the nut 158 and a threaded portion 202 is attached to the nut 160. The nut 160 presses down on the nut 158 to seal the nut 158 against the shoulder 204. The bottom surface 206 of the nut 160 presses down on the top surface 208 of the nut 158 to seal against the concrete. A pointed shaft 201 extending downwardly from the base portion 21 is integrated with the plug and is used to secure the plug to the form board 28.

Figure 30:
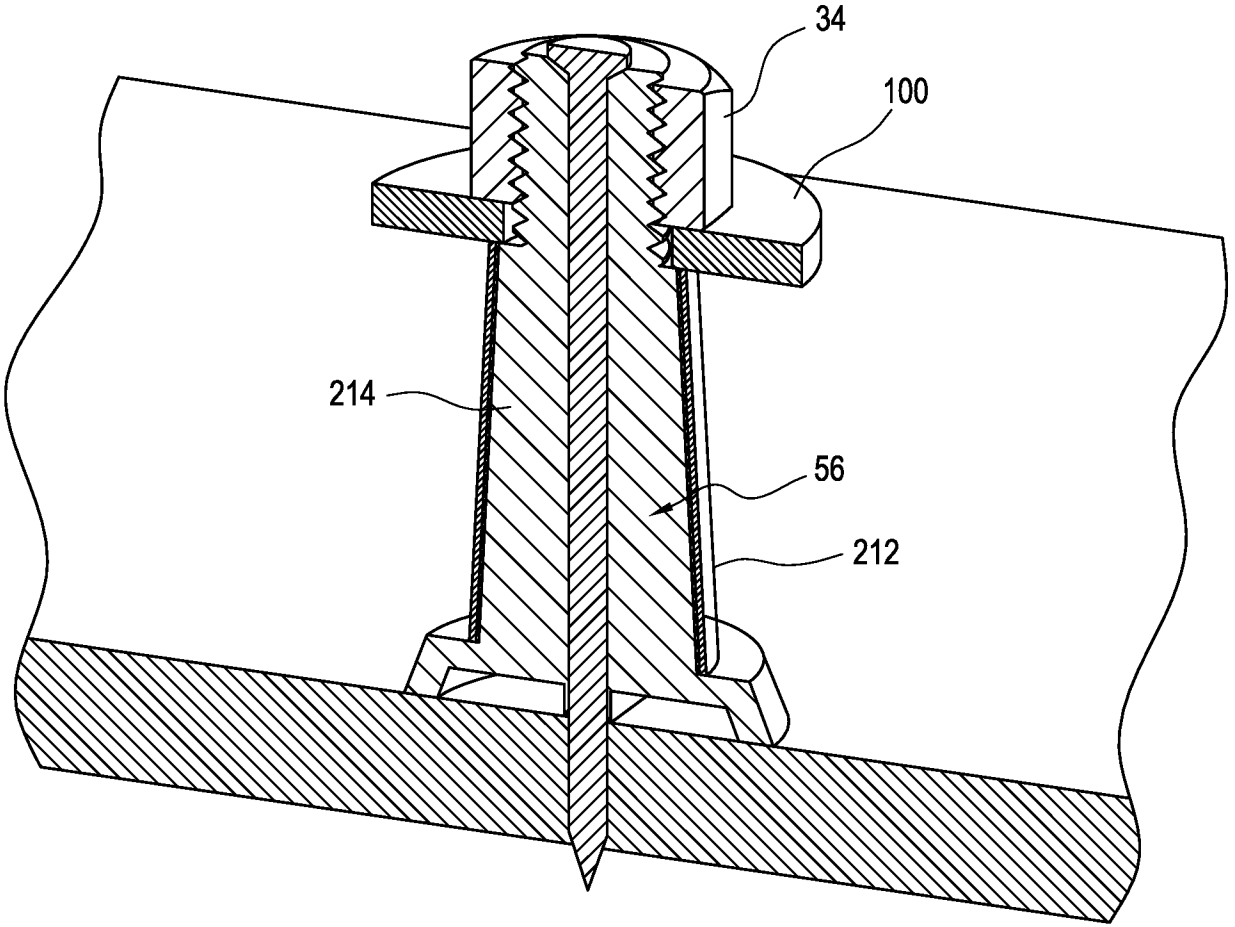
FIG. 30 is a perspective cross-sectional view of the plug of FIG. 15 with its main body portion covered with a tapered sleeve.

FIG. 30 shows the plug 56 (also shown in FIG. 15) with a sleeve 212 around the main body portion 214 of the plug. The sleeve 212 has the same conical shape of the main body portion 214. The sleeve facilitates removal of the plug after the concrete has cured since the plug is not in direct concrete contact.

Figure 31B:
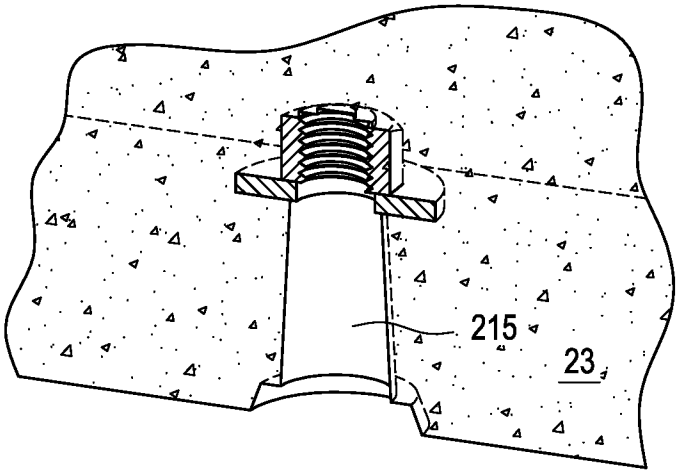
FIG. 31B is a perspective cross-sectional view in concrete of FIG. 30 after the plug and the sleeve are removed from the concrete.
Figure 31A:
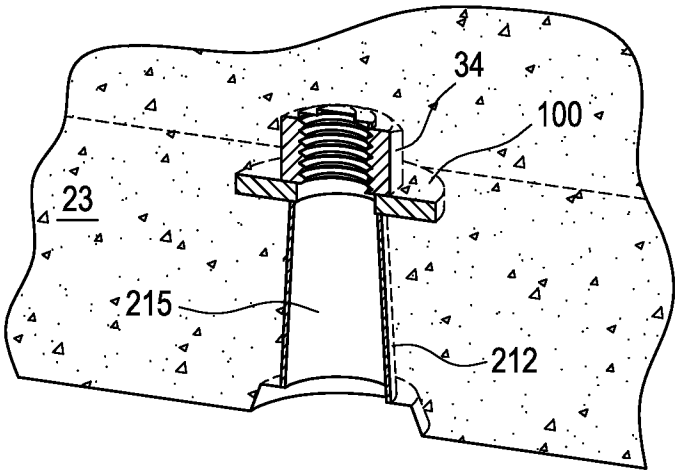
FIG. 31A is a perspective cross-sectional view in concrete of FIG. 30 after the plug is removed from the concrete, with the sleeve remaining in the concrete.

FIG. 31A shows the void 215 in the concrete 23 after the plug 56 of FIG. 30 has been removed, leaving behind the sleeve 212.

FIG. 31B shows the void 215 in the concrete 23 with the sleeve 212 removed from the concrete.

Figure 32:
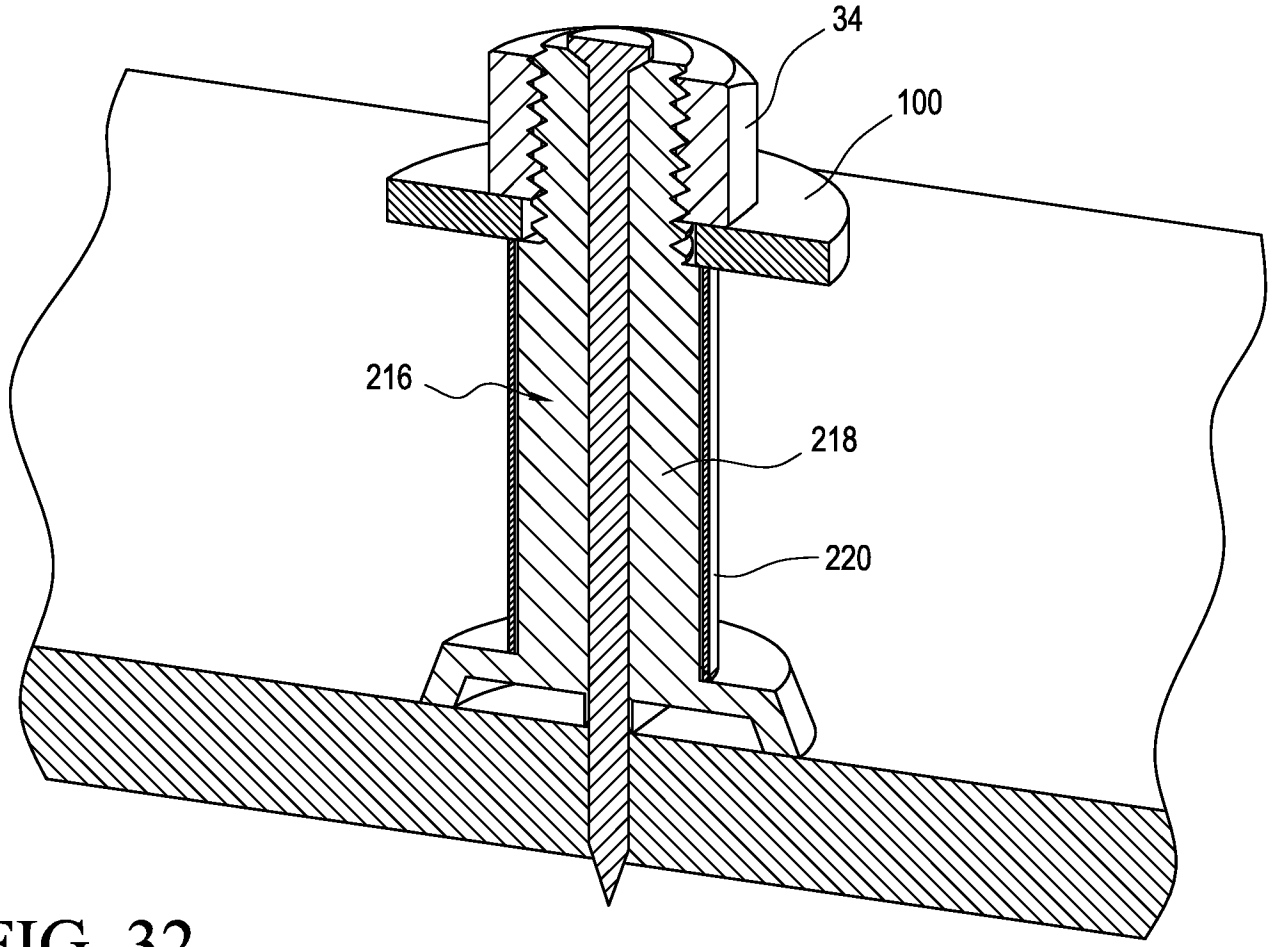
FIG. 32 is a perspective cross-sectional view of a plug with a cylindrical main body portion covered with a sleeve.

FIG. 32 shows a plug 216 attached to the washer 100 and the nut 34. A main body portion 218 of the plug is cylindrical with a sleeve 220. The sleeve facilitates removal of the plug after the concrete has cured since the plug is not in direct concrete contact.

Figure 33:
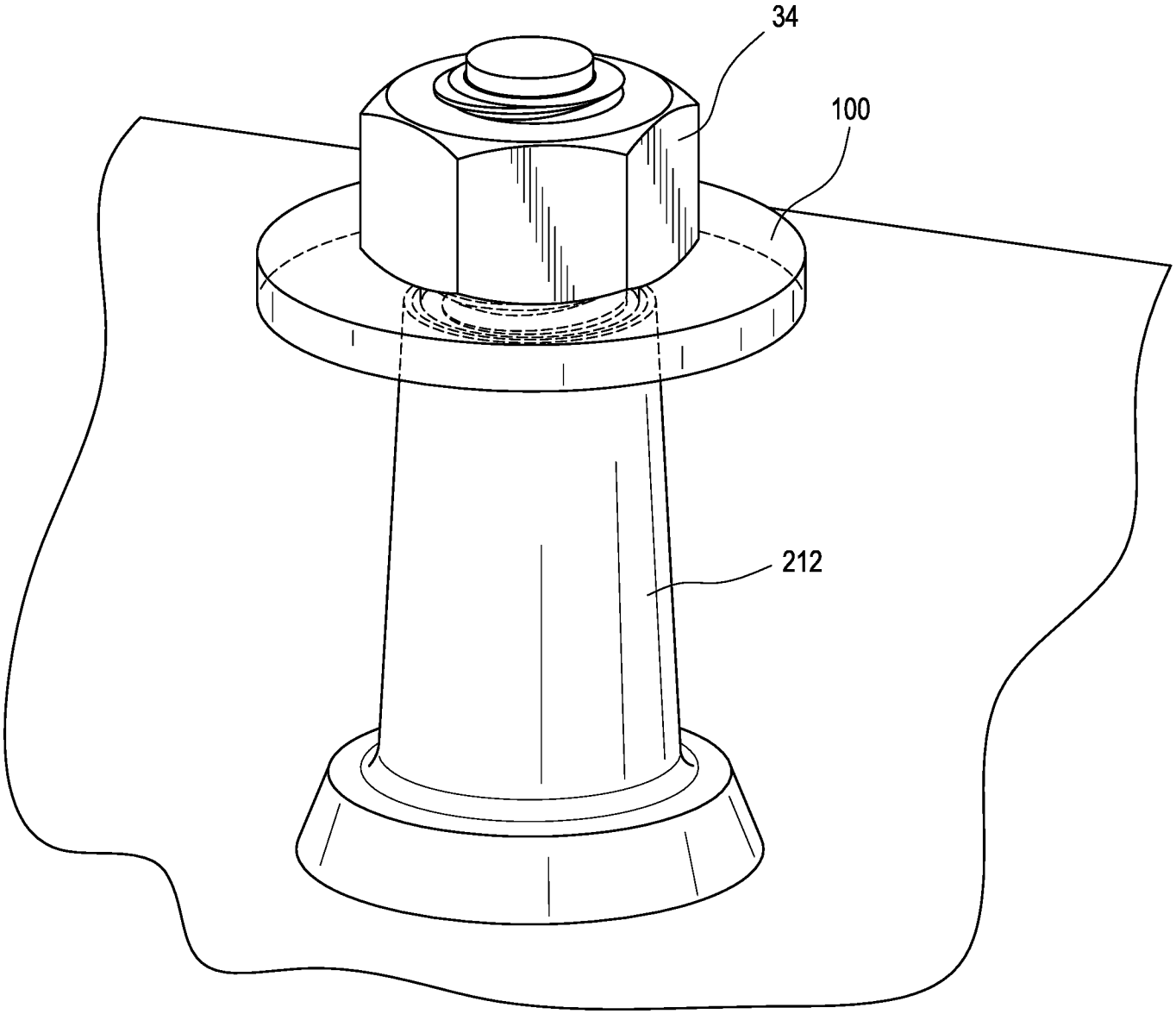
FIG. 33 is a perspective view of a plug with its main body portion covered in a continuous sleeve.

FIG. 33 shows the arrangement of FIG. 30 where the sleeve 212 is used to hold the washer 100 in place.

Figure 34:
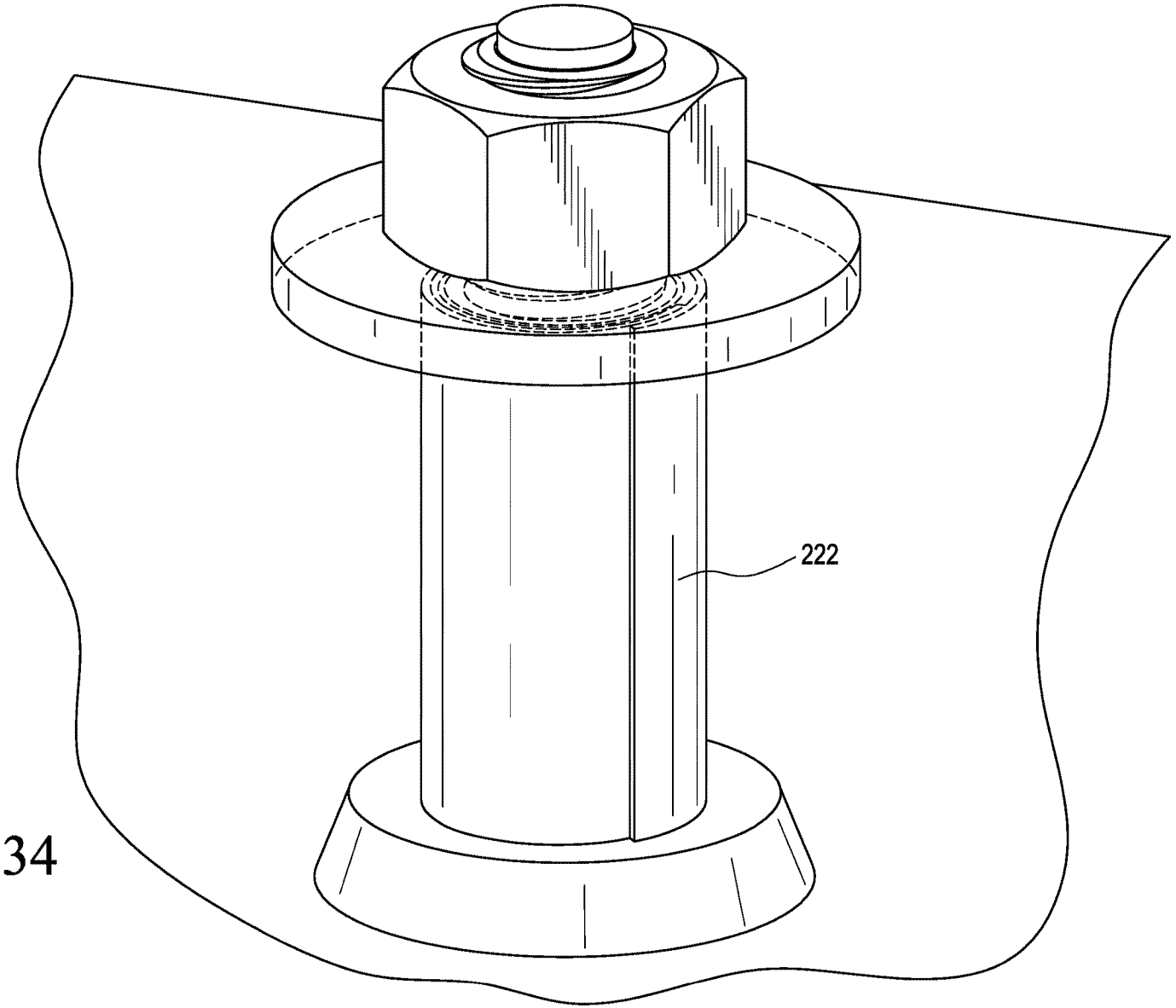
FIG. 34 is a perspective view of a plug with a cylindrical main body portion covered with a sleeve with overlapped end portions.

FIG. 34 shows the arrangement of FIG. 32 where the sleeve 222 is overlapped and not continuous. The sleeve 222 may be made to squeeze around the main body portion of the plug or with a loose fit. Whether continuous or non-continuous (overlapped), the sleeve may be removed or left in place after the concrete has cured.

Figure 35:
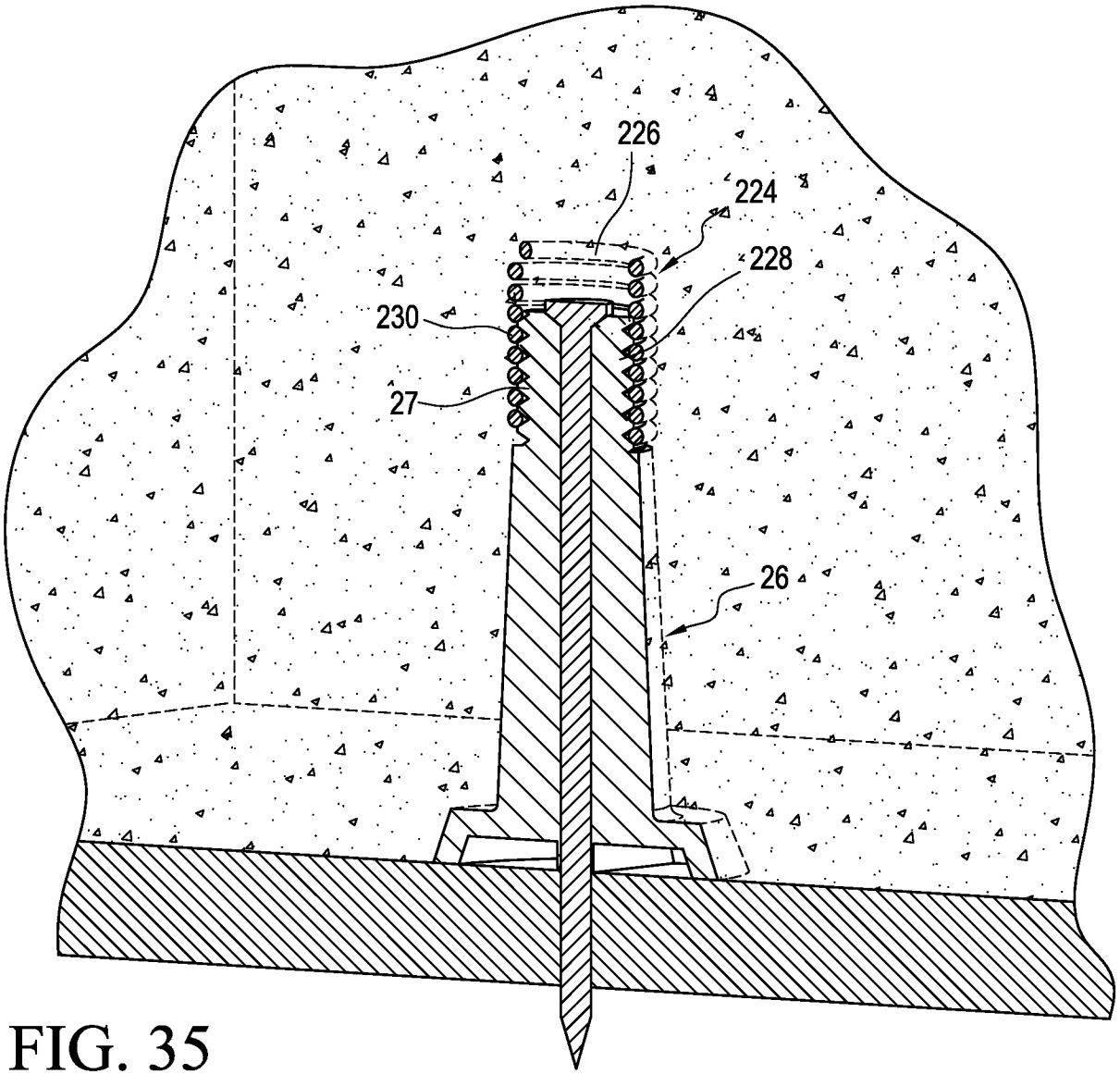
FIG. 35 is a perspective cross-sectional view of a plug attached to a wire coil or spring.

FIG. 35 shows the plug 26 attached to a wire coil or spring 224 at the threaded portion 27. A portion 226 of the spring above the top of the plug 26 will be embedded in concrete. The pitch of the spring is the same as the pitch of the threads 228 in the threaded portion 27, which is the pitch of the threaded fastener to be installed. The portion 230 engaged with the threads 228 will be embedded in concrete only on the outside.

Figure 36:
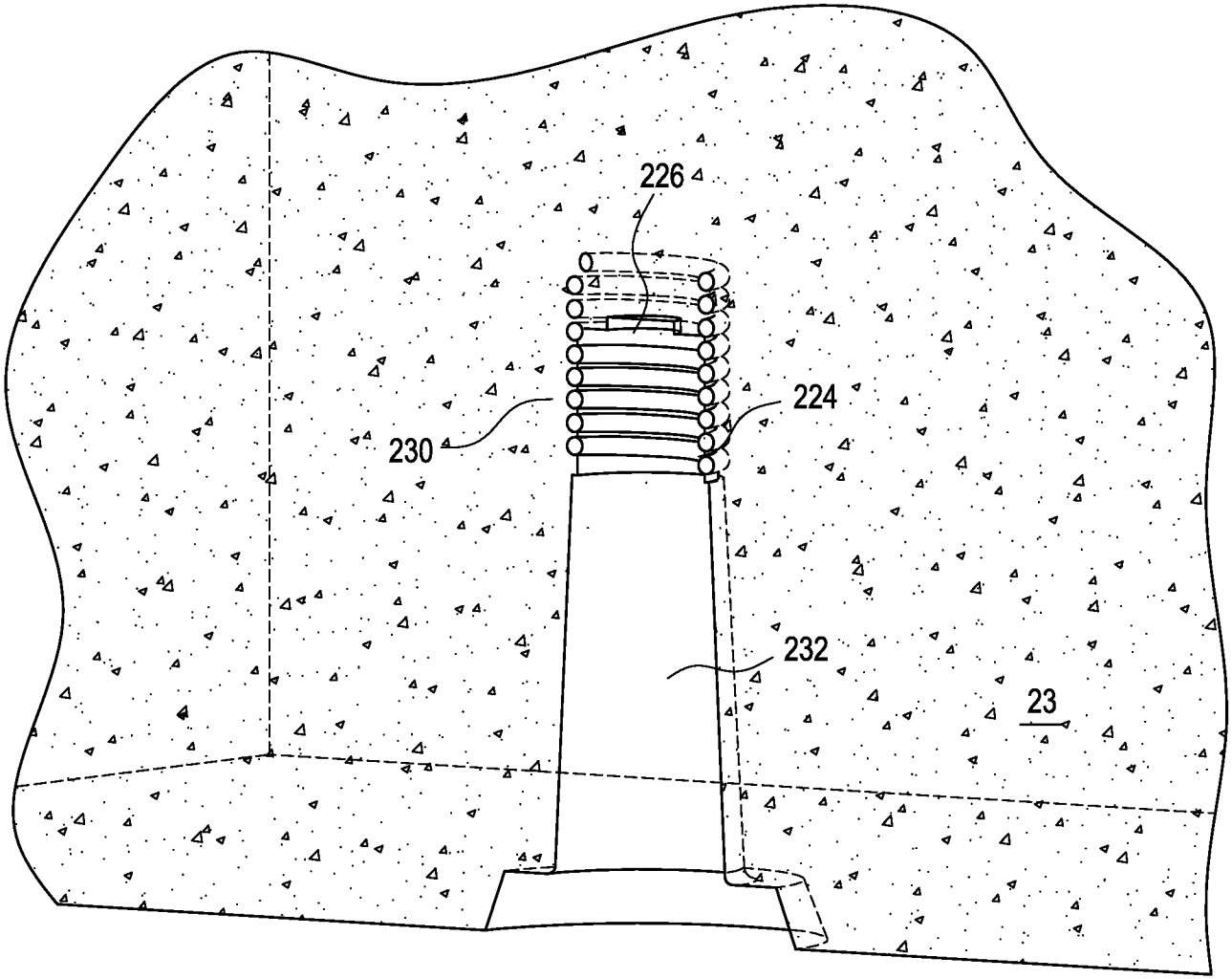
FIG. 36 is a perspective cross-sectional view of FIG. 35 after the plug is removed from the concrete, leaving the coil or spring in the concrete.

FIG. 36 shows the spring 224 in the concrete 23 after the plug 26 is removed after the concrete has cured. The portion 226 is completely embedded in concrete while the portion 230 below is only embedded on the outside. A void 232 in the concrete 23 is shown after the plug is removed. The void 232 includes a portion within the spring portion 230. The portion 226 advantageously increases the pull-out strength of the spring 224, adding to the strength of the compression of the portion 230 against the concrete when the threaded fastener is installed. Complete embedment of the spring portion 226 locks the spring in the concrete. The spring coils stack on top of each other so that concrete cannot penetrate to the inside of the spring. Engagement of the concrete with each coil of the spring is independent of the other coils of the spring. Transfer of force from each thread pitch directly to concrete occurs and each coil creates its own bearing surface interacting with concrete when the threaded fastener is installed.

Figure 37B:
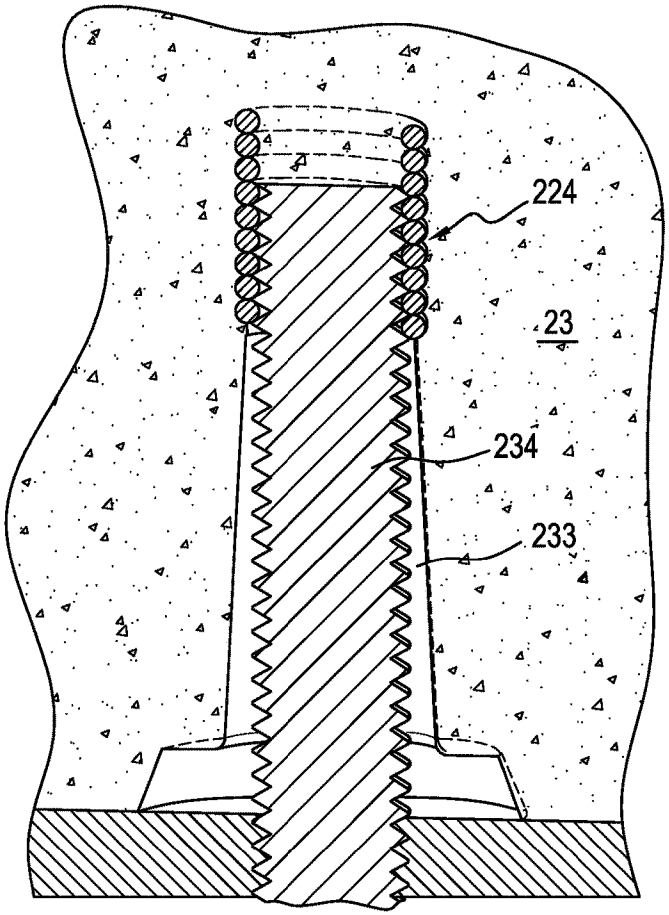
FIG. 37B is perspective cross-sectional view of FIG. 37A after the plug is removed from the concrete and a threaded rod attached to the wire coil or spring in the concrete for supporting a load.
Figure 37A:
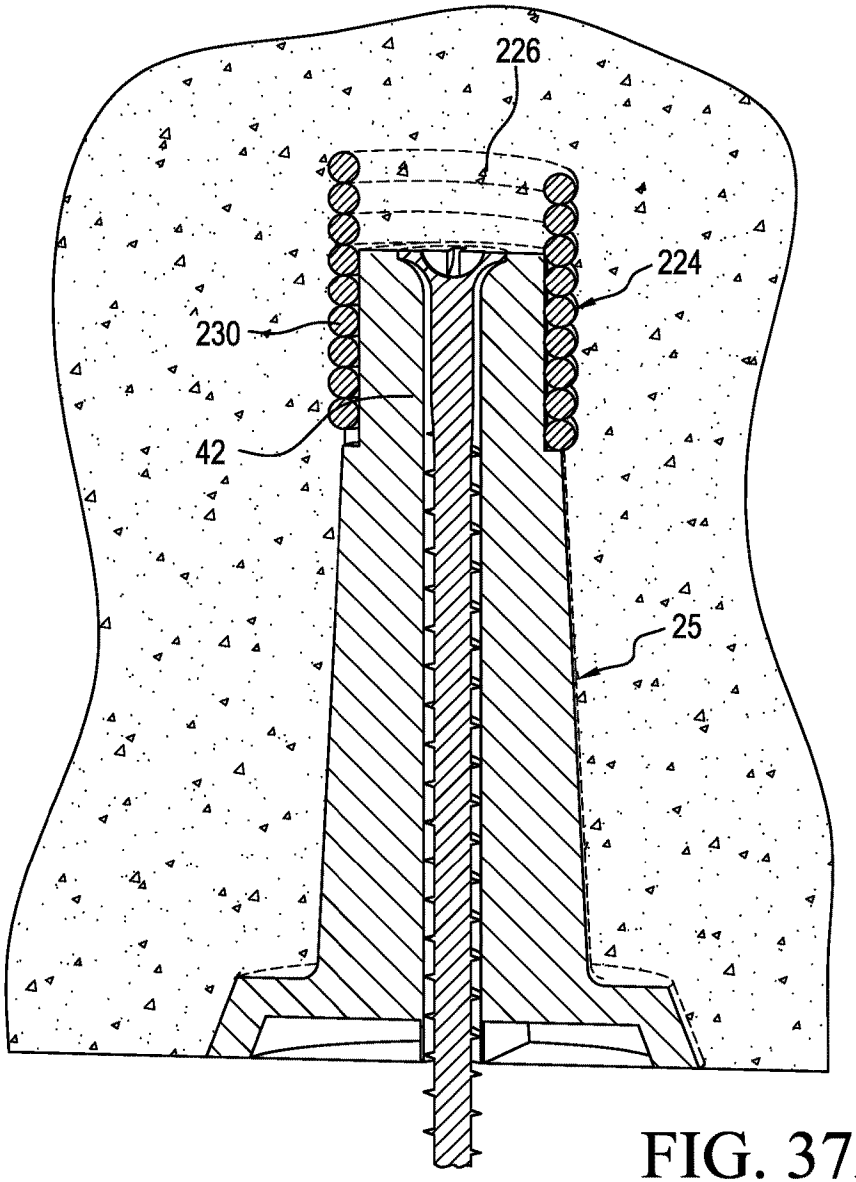
FIG. 37A is a perspective cross-sectional view of a plug with a portion without threads attached to a wire coil or spring.

FIG. 37A shows the plug 25 attached to the spring 224 at the cylindrical portion 42. The spring coils stack on top of each other so that concrete cannot penetrate to the inside of the spring.

FIG. 37B shows the void 233 after the plug 25 has been removed after the concrete 23 has cured and a threaded rod 234 or bolt screwed into the coil 224. The pitch of the spring 224 is made to match the pitch of the threads of the threaded rod 234 or bolt.

Figure 38:
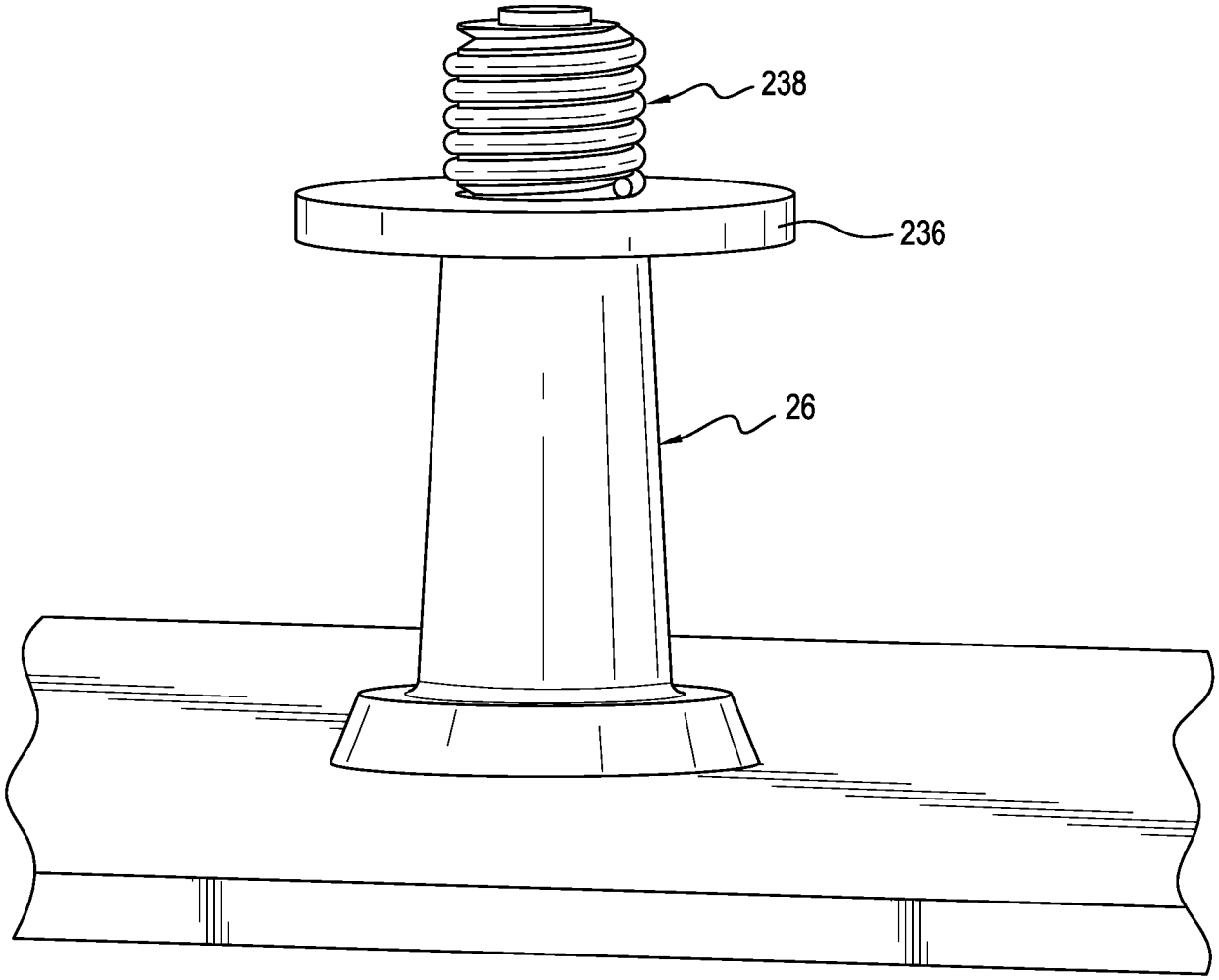
FIG. 38 is a perspective view of a plug attached to a washer and a coil or spring.

FIG. 38 shows the plug 26 attached to a washer 236 and a spring 238, which does not extend beyond the top of the plug. The washer 236 provides an added bearing area. The washer 236 provides support to the spring 238.

Figure 39:
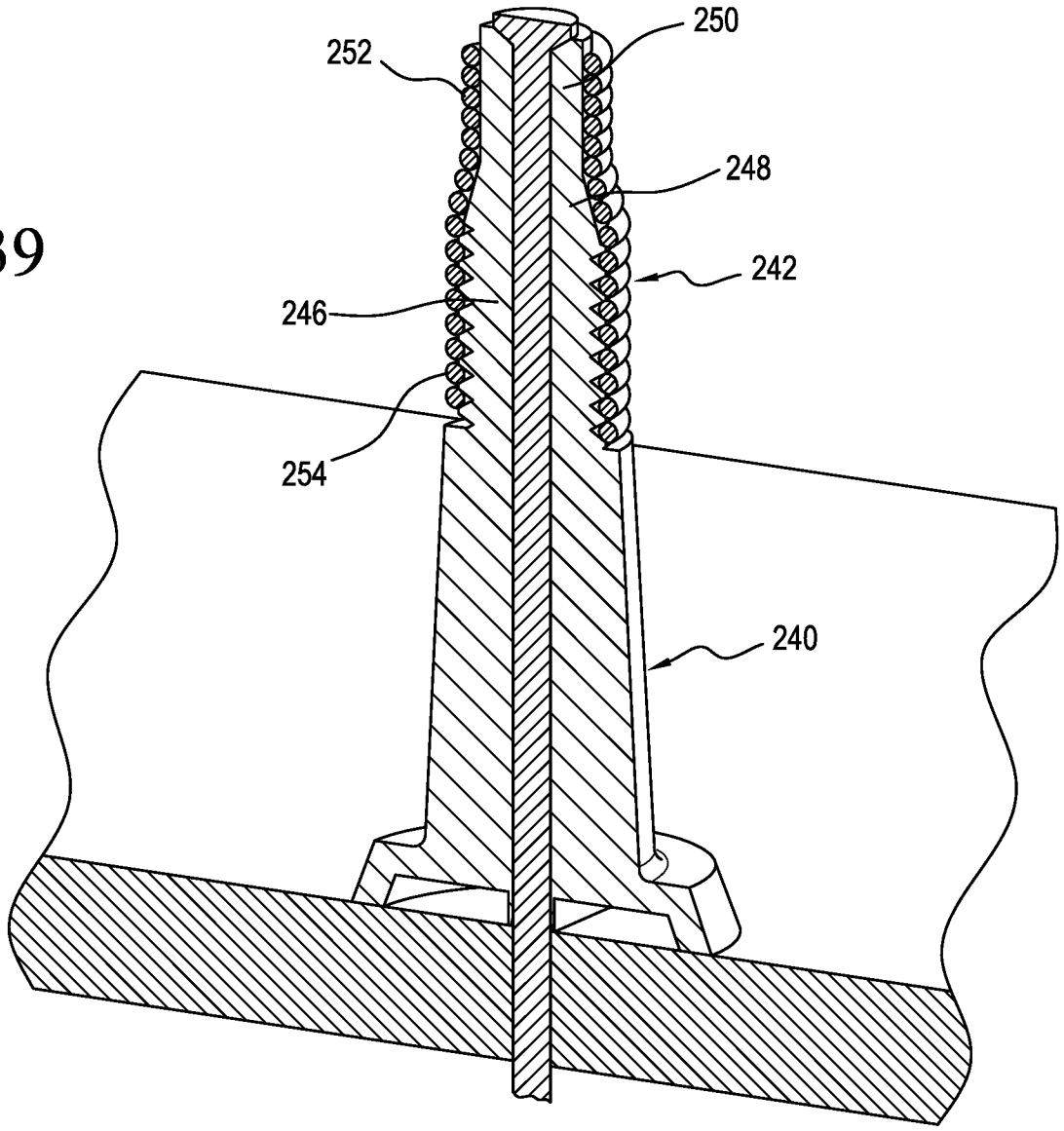
FIG. 39 is a perspective cross-sectional view of a plug attached to a coil or spring with multiple diameters.

FIG. 39 shows a plug 240 attached to a wire coil or spring 242 with multiple pitches so that different size fastener can be used. The plug has a threaded portion 246, a conical transition 248 and cylindrical portion 250. The threaded portion 248 is larger in diameter than the cylindrical portion's diameter. The coils in the upper portion 252 of the spring 242 are stacked on top of each other to seal the inside of the spring from the concrete. The coils of the lower portion 254 of the spring are spread apart and pressed against the threads of the threaded portion 246 to seal the inside of the spring from the concrete. The pitch of the lower portion 254 is larger than the pitch of the upper portion 252 to advantageously permit the flexibility of using a threaded fastener of a larger or smaller pitch and diameter.

Figure 40:
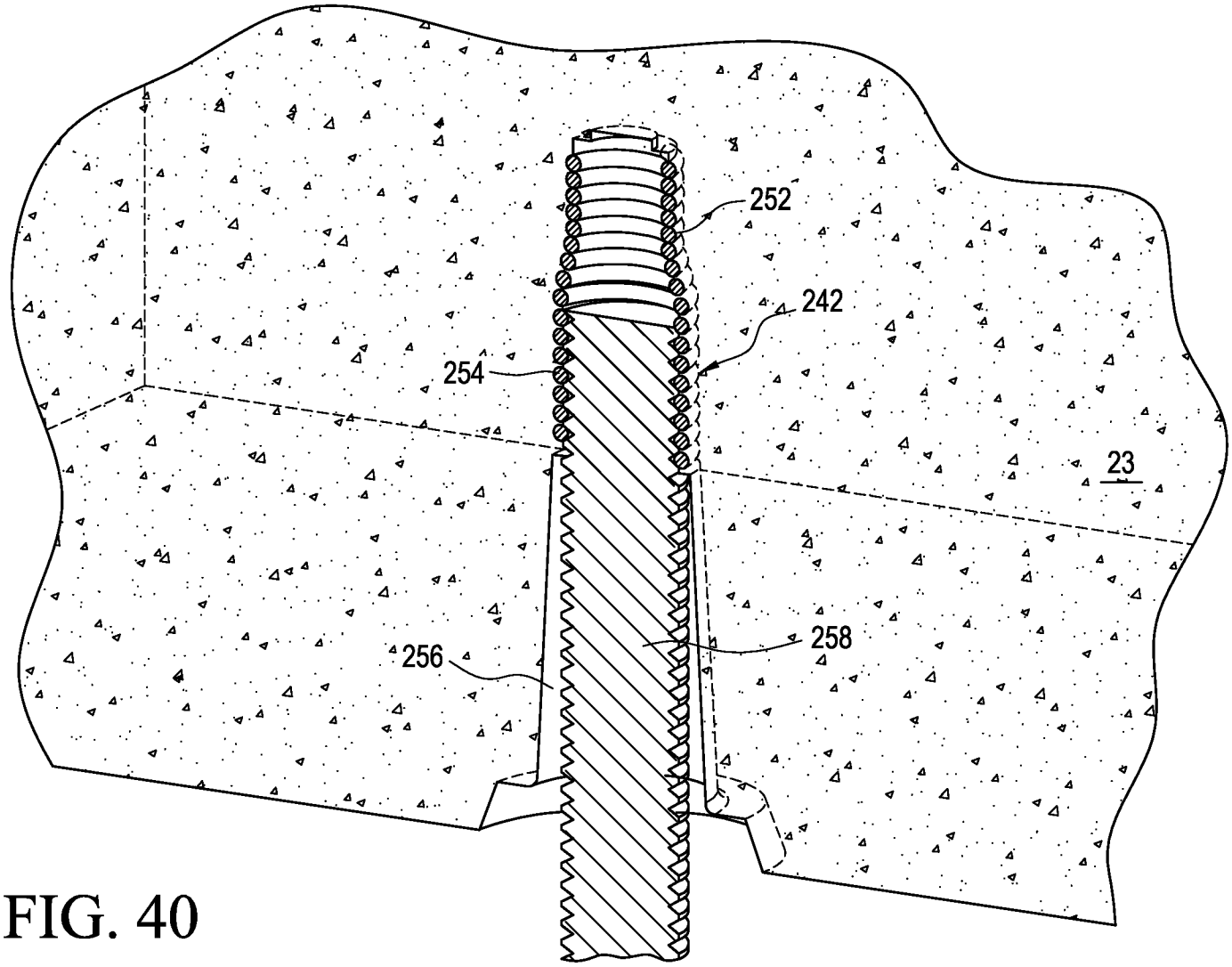
FIG. 40 is a perspective cross-sectional view of FIG. 39, showing the plug removed from the concrete and a threaded rod attached to a lower portion of the coil or spring with a larger diameter.

FIG. 40 shows the plug 240 removed after the concrete 23 has cured, creating a void 256 in the concrete. A fastener 258, such as a threaded rod or bolt, is screwed into the lower portion 254 of the spring.

Figure 41:
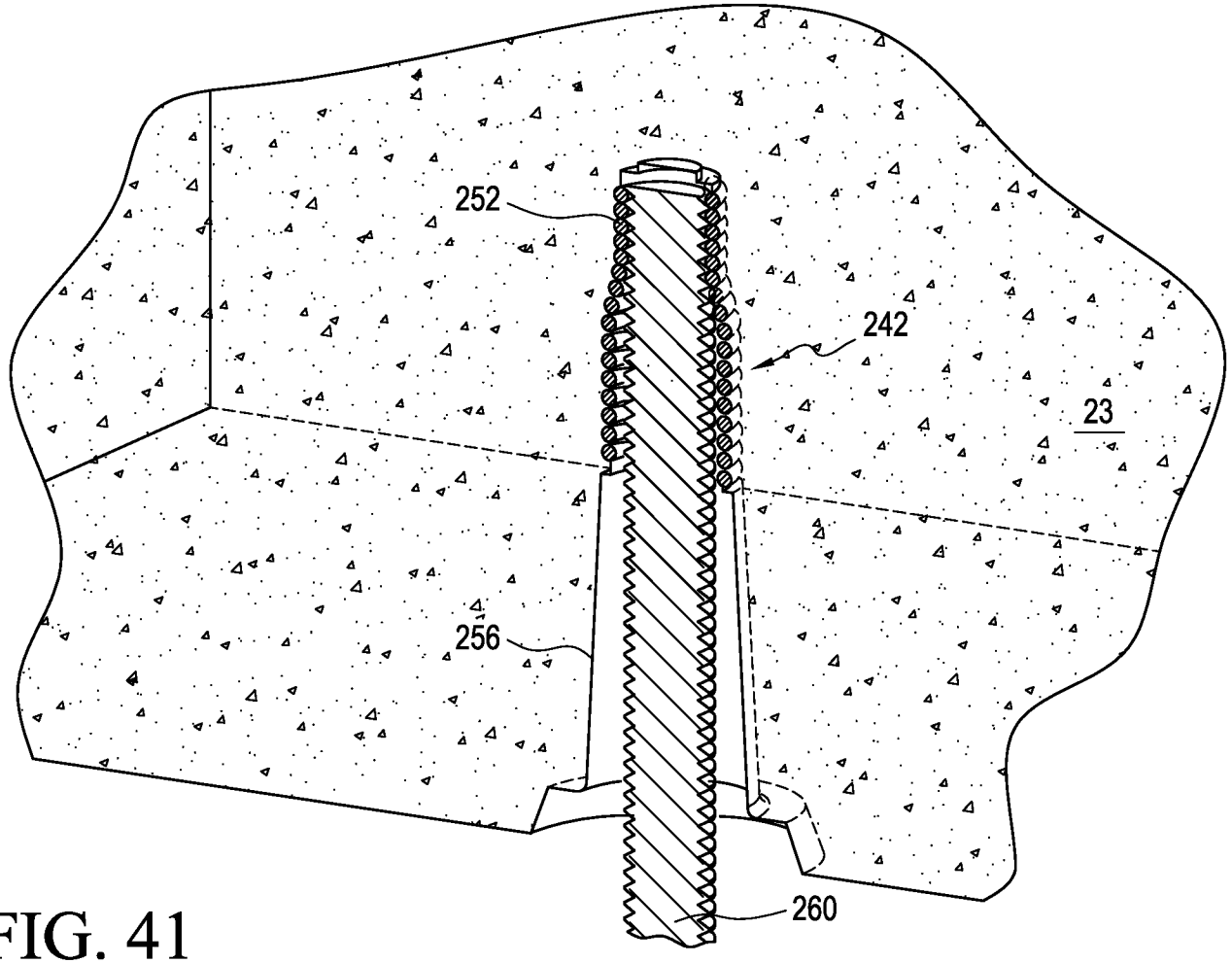
FIG. 41 is a perspective cross-sectional view of FIG. 39, showing the plug removed from the concrete and a threaded rod attached to an upper portion of the coil or spring with a smaller diameter.

FIG. 41 shows a smaller diameter fastener 260 screwed to the upper portion 252 of the spring 242. The void 256 in the concrete 23 allows access for the fastener 260.

Figure 42B:
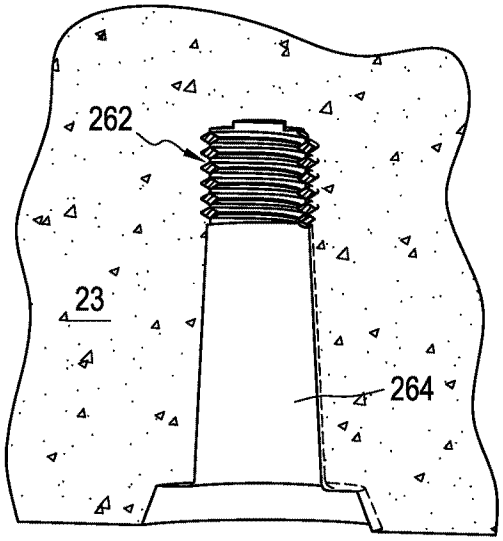
FIG. 42B is a perspective cross-sectional view of FIG. 42A, showing the plug removed, leaving the coil or spring in the concrete.
Figure 42C:
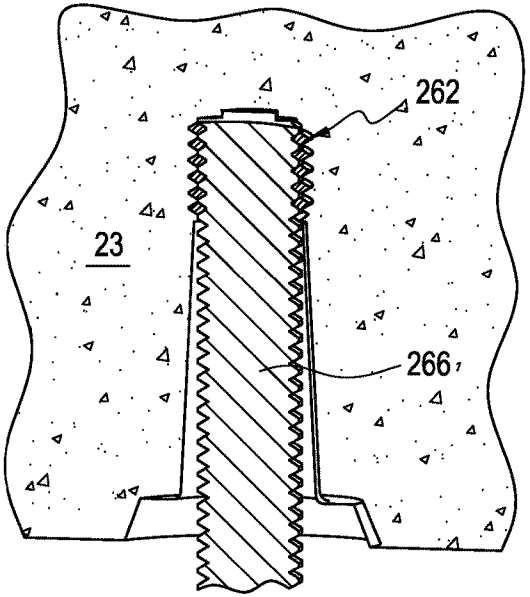
FIG. 42C is a perspective cross-sectional view of FIG. 42B, showing a threaded rod attached to the coil or spring for supporting a load.
Figure 42A:
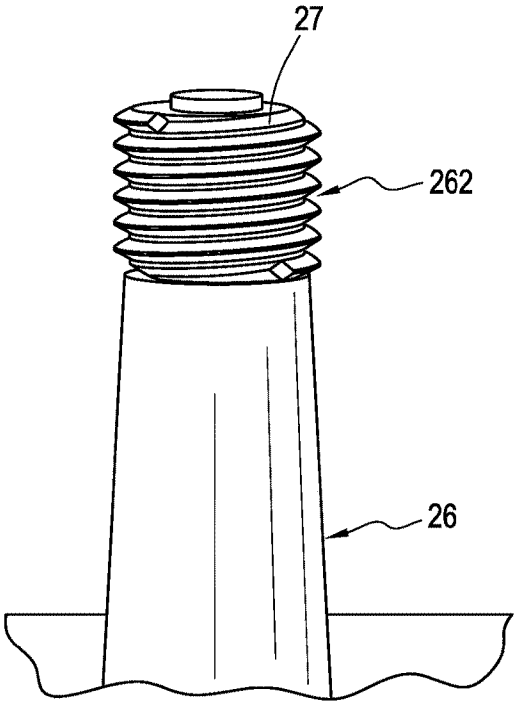
FIG. 42A is a perspective view of a plug attached to a coil or spring made of shaped metal (not round).

FIG. 42A shows the plug 26 attached to a coiled wire 262 formed into the threads of the threaded portion 27 of the plug. The wire has a shaped cross-section, such as square, diamond, etc. and has the same shape as the threads of the threaded section 27. The coils do not touch each other and concrete fills up the space between the coils.

FIG. 42B shows the void 264 in the concrete after the plug is removed after the concrete 23 has cured. The coiled wire 262 remains in the concrete.

FIG. 42C shows a fastener 266 screwed to the coiled wire 262 through the void 264 in the concrete 23.

Figure 43:
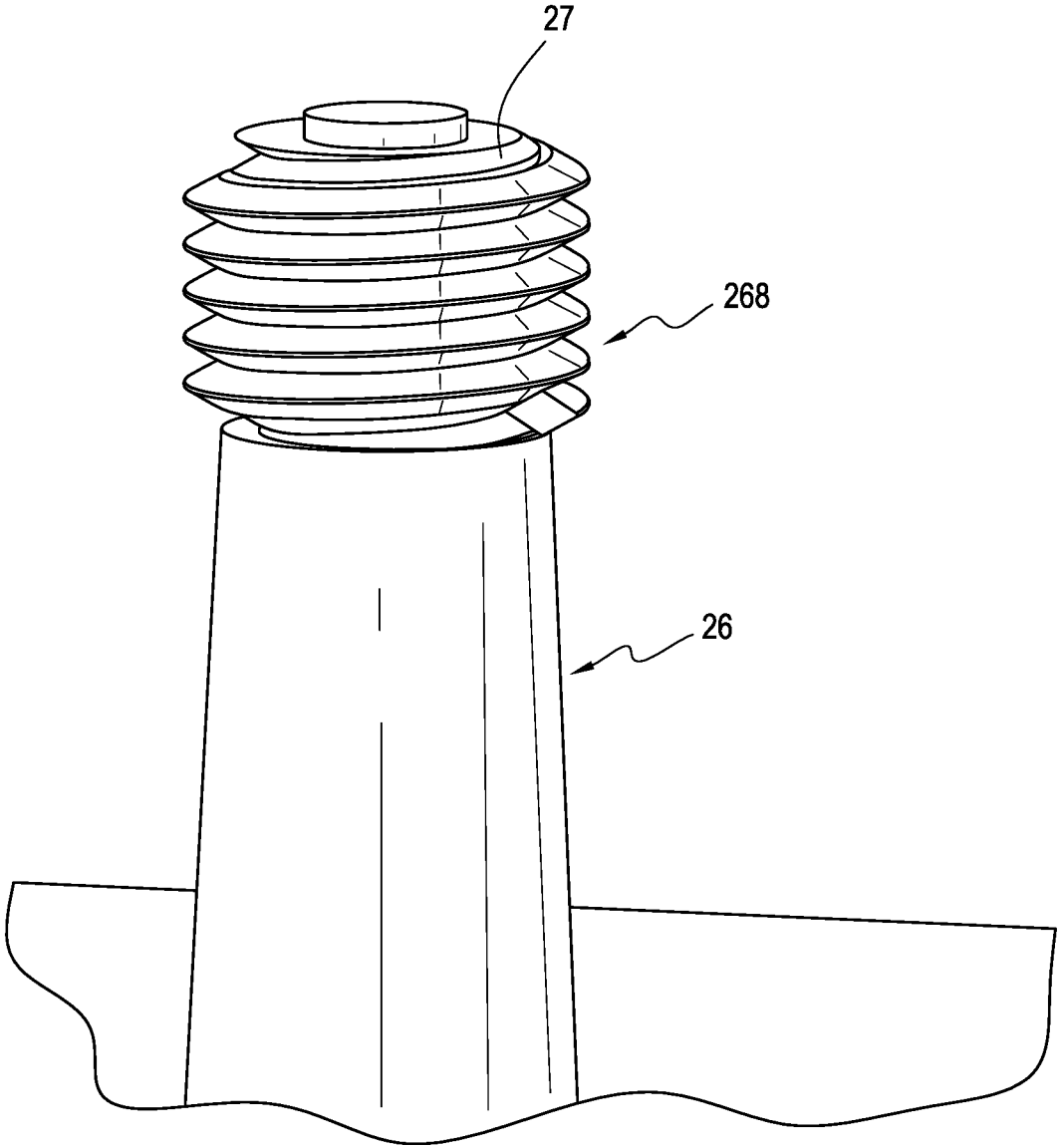
FIG. 43 is a perspective view of a plug attached to a coil or spring of shaped metal (not round), showing the individual coils touching the adjacent coil to seal the interior of the coil or spring from the concrete.

FIG. 43 shows the plug 26 attached to a coiled wire 268 wound around the threaded portion 27 of the plug. The wire has a shaped cross-section, such as square, diamond, etc., and has the same shape as the threads of the threaded section 27. The coils touch each other to seal the concrete from the inside of the coiled wire.

Figure 44A:
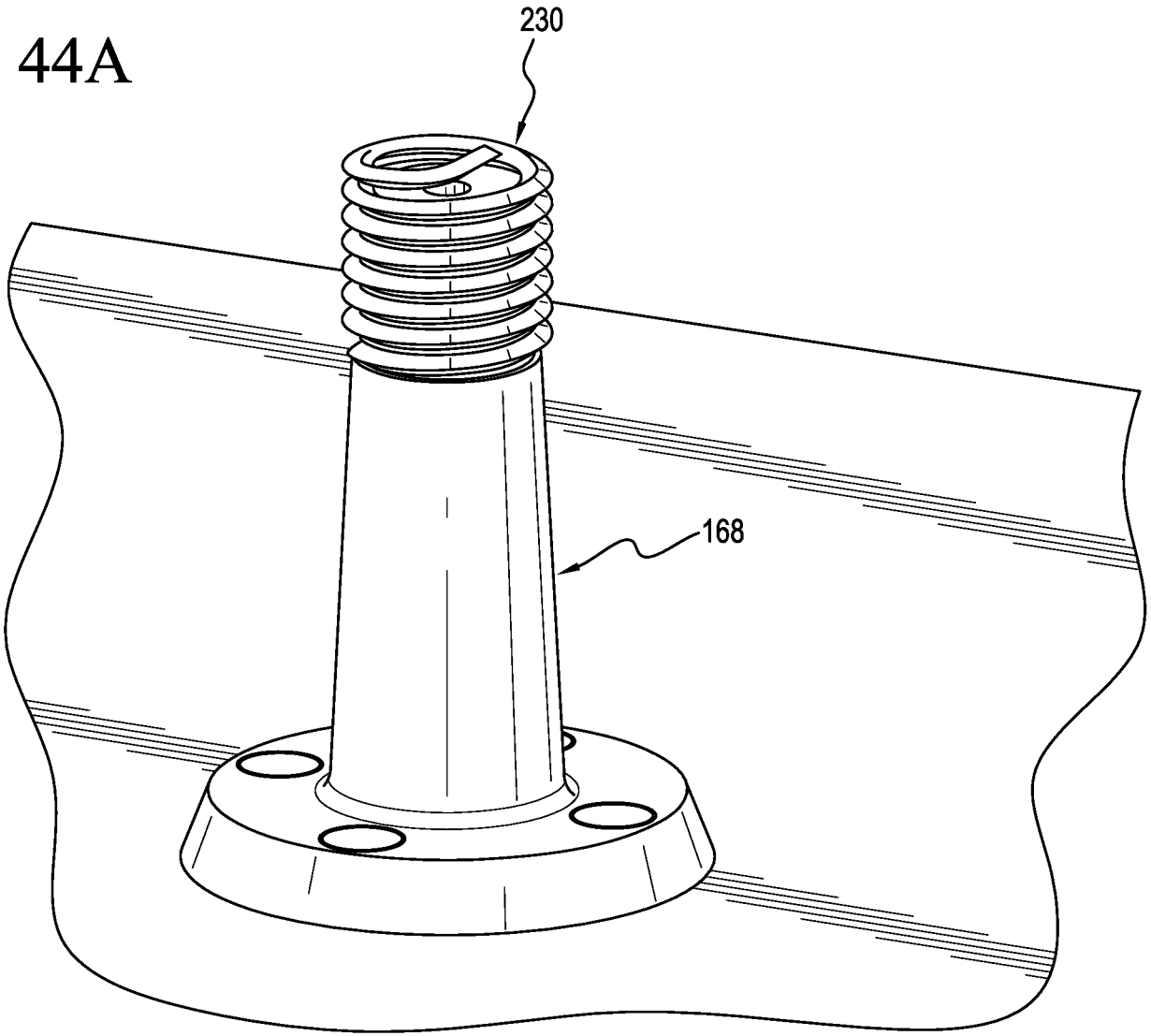
FIG. 44A is a perspective view of a plug attached to a Heli coil.

FIG. 44A shows the plug 168 attached to a coil anchor body 230, such as a Heli-coil, at the threaded portion 27. The coils do not touch each other to seal out fluid concrete. The plug molds the concrete as well as holding and or suspending the coil anchor body in-place before, during, and after the concrete is poured. After the concrete has cured and hardened, the plug is able to be removed and the Heli-coil can be used as an anchor body. Once the plug is removed, a threaded rod will thread in easily. The Heli-coil and concrete are together controlled by the plug to form an anchor body. Both concrete and steel surfaces are controlled to form dimension geometry with standard tolerances such that are similar with standard nut and bolts threaded geometry and tolerances. This same idea and invention is consistent throughout the other anchor bodies provided herein with different variations and configurations.

Figure 44B:
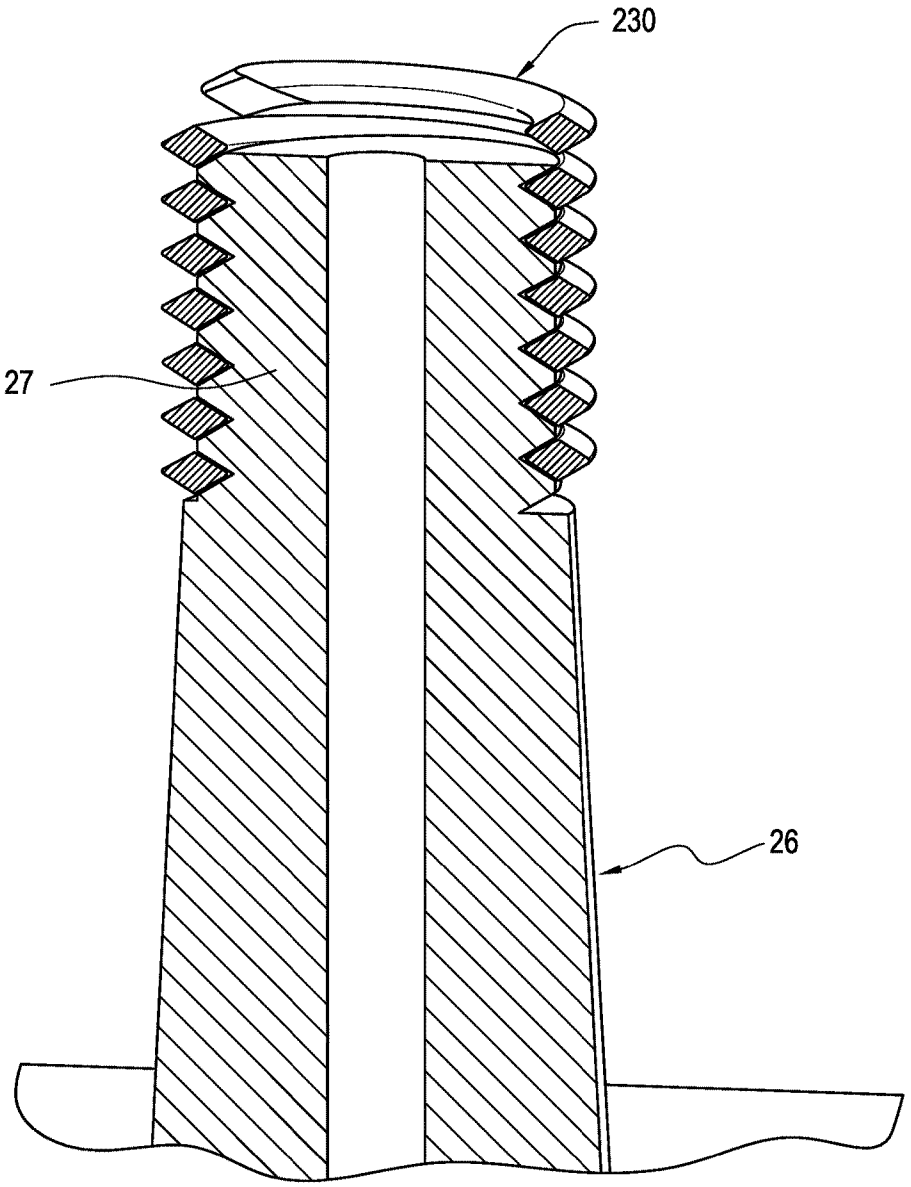
FIG. 44B is a perspective cross-sectional view of FIG. 44A.

FIG. 44B shows a cross-section of the arrangement shown in FIG. 44A, showing the coils not touching each other.

Figure 45:
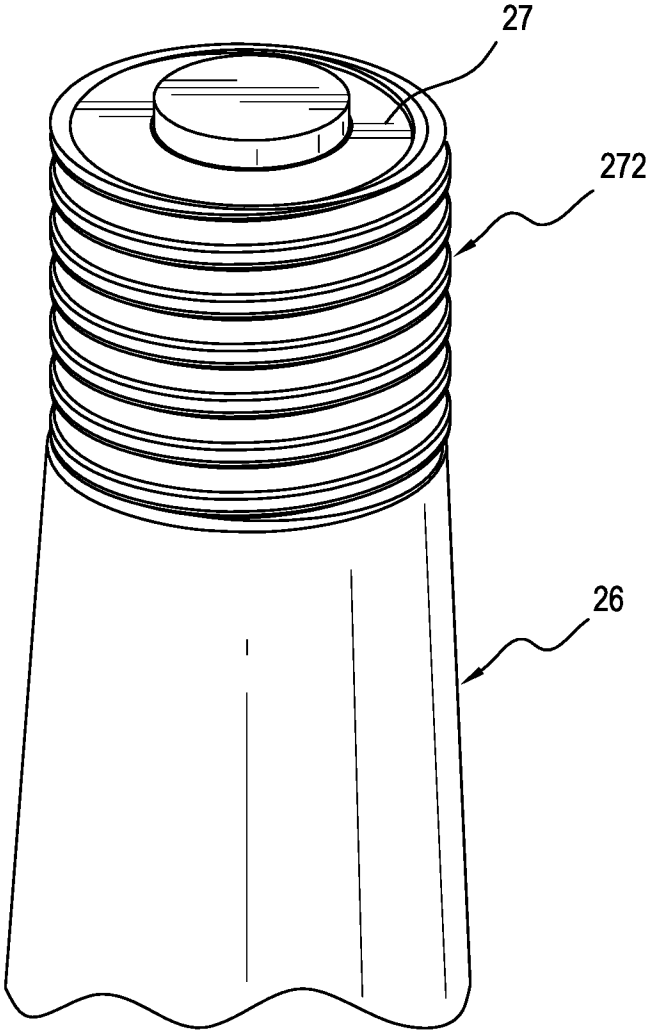
FIG. 45 is a perspective view of a plug attached to a thin wall formed metal in the shape of interior and exterior threads.

FIG. 45 shows the plug 26 attached to a metal sleeve 272 formed with threads threaded to the threaded portion 27. The sleeve is a thin metal formed to create internal threads to hold a fastener and external threads to create an external geometry for the required concrete bearing area for the designed load for the fastener. The sleeve is continuous without a break.

Figure 46:
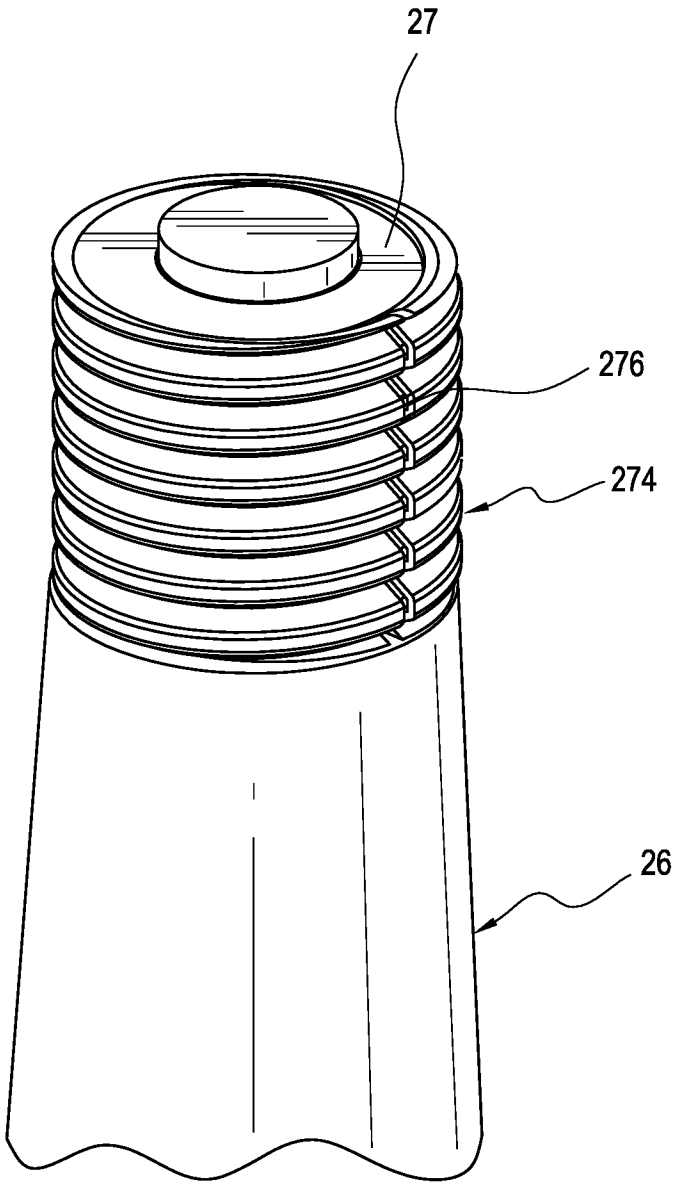
FIG. 46 is a perspective view of a non-continuous thin wall formed metal in the shape of interior and exterior threads.

FIG. 46 shows the plug 26 attached to a split metal sleeve 274 formed with threads threaded to the threaded portion 27. The sleeve 274 shows a vertical split 276.

Figure 47:
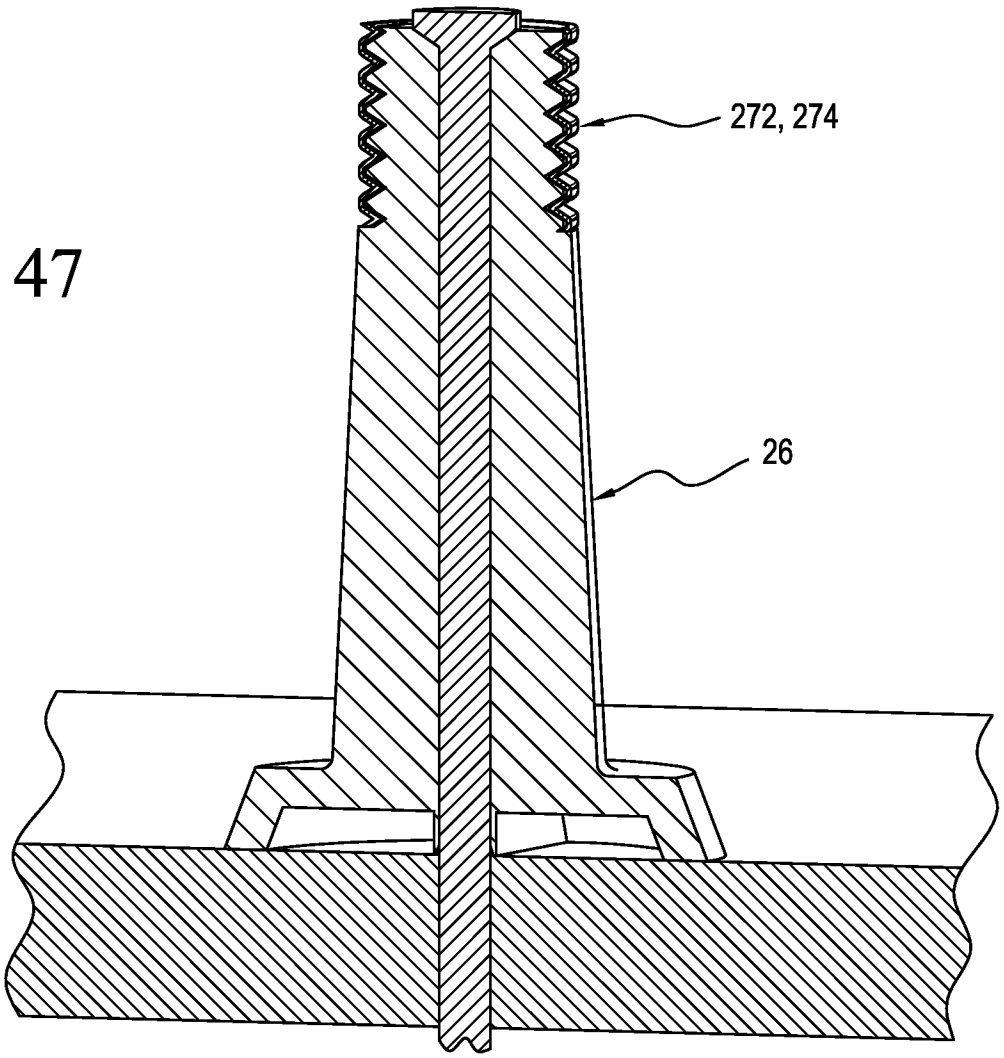
FIG. 47 is a perspective cross-sectional view of FIGS. 45 and 46.

FIG. 47 shows a cross-section of FIGS. 45 and 46, showing the internal and external threads of the sleeves 272 and 274.

Figure 48:
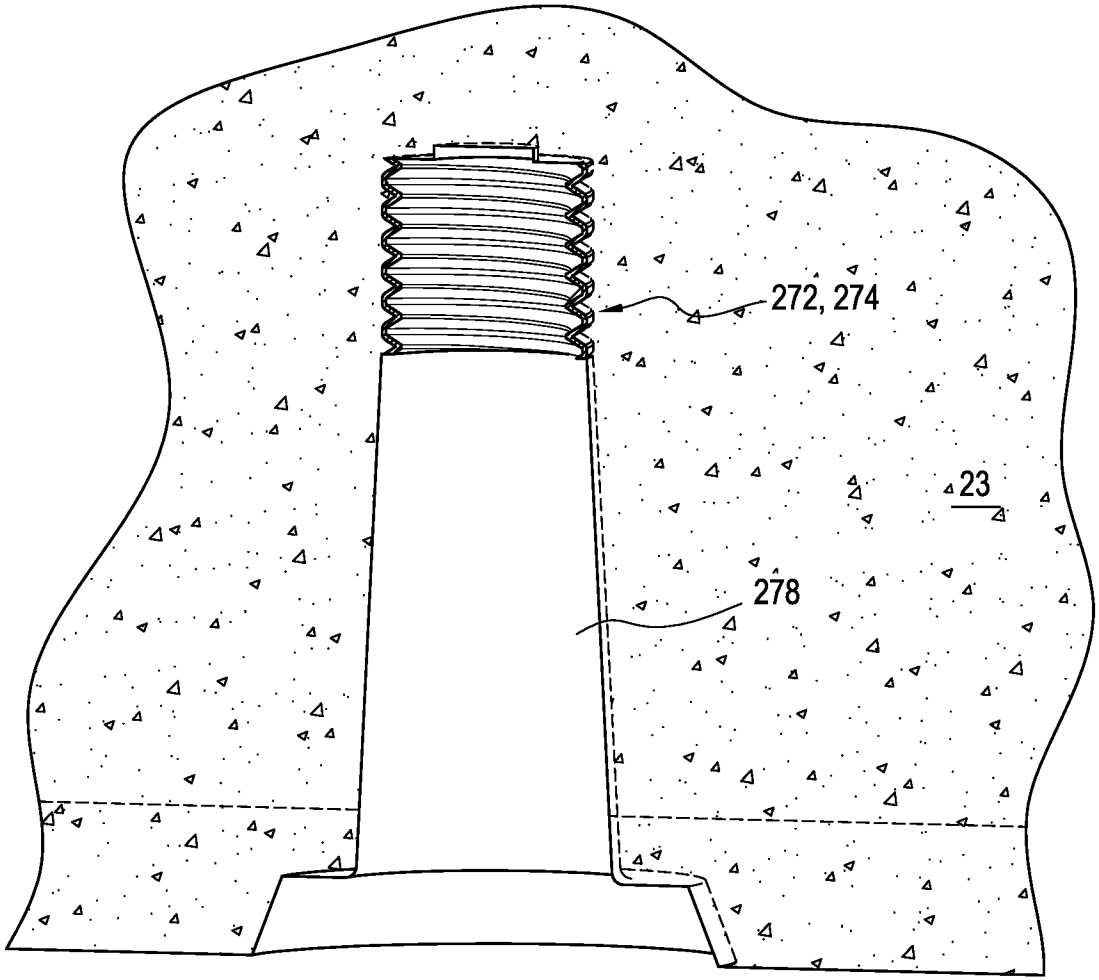
FIG. 48 is a perspective cross-sectional view of FIGS. 45 and 46, showing the plug removed from the concrete, leaving the formed metal in the concrete.

FIG. 48 shows the plug removed, leaving a void 278 in the concrete 23. The threaded sleeve 272 or 274 is left behind in the concrete 23 to which a threaded fastener may be screwed.

Figure 49B:
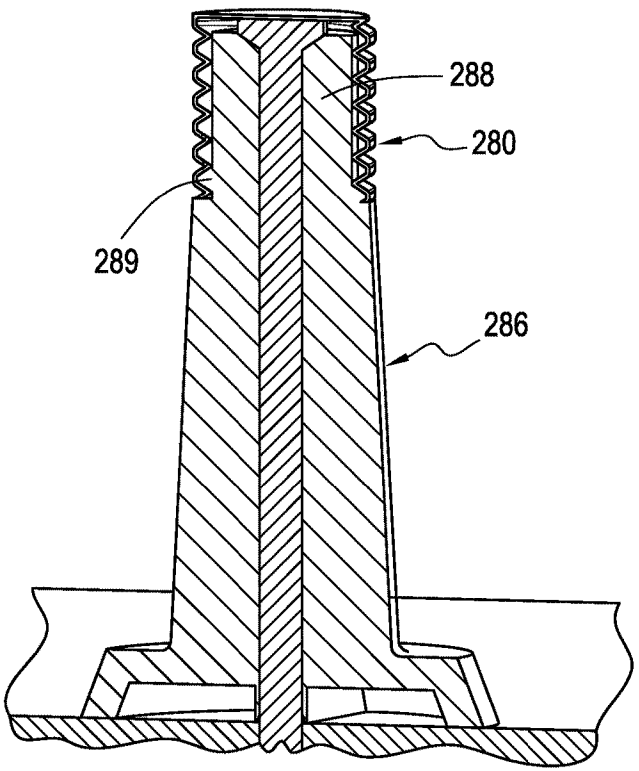
FIGS. 49A and 49B are perspective cross-sectional views of FIG. 45 with a closed top thin wall formed metal in the shape of interior and exterior threads.
Figure 49A:
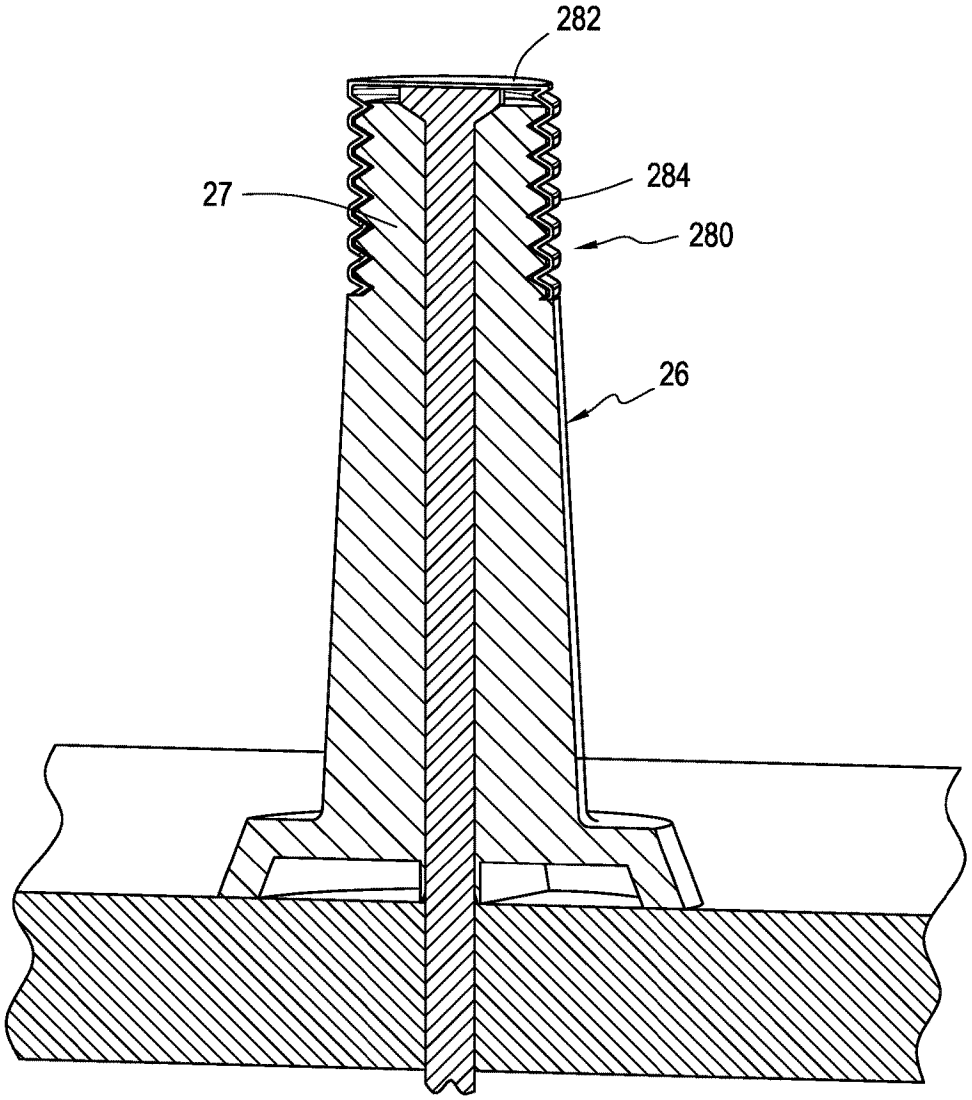

FIG. 49A shows an inverted metal cup 280 with a bottom wall 282 and a side wall 284 formed with threads. The cup is attached to the threaded portion 27.

FIG. 49B shows a plug 286 with a cylindrical portion 288 with a single turn thread (one revolution) 289. The inverted metal cup 280 is screwed to the single thread so that the plug can be removed with a single turn.

Figure 50:
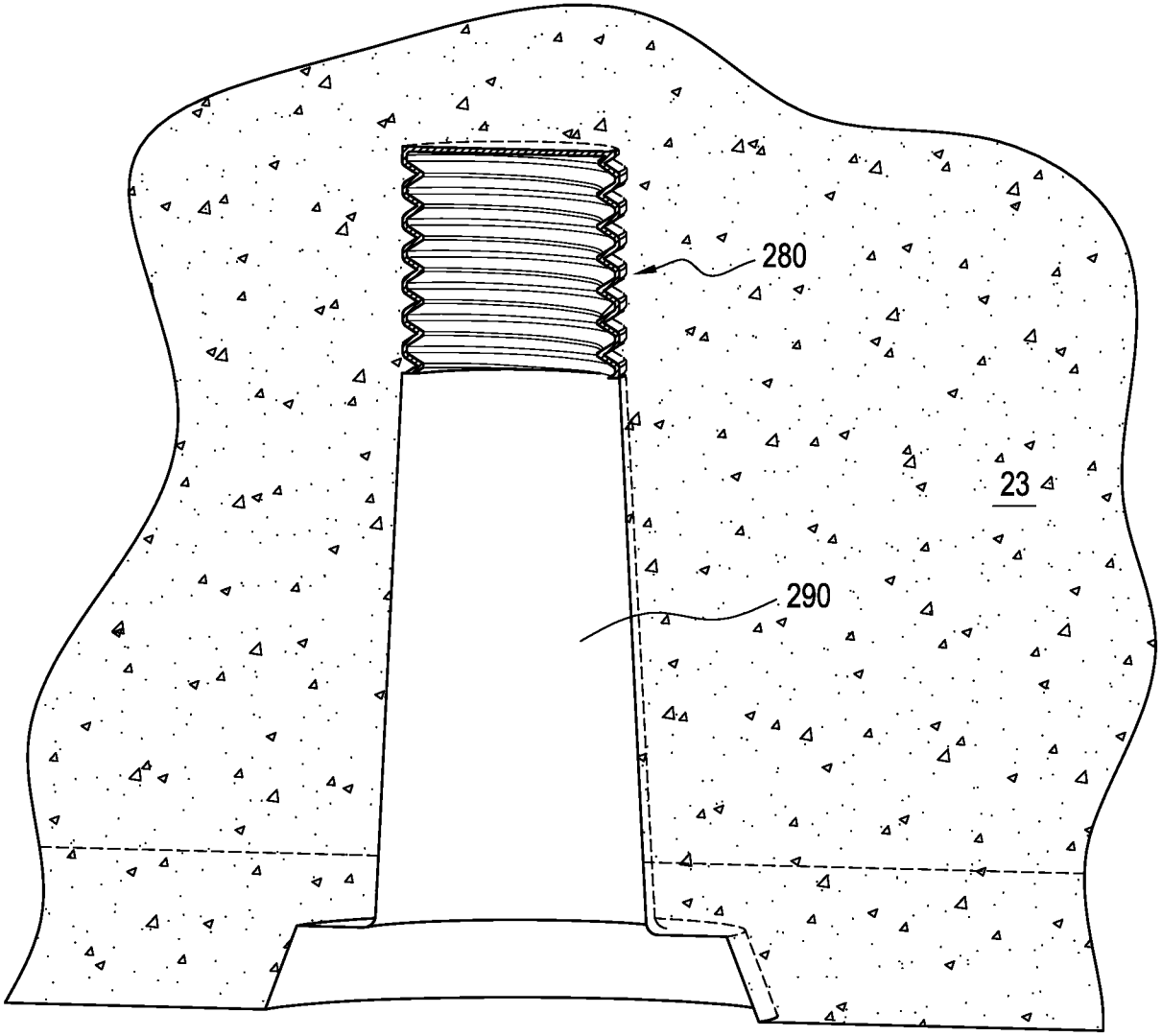
FIG. 50 is a perspective cross-sectional view of FIGS. 49A and 49B, showing the plug removed from the concrete.

FIG. 50 shows a void 290 in the concrete 23 after the plug 26 or 286 is removed. The metal cup 280 is left behind in the concrete to which a threaded fastener may be screwed.

Figure 51:
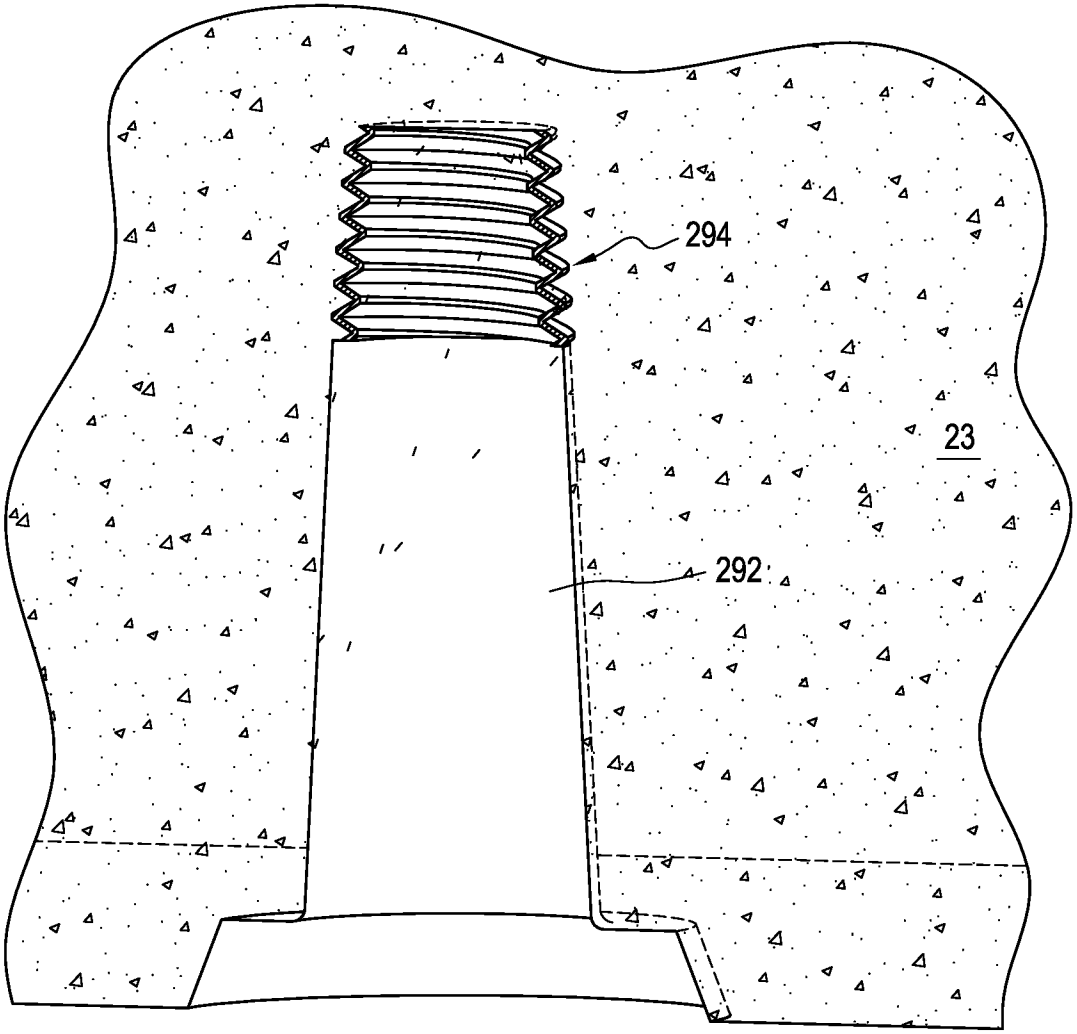
FIG. 51 is a perspective cross-sectional view of FIG. 48 with a tapered thin wall formed metal in the shape of interior and exterior threads.
Figure 52:
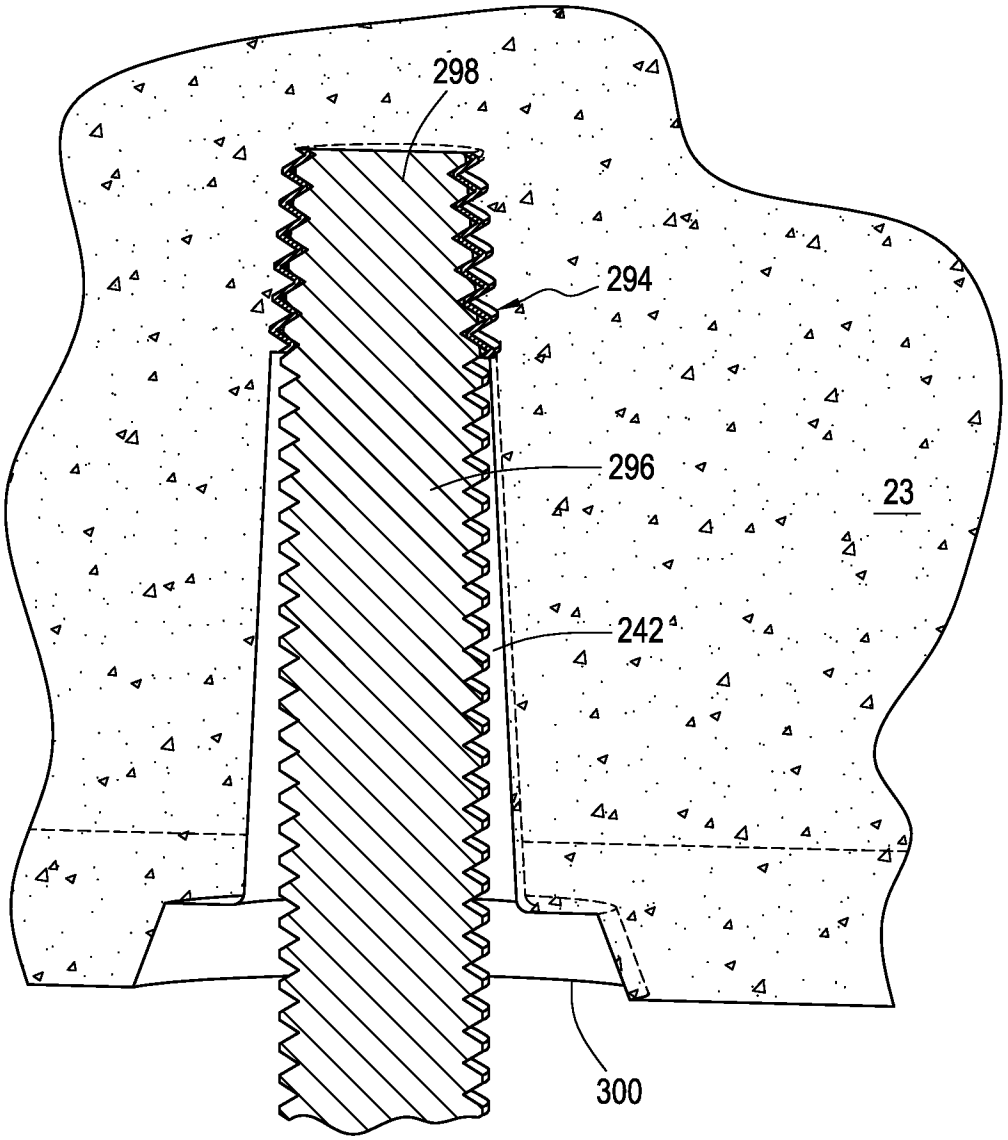
FIG. 52 is a perspective cross-sectional view of FIG. 51, showing a threaded rod attached to the formed metal for supporting a load.

FIG. 51 shows a void 292 in the concrete 23 after the plug is removed after the concrete has cured. A tapered inverted metal cup 294 is left behind in the concrete FIG. 52 shows a threaded rod 296 with a threaded tapered end portion 298 screwed to the tapered metal cup 294. The rod 296 is inserted into the void 292 in the concrete 23 through an opening 300 at the bottom of the concrete created by the plug.

Figure 53:
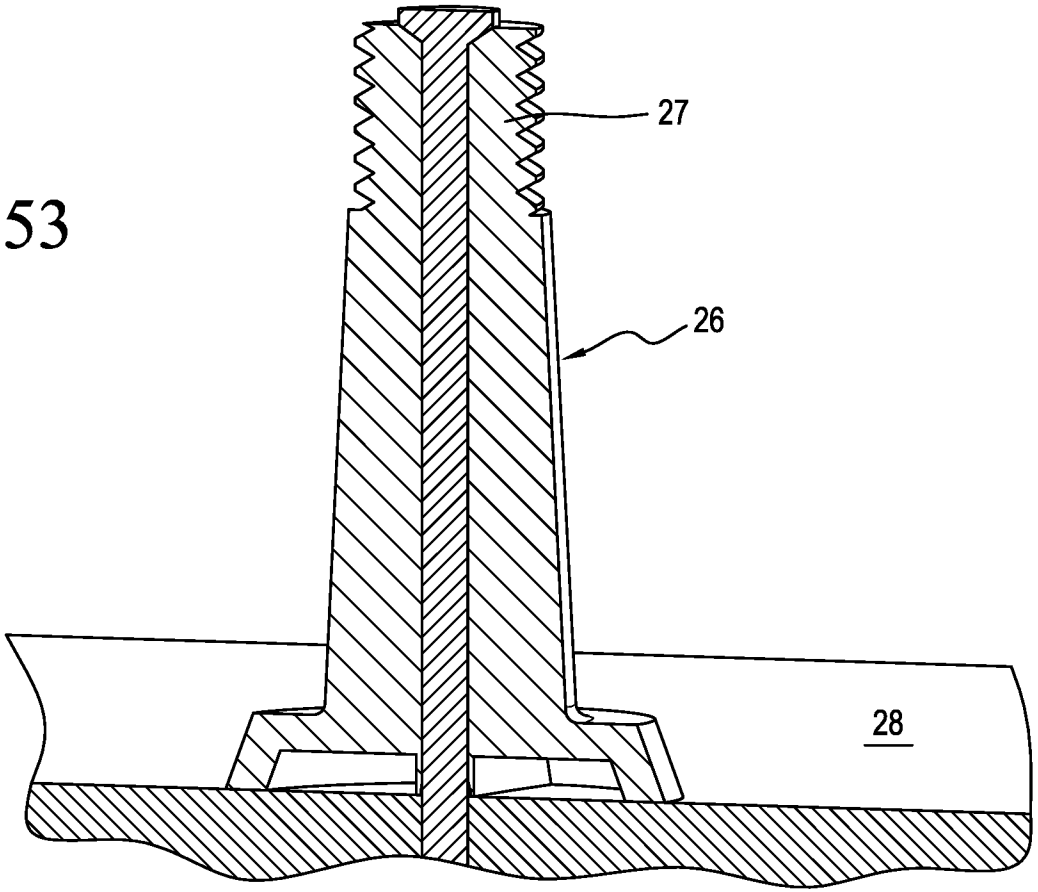
FIG. 53 is a perspective cross-sectional view of a plug.

FIG. 53 shows the plug 26 attached to the form board 28. The threaded portion 27 is used to form the threads in the concrete.

Figure 54:
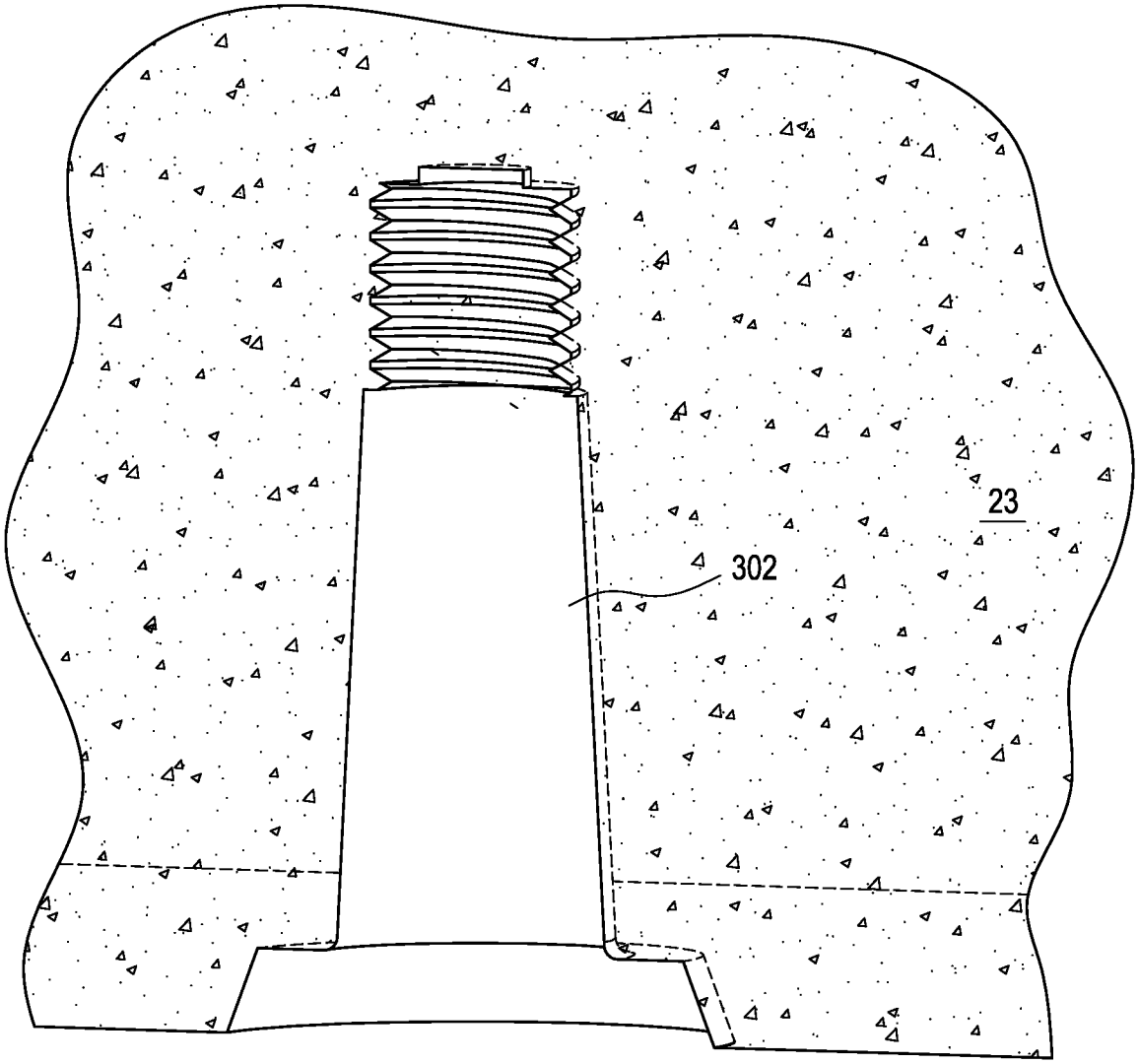
FIG. 54 is a perspective cross-sectional view of FIG. 53, showing the plug removed from the concrete.

FIG. 54 shows the void 302 in the concrete 23 after the plug is removed after the concrete 23 has cured. The threaded portion 27 forms the threads in the concrete to which a fastener may be screwed.

Figure 55B:
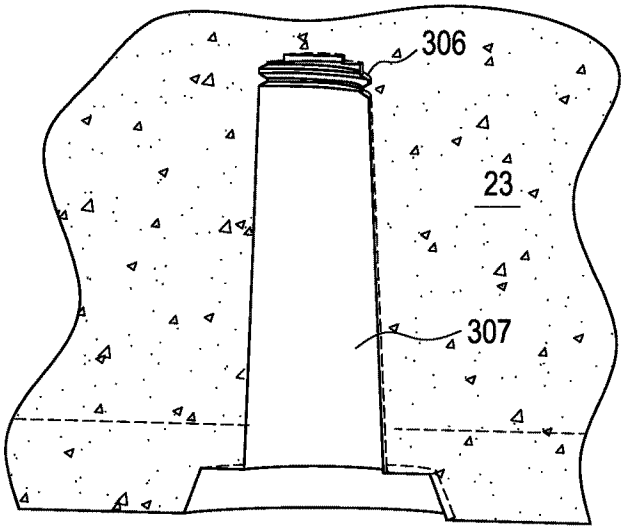
FIG. 55B is a perspective cross-sectional view of FIG. 55A, showing the plug removed from the concrete.
Figure 55C:
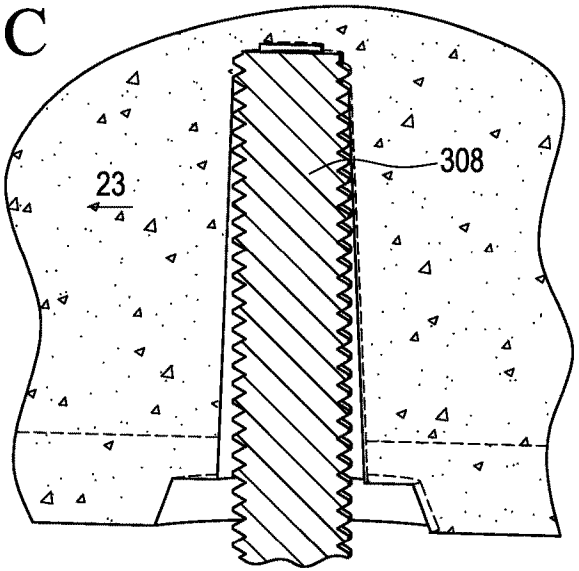
FIG. 55C is perspective cross-sectional view of FIG. 55B, showing a threaded rod attached to the concrete-formed thread for supporting a load.
Figure 55A:
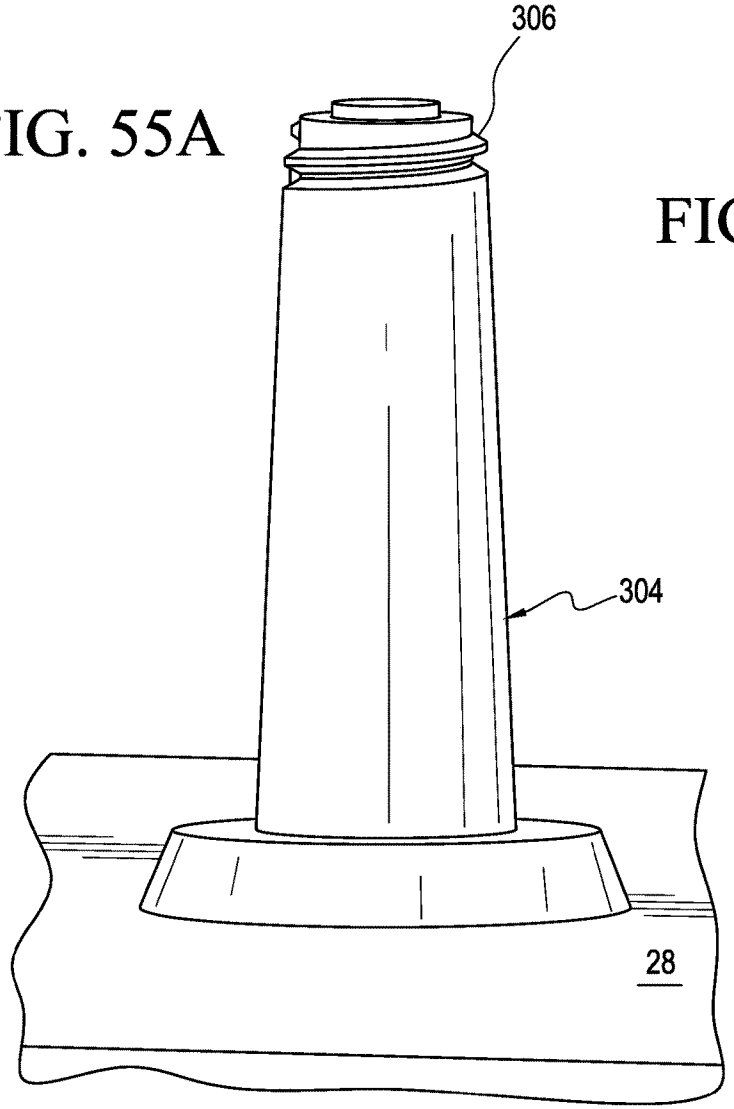
FIG. 55A is a perspective view of a plug with a single (one-revolution) thread.

FIG. 55A shows a plug 304 attached to a form board 28. A single turn (one revolution) thread 306 or less at the end of the end of the plug is used to form a corresponding single turn thread or less in the concrete.

FIG. 55B shows the void 307 in the concrete 23 after the plug is removed after the concrete has cured. The single turn thread 306 is formed in the concrete 23.

FIG. 55C show a fastener 308 threaded to the single turn thread 306 in the concrete 23.

Figure 56:
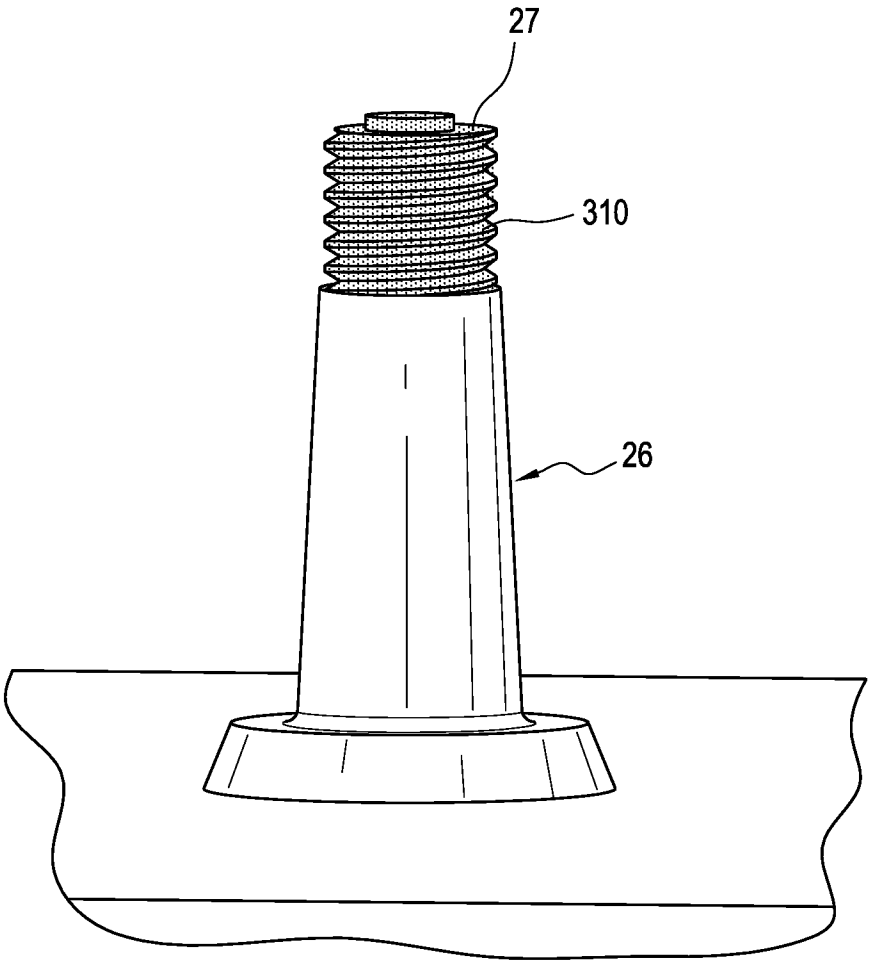
FIG. 56 is a perspective view of plug with a non-stick tape wrapped around the threaded end portion of the plug.

FIG. 56 shows the plug 26 with the threaded portion 27 wrapped in TEFLON tape 310 to create a non-structural barrier between the plug and the concrete. The tape 310 provides for easier removal of the plug after the concrete has cured.

Figure 57:
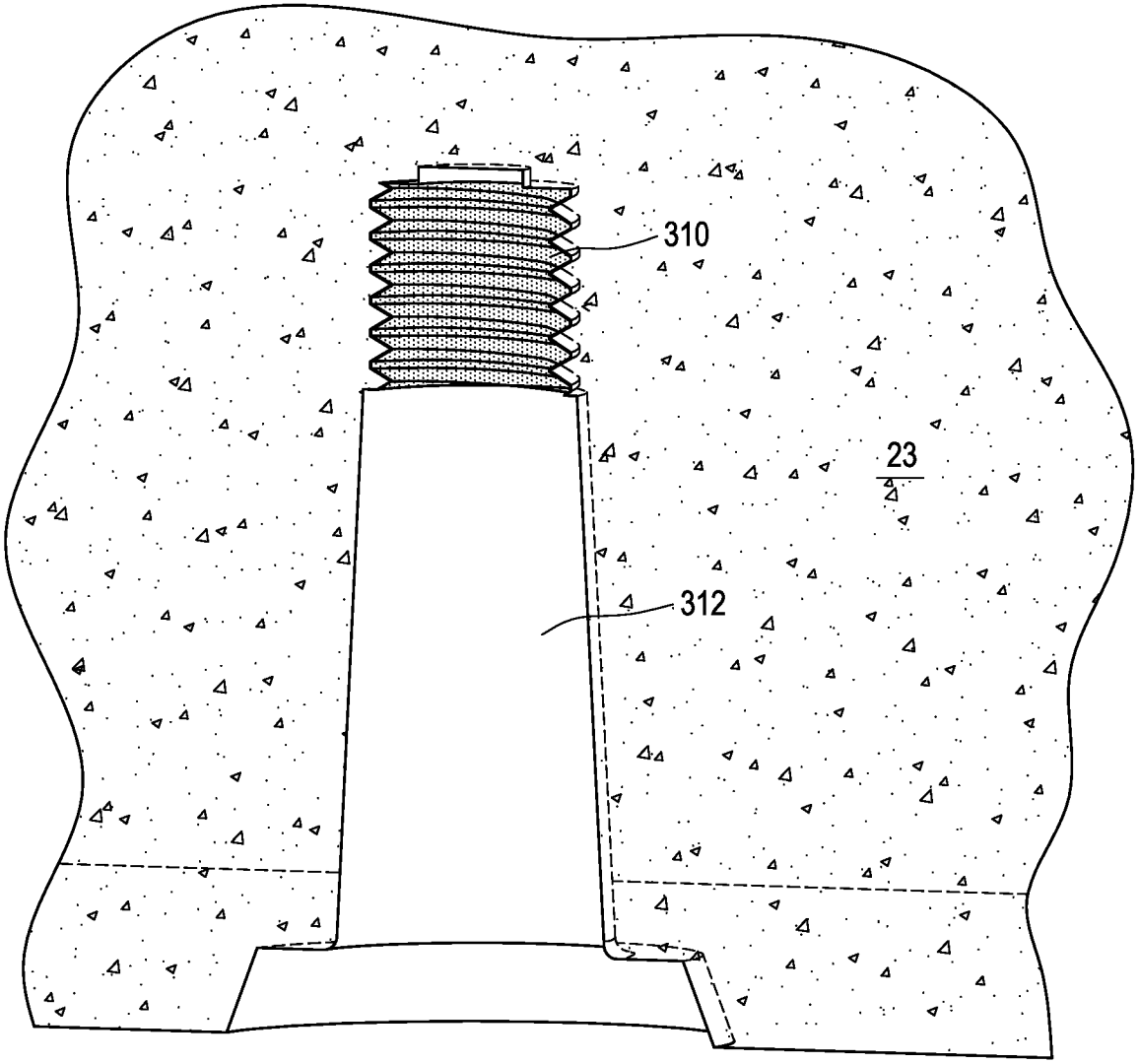
FIG. 57 is a perspective cross-sectional view of FIG. 56, showing the plug removed from the concrete and the non-stick tape left behind in the concrete.

FIG. 57 shows the void 312 in the concrete 23 after the plug is removed after the concrete has cured. The non-stick tape 310 remains in the threads formed in the concrete.

Figure 58:
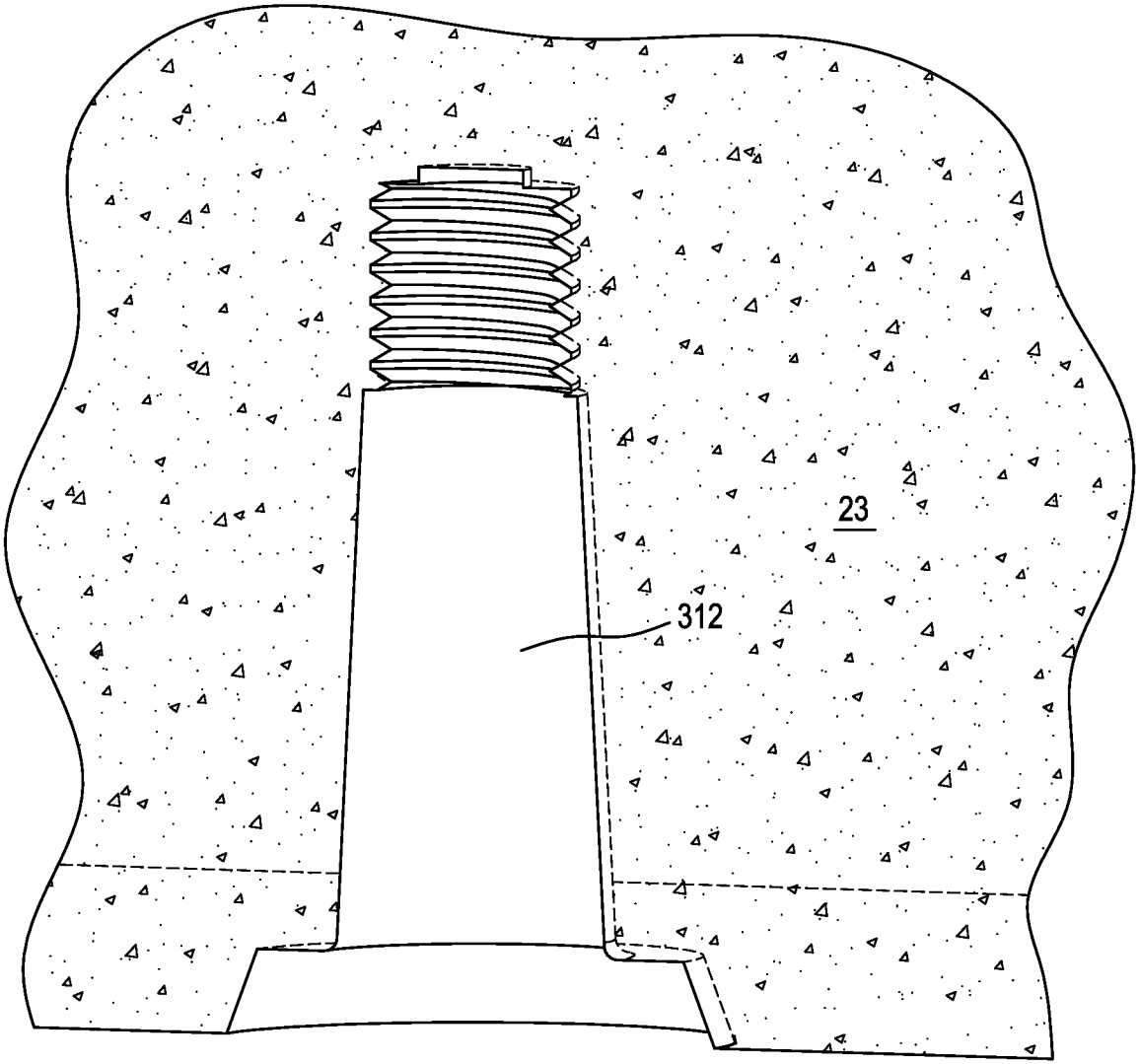
FIG. 58 is a perspective cross-sectional view of FIG. 57, showing the non-stick tape removed from the concrete.

FIG. 58 shows the void 312 in the concrete 23 with the non-stick tape 310 removed from the formed threads in the concrete 23.

Figure 59:
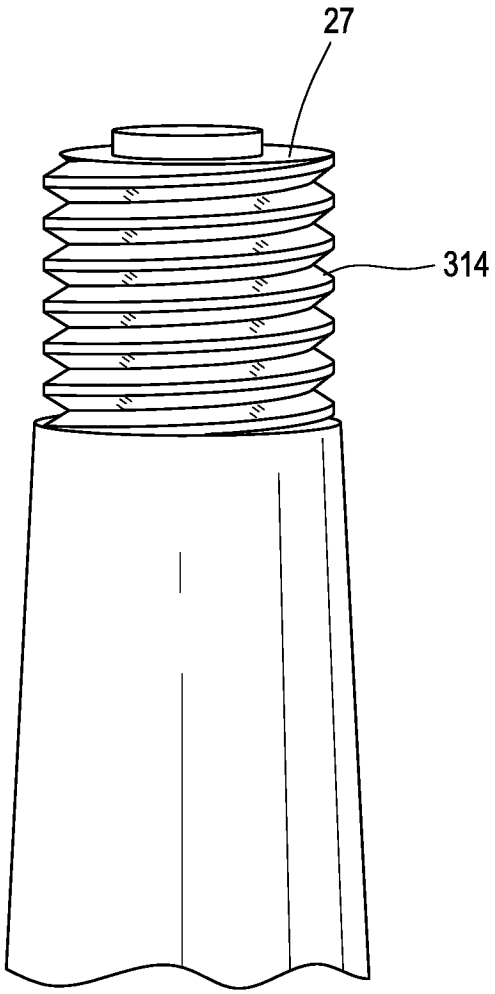
FIG. 59 is a perspective view of a plug with a metallic foil wrapped around the threaded end portion of the plug.

FIG. 59 shows the plug 26 with the threaded portion wrapped with a thin metallic foil 314 to create a barrier between the threaded portion 27 and the concrete.

Figure 60:
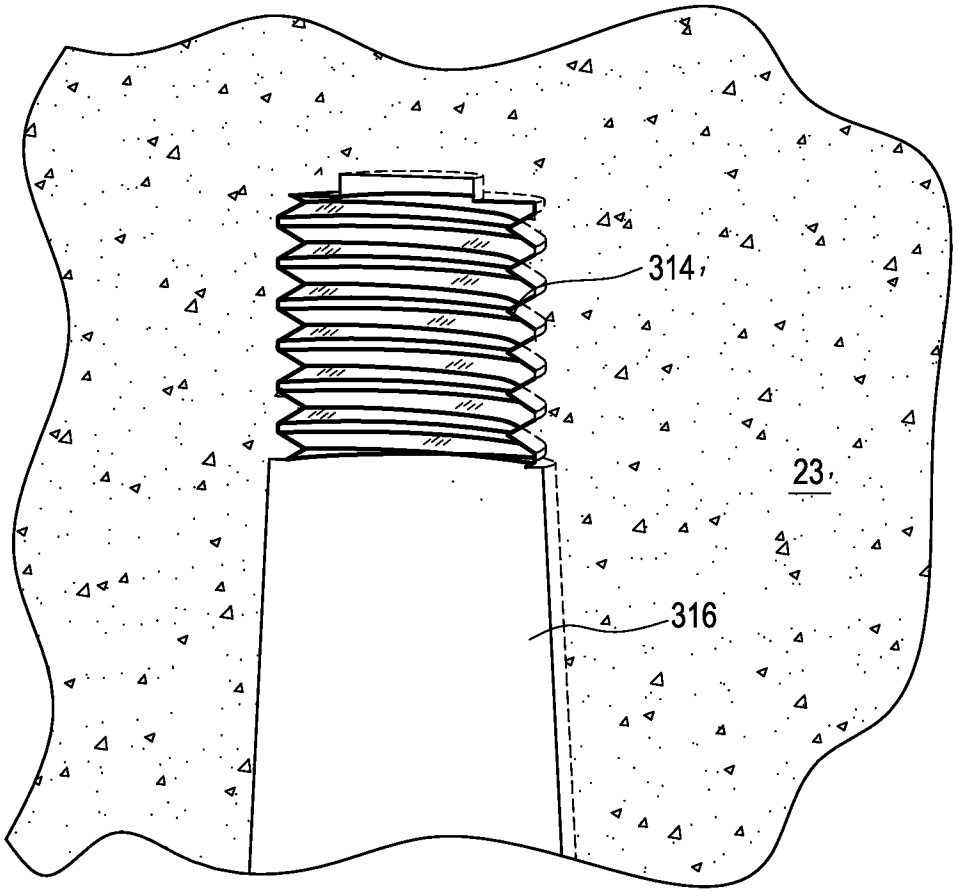
FIG. 60 is cross-sectional view of FIG. 59, showing the plug removed from the concrete and the metallic foil left behind in the concrete.

FIG. 60 shows the void 316 in the concrete 23 after the plug is removed after the concrete has cured. The metallic foil 314 remains in the threads formed in the concrete.

Figure 61:
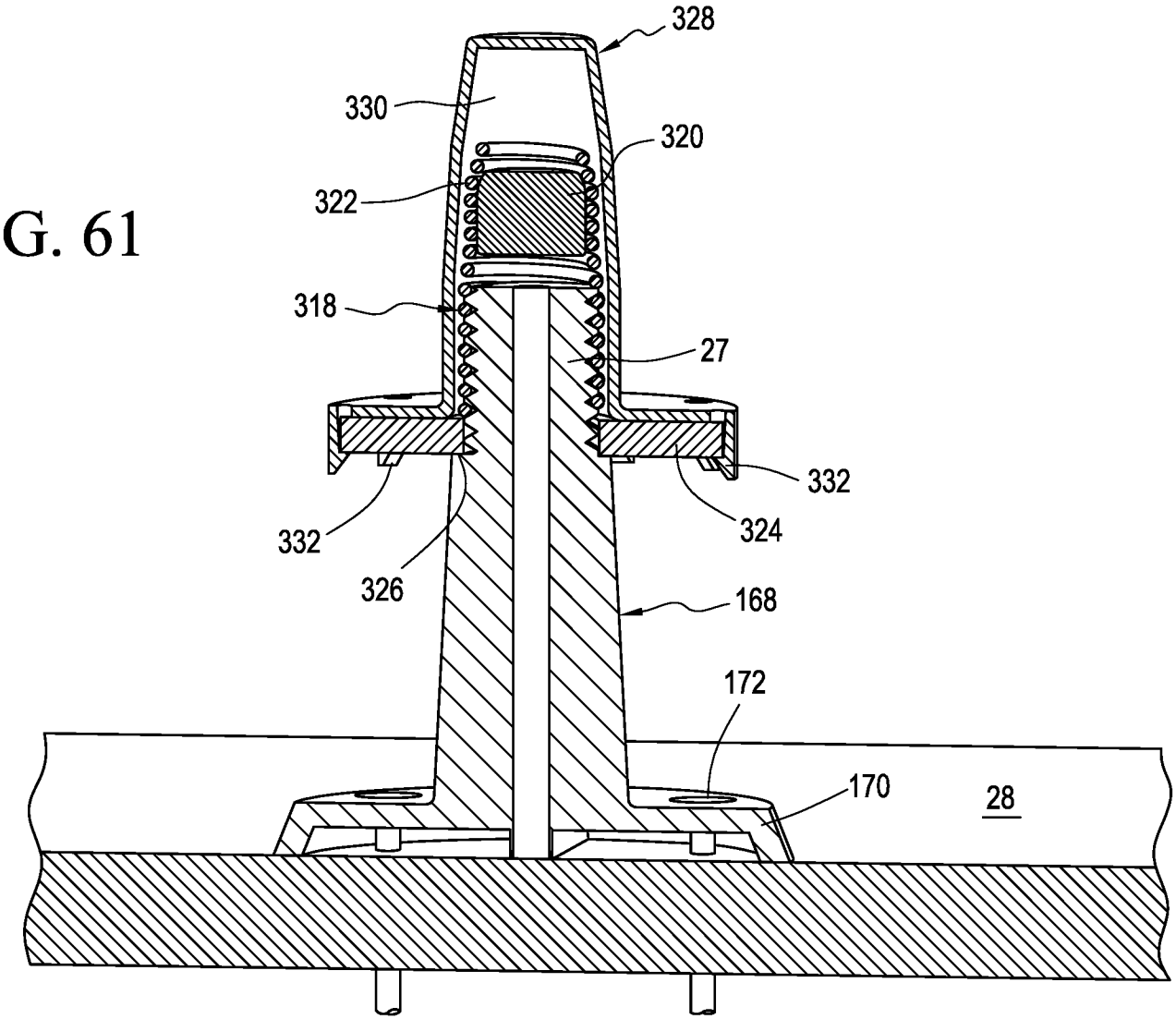
FIG. 61 is a perspective cross-sectional view of a plug attached to a metal washer, a push plug, a spring and cap.

FIG. 61 shows the plug 168 with the threaded portion 27. The base portion 170 is attached to the form board 28 with nails 172. A spring 318 with multiple diameters and pitches is attached to the threaded portion 27. An expansion plug 320 is attached at the smaller diameter portion 322 of the spring. The expansion plug 320 expands the portion 322 to a larger diameter equal to the diameter of the expansion plug 320. A metal washer 324 is supported by a peripheral shoulder 326 at the bottom of the threaded portion 27. A cap 328 seals the washer, spring and the expansion plug from the concrete. A cavity 330 is provided to receive the expansion plug 320 and when the threaded fastener is installed and pushes the expansion plug 320 into the cavity 330. The portion 322 contracts to its original diameter when the expansion plug 320 is pushed out. The cap 328 has clip portions 332 that hold the washer in place.

Figure 62:
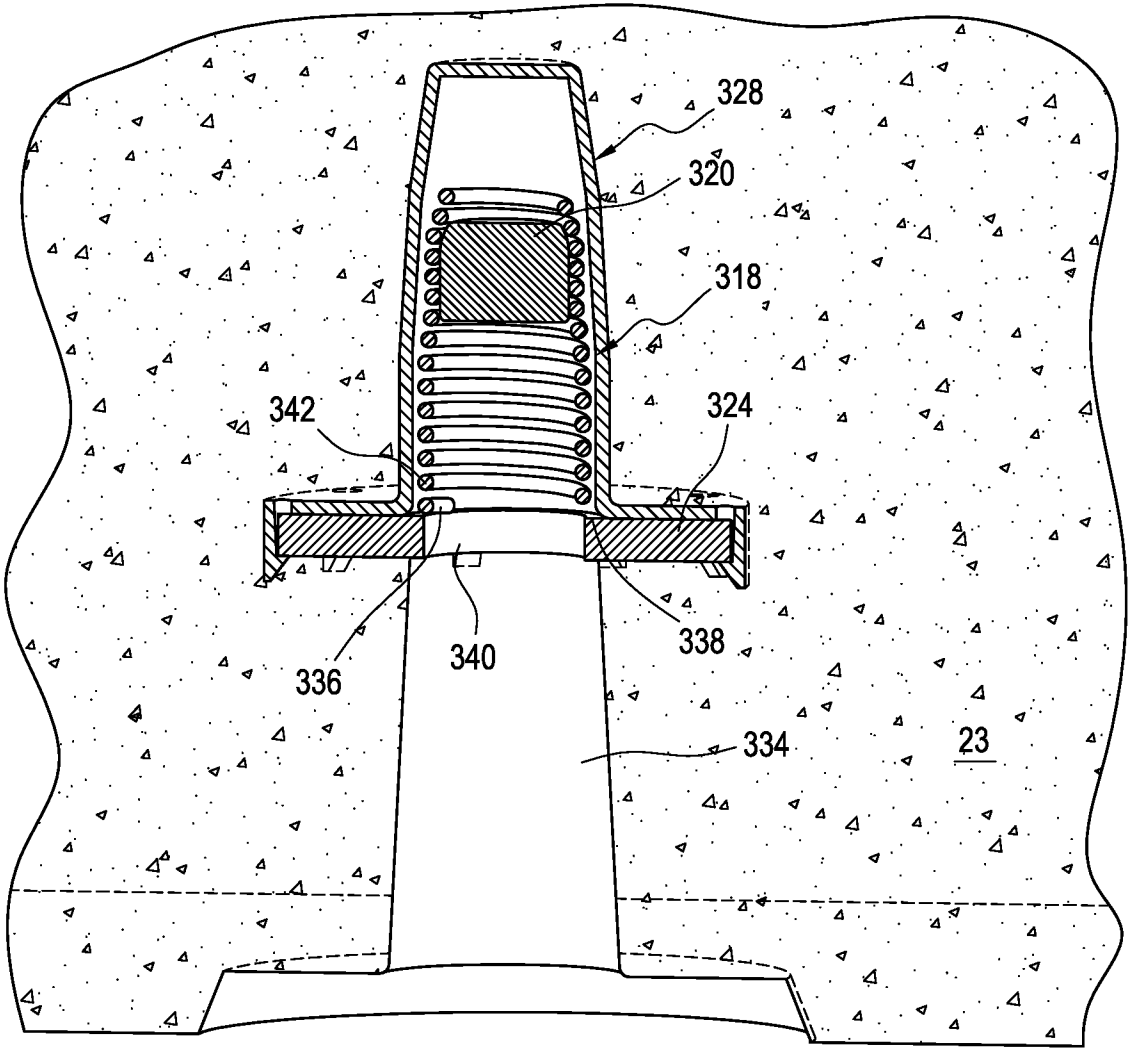
FIG. 62 is perspective cross-sectional view of FIG. 61, showing the plug removed from the concrete.

FIG. 62 shows the void 334 in the concrete 23 after the plug is removed after the concrete has cured. The cap, spring, expansion plug and the washer remain behind. The bottom coil 336 is supported by the top surface 338 of the washer since the diameter of the opening 340 of the washer is smaller than the outer diameter of the lower portion 342 of the spring 318.

Figure 63:
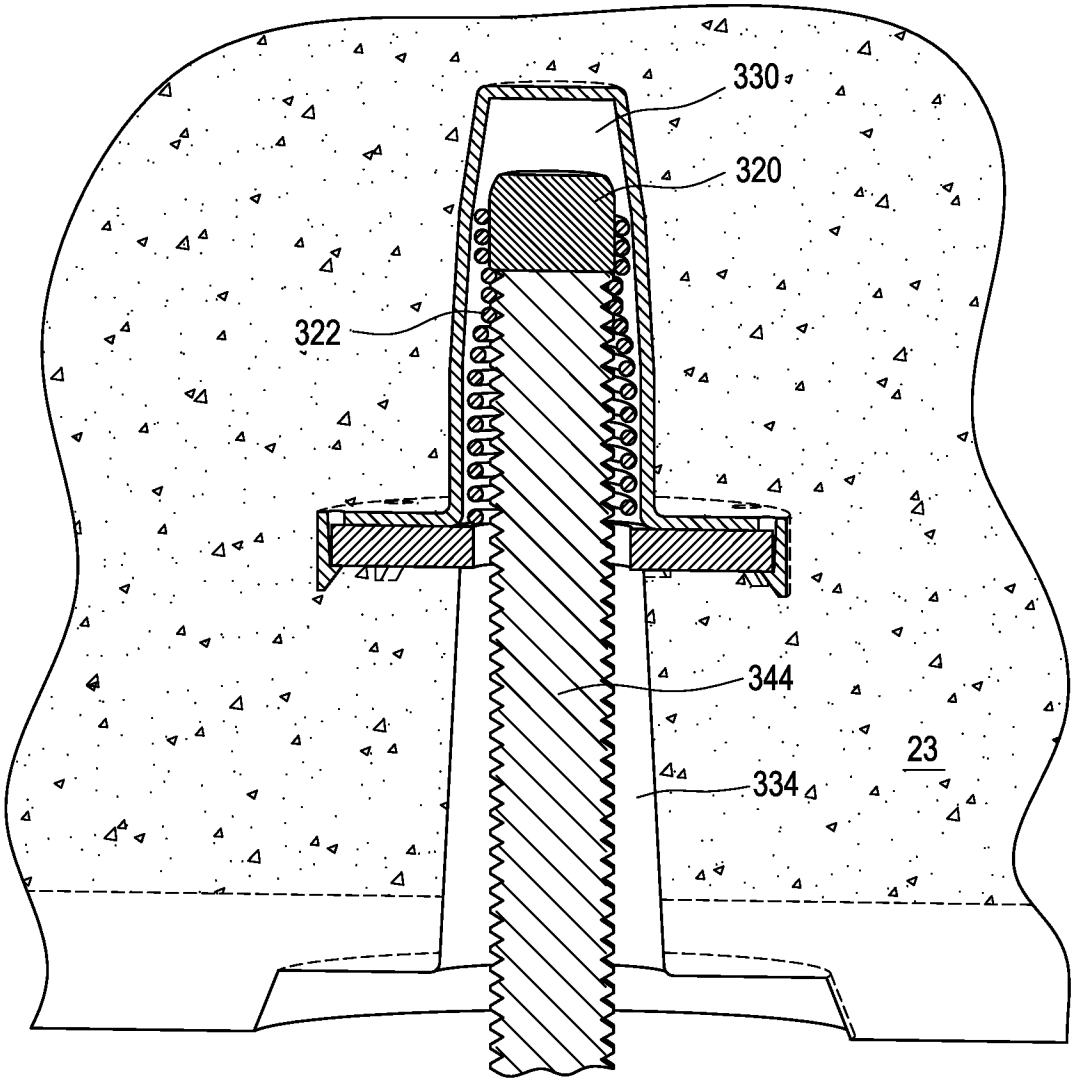
FIG. 63 is a perspective cross-sectional view of FIG. 62, showing a threaded rod pushing the plug out of the spring.

FIG. 63 shows the threaded rod 344 inserted through the void 334 in the concrete 23 and pushing the expansion plug 320 into the cavity 330, allowing the smaller diameter portion 322 to contract around and grab the threaded rod. The threaded rod 344 does not have to be turned for attachment to the spring. Simply pushing the expansion plug into the cavity 330 will allow the expanded spring portion that was expanded by the expansion plug to contract once the expansion plug is pushed out and attaches to the threaded rod without rotating the threaded rod to engage the threads of the threaded rod with the portion 322.

Figure 64:
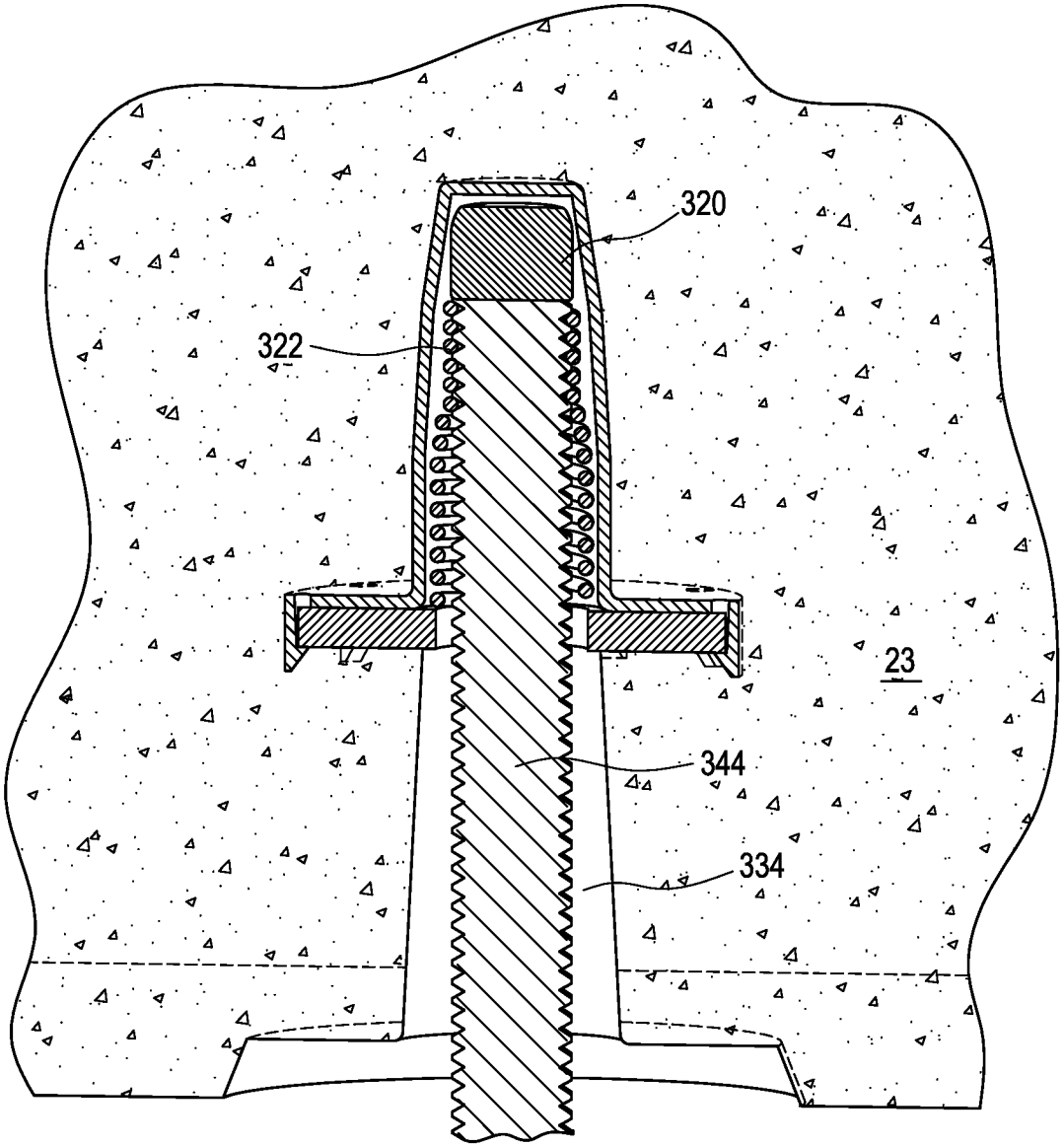
FIG. 64 is a perspective cross-sectional view of FIG. 63, showing the plug outside the spring and the threaded rod attached to the spring.

FIG. 64 shows the expansion plug 320 completely displaced from the spring portion 322, thereby allowing the spring portion 322 to grab the threaded rod.

Figure 65:
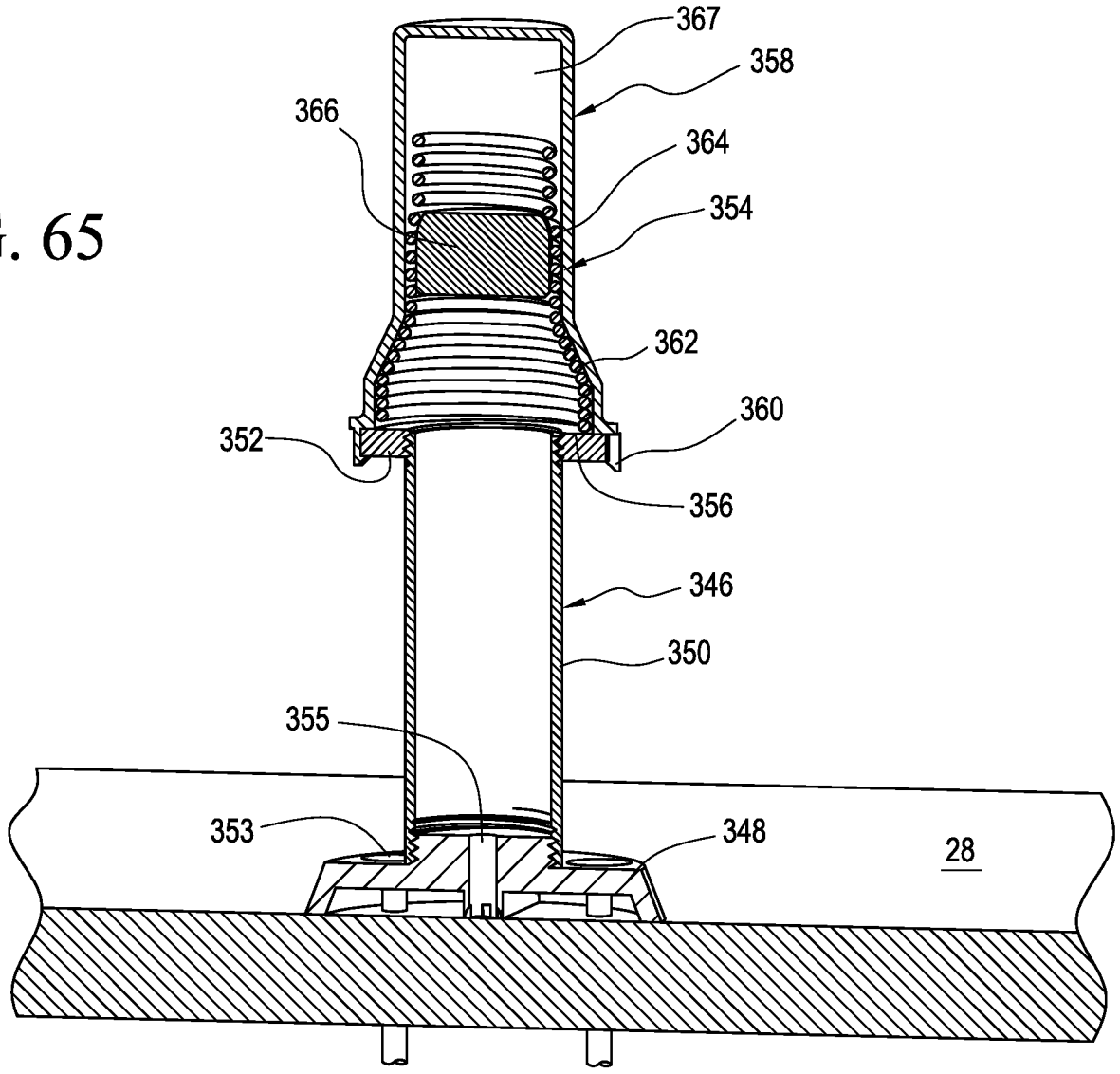
FIG. 65 is a perspective cross-sectional view of a plug with a hollow tube attached to a base, a metal washer, a push plug, a spring with multiple diameters and a cap.

FIG. 65 shows an anchor support 346 including a base 348 threaded to an extension tube 350 at a bottom end and a washer 352 at another end. The base is attached to the form board 28 by screws or nails 353. A central opening 355 may also be used with a nail or screw to attach the base to the form board. The extension tube 350 is advantageously detachable from the base 348 to gain access to the opening 355. A spring 354 is supported by the top surface 356 of the washer. A cap 358 encloses and seals the spring and the washer from the concrete. Resilient fingers 360 lock the cap 358 to the washer. The spring has a dead portion 362 engaging an inner surface of the cap and is shaped to prevent vertical and horizontal movement within the cap. A live portion 364 of the spring is expanded by an expansion plug 366. A cavity 367 at the top of the cap is provided to receive the expansion plug after being pushed up by a fastener. The cap 358 advantageously centers the spring 354 and holds it against the washer 352.

Figure 66:
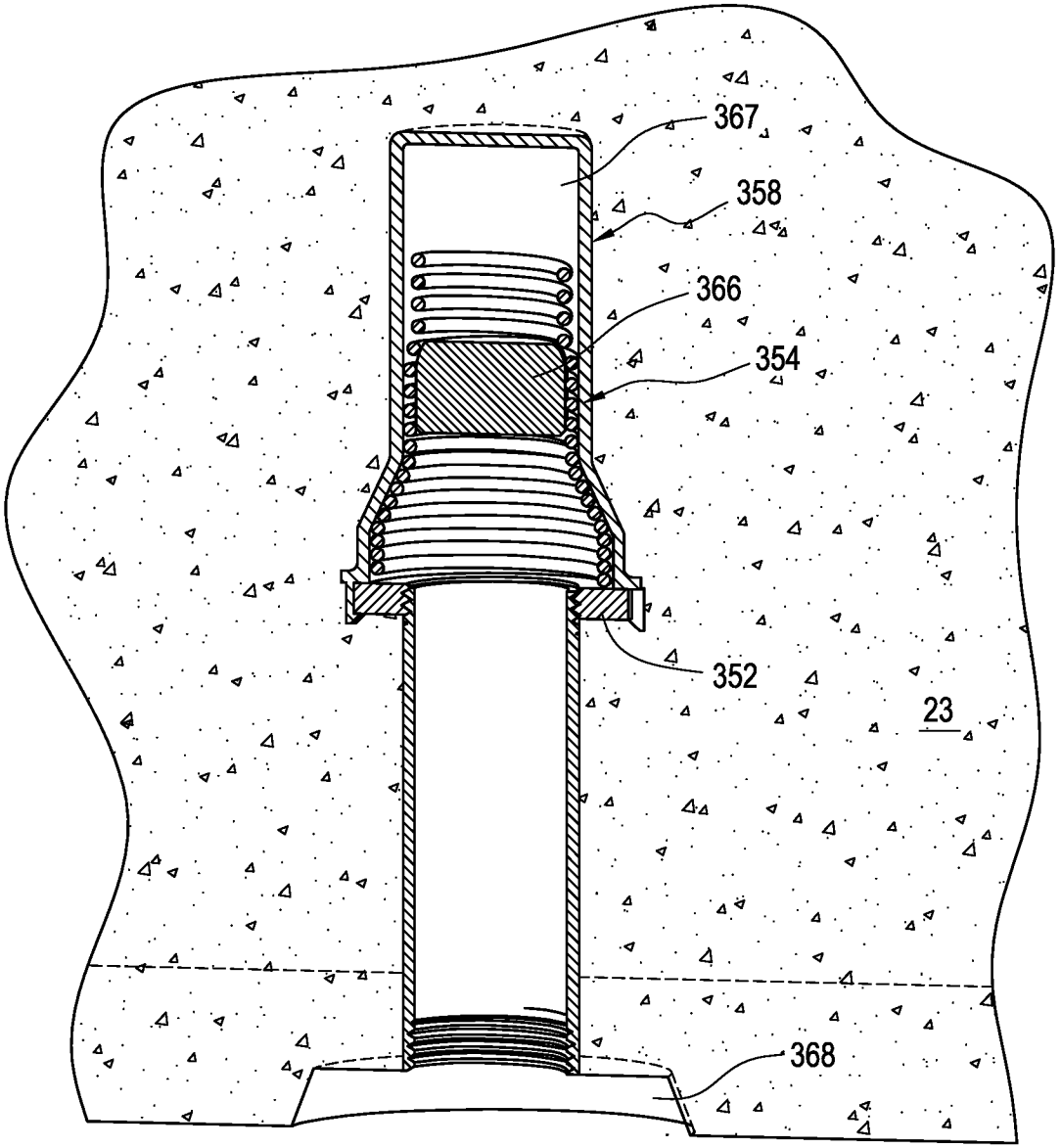
FIG. 66 is a perspective cross-sectional view of FIG. 65, showing the base removed from the concrete.

FIG. 66 shows a void 368 in the concrete 23 after the base 348 is removed after the concrete has cured. The extension tube 350 remains in the concrete 23 to provide access for a fastener to attach to the spring 354.

Figure 67:
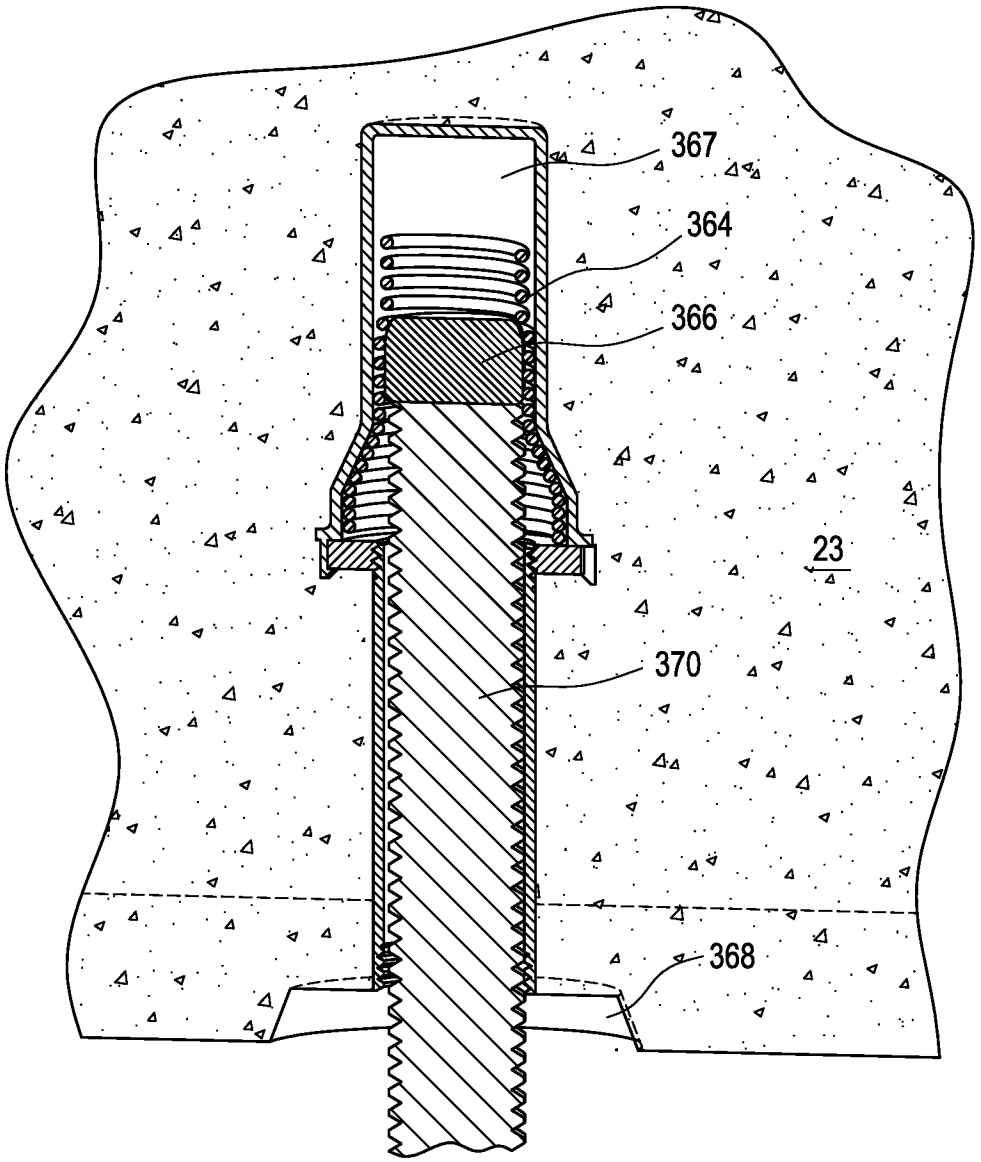
FIG. 67 is a perspective cross-sectional view of FIG. 66, showing a threaded rod pushing the plug out of the spring.

FIG. 67 shows a fastener 370 pushing the expansion plug 366 through the live portion 364 of the spring and into the cavity 367.

Figure 68:
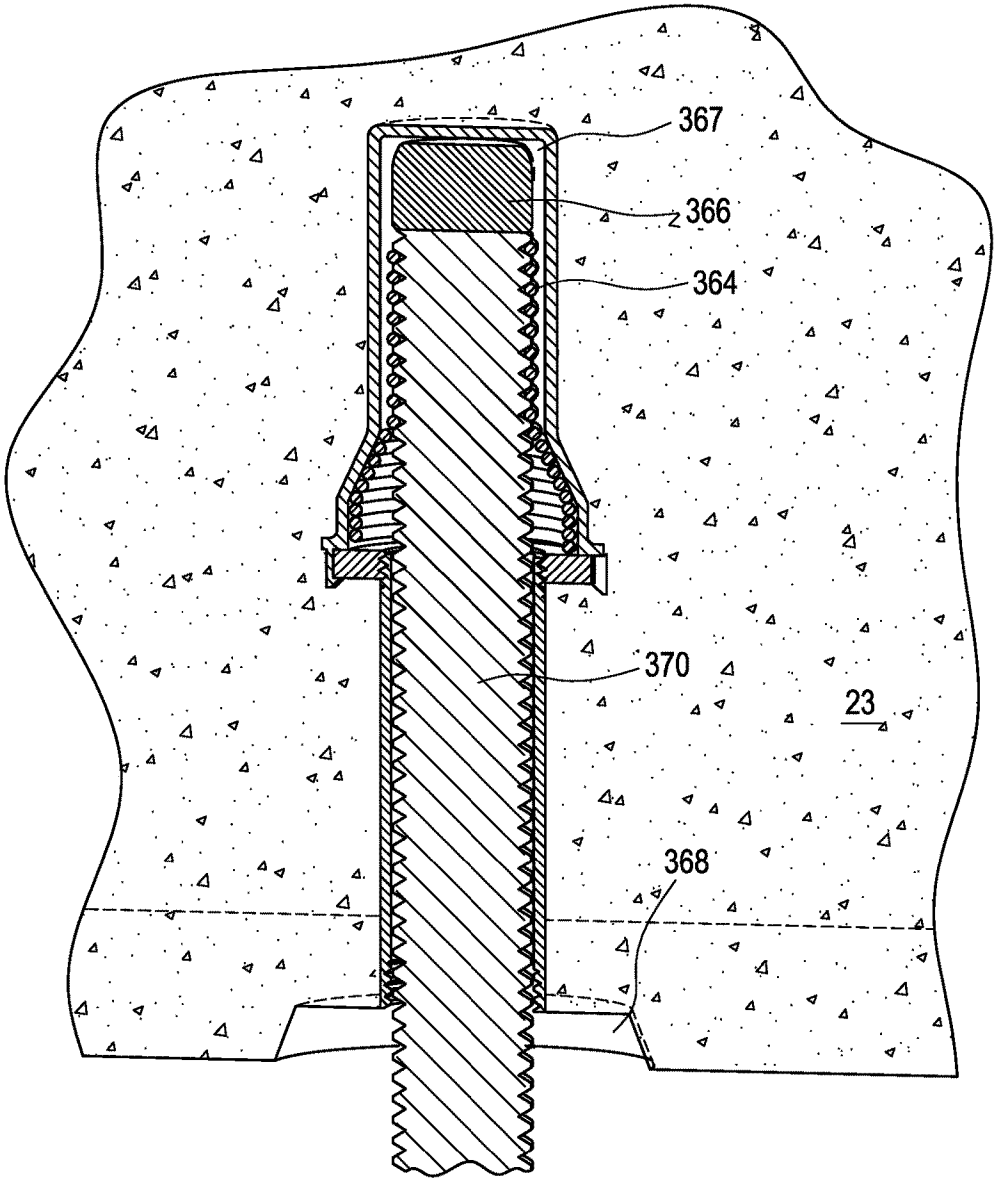
FIG. 68 is a perspective cross-sectional view of FIG. 67, showing the plug out of the spring and the threaded rod attached to a smaller diameter portion of the spring.

FIG. 68 shows the expansion plug 366 completely out of the live portion 364 of the spring and occupying the cavity 367.

Figure 69:
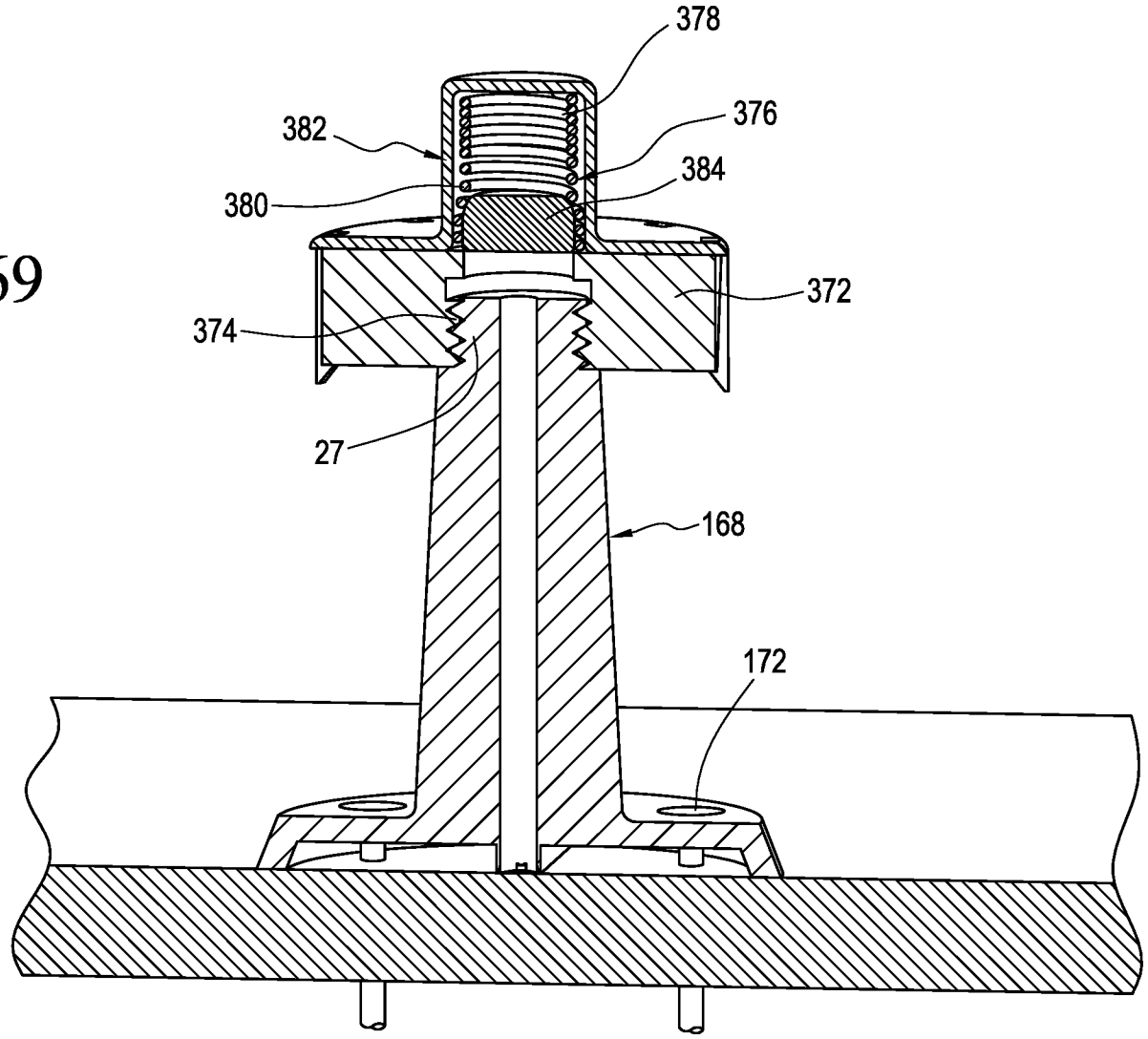
FIG. 69 is a perspective cross-sectional view of plug attached to a metal washer, a push plug, a spring and a cap.

FIG. 69 shows the plug 168 with the threaded portion 27 attached to a metal washer 372, which has a partly threaded opening 374. The threaded portion 27 does not extend through the thickness of the washer. A spring 376 with an upper dead portion 378 and a lower live portion 380 is disposed inside a cap 382 that seals the washer and the spring from the concrete. An expansion plug 384 expands the live portion 380 to a larger diameter.

Figure 70:
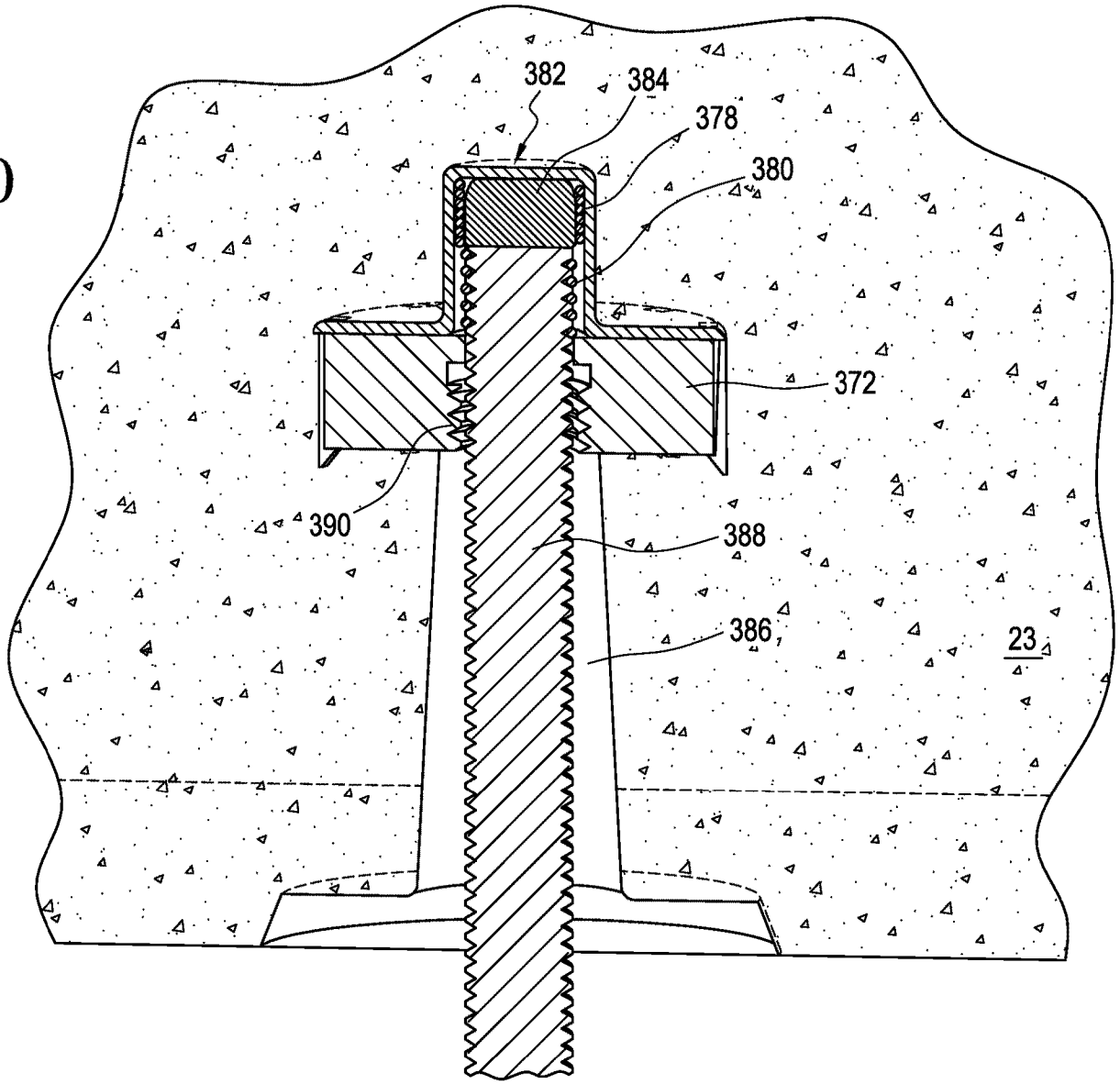
FIG. 70 is a perspective cross-sectional view of FIG. 69, showing the plug removed from the concrete and a threaded rod attached to the spring after pushing the plug to an upper portion of the spring.

FIG. 70 shows the void 386 in the concrete after the plug is removed after the concrete has cured. A fastener 388 has pushed the expansion plug into the dead portion of the spring, allowing the live portion 380 to revert to its original diameter and grab the fastener. The threads 390 in the opening 374 may also be used to attach a larger diameter fastener.

Figure 71C:
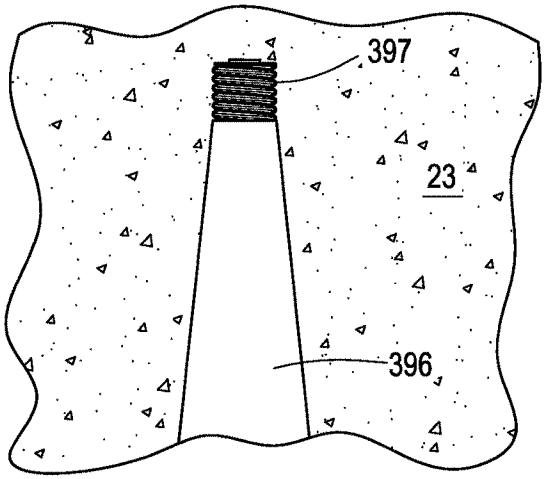
FIG. 71C is a cross-sectional view of FIGS. 71B, showing the plug removed from the concrete.
Figure 71D:
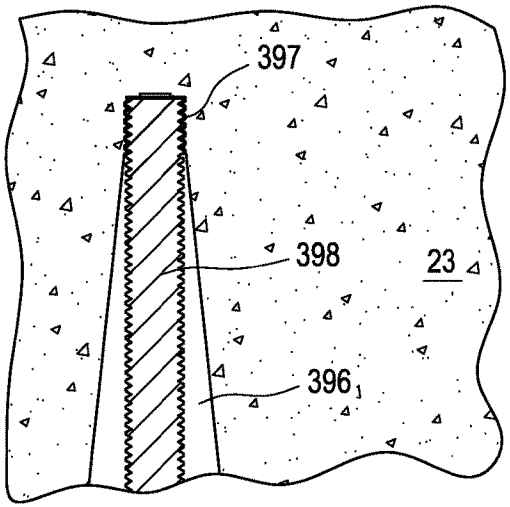
FIG. 71D is a cross-sectional view of FIG. 71C, showing a threaded rod attached to the threads formed in the concrete by the plug.
Figure 71B:
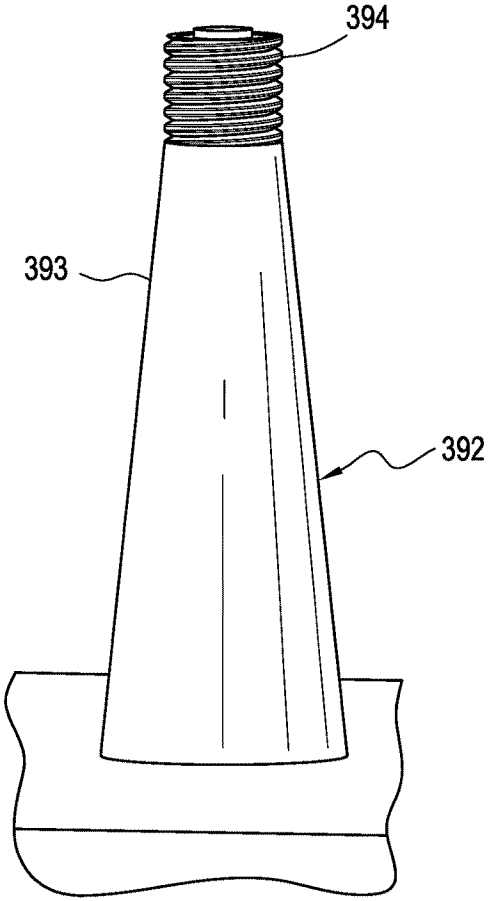
FIGS. 71A and 71B are perspective views of a plug without a base flange portion.
Figure 71A:
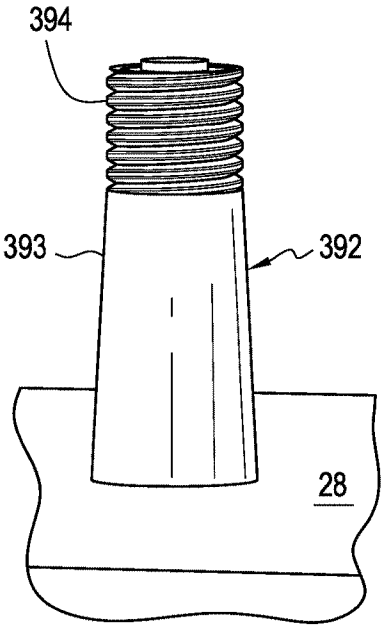

FIG. 71A shows a plug 392 without a base portion. The plug 392 has a main body portion 393, preferably columnar in shape. A nail or screw attaches the plug to the form board 28. The plug is conical with a threaded end portion 394 for forming threads in the concrete.

FIG. 71B shows a taller plug 392 with a wider bottom end for stability.

FIG. 71C shows the void 396 in the concrete 23 after the plug is removed after the concrete has cured. Threads 397 are formed in the concrete by the threaded end portion 394.

FIG. 71D shows a fastener 398 screwed to the concrete threads 397.

Figure 72:
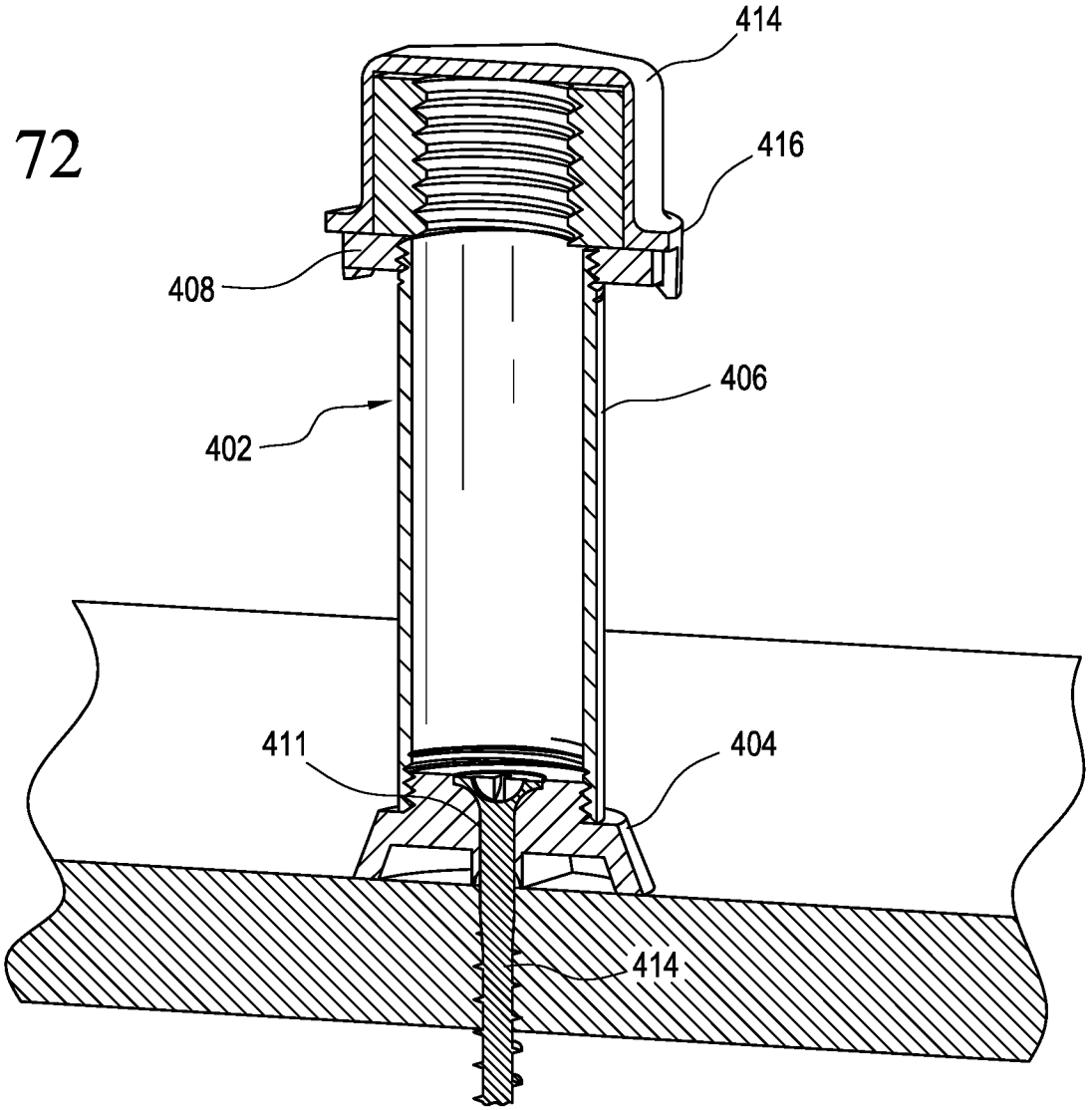
FIG. 72 is a perspective cross-sectional view of a plug with an extension tube threaded to a base, a washer, a nut and a cap.

FIG. 72 shows an anchor support 402 including a base 404 threaded to an extension tube 406 at a bottom end and a washer 408 at another end. The base is attached to the form board 28 with a single screw 410 or nail through an opening 411 in the center of the base. The tube 406 is removably attached to the base 404 to gain access to the opening 411 to attach the base to the form board. A nut 412 is supported by the washer. A cap 414 encloses and seals the nut from the concrete. Resilient fingers 416 lock the cap to the washer. The washer may be integrated with the expansion tube 406 instead of being a separate unit threaded to the expansion tube.

Figure 73:
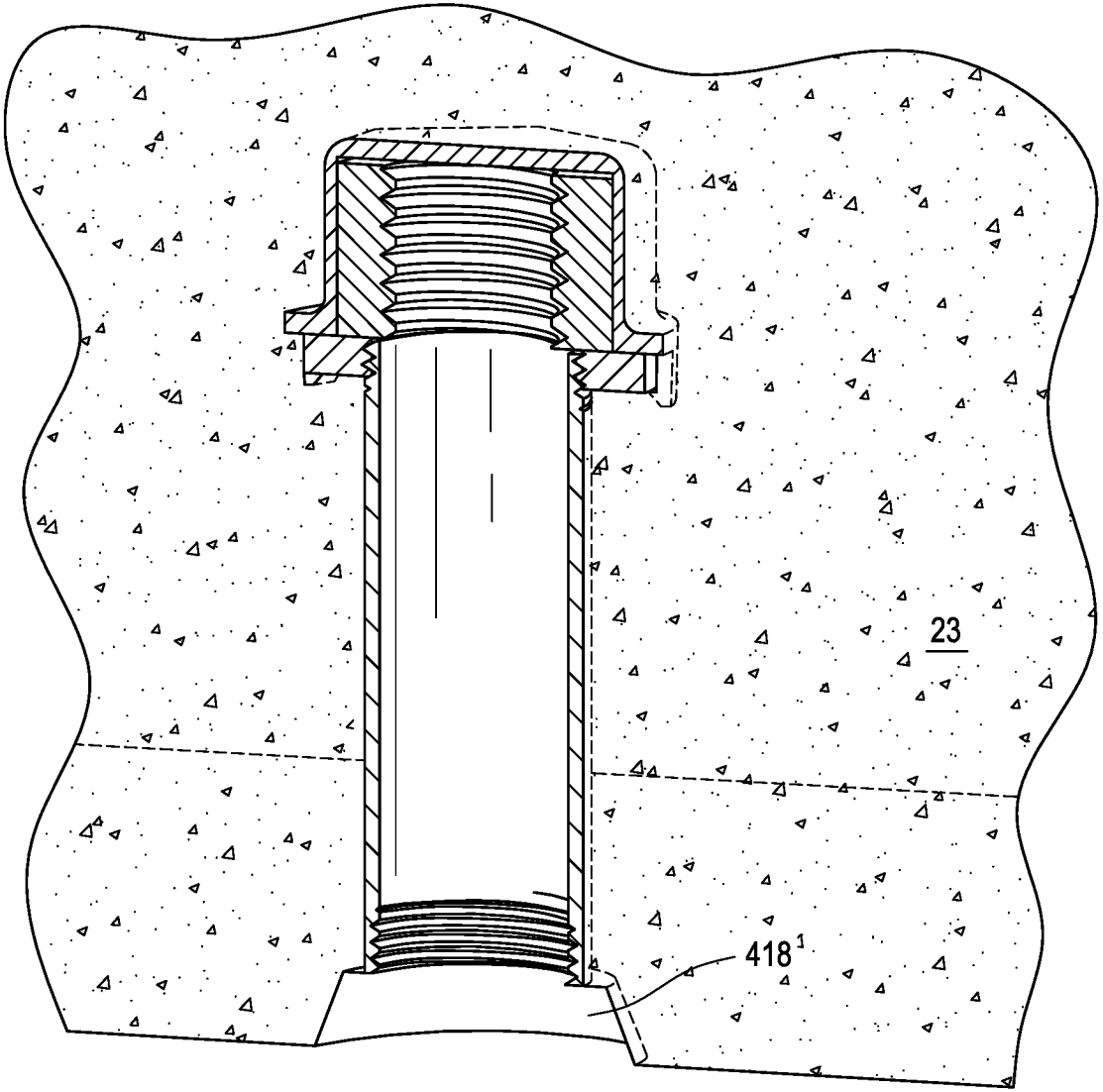
FIG. 73 is a cross-sectional view of FIG. 72, showing the base removed from the concrete.

FIG. 73 shows the void 418 in the concrete 23 after the base 404 is unscrewed from the extension tube 406.

Figure 74:
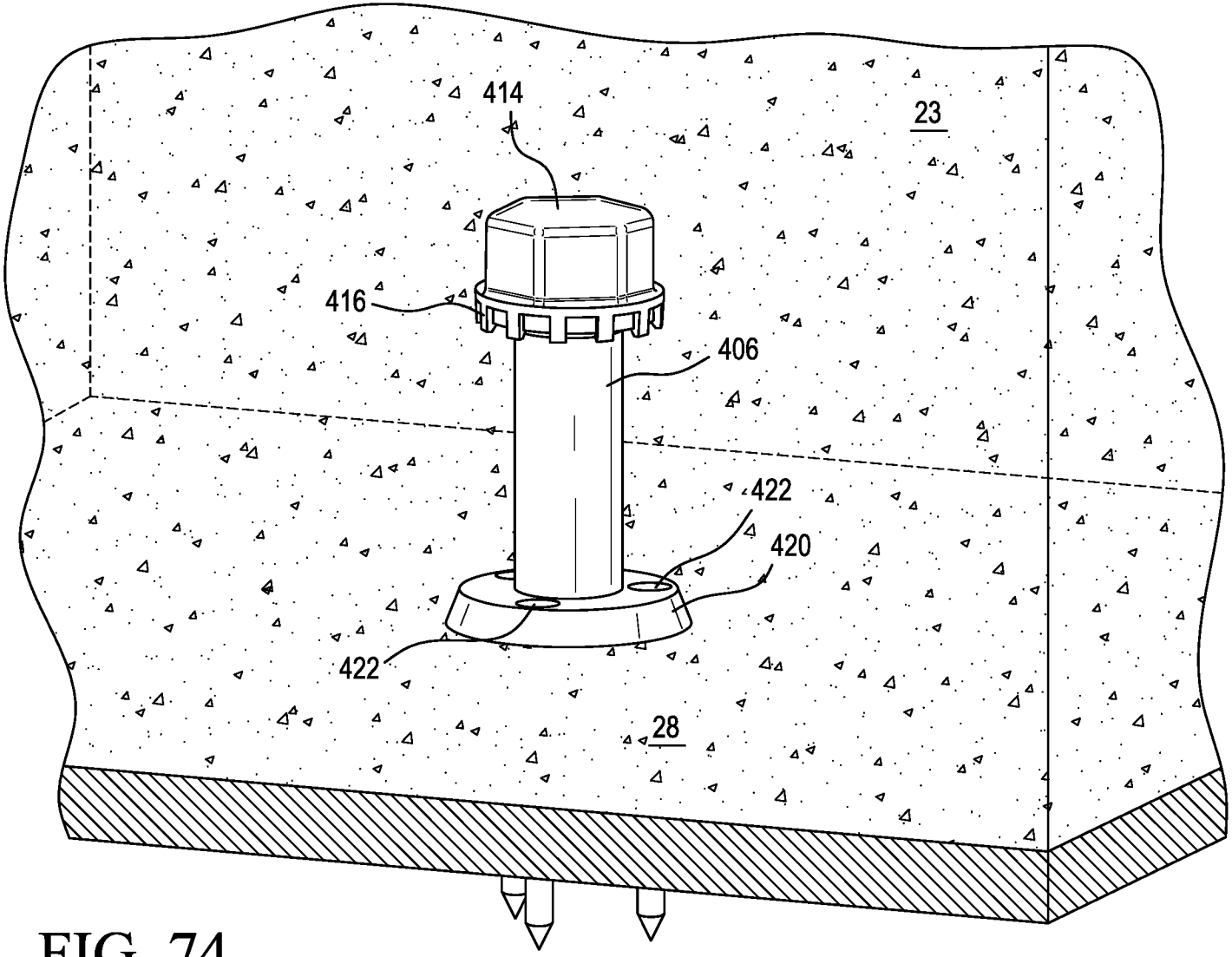
FIG. 74 is a perspective view of FIG. 72, showing a different way of attachment of the base to the form board.

FIG. 74 shows a base 420 attached to the form board 28 with screws or nails 422 through openings along the peripheral edge of the base. The base 420 is attached to the extension tube 406 in the same manner as the base 404.

Figure 75B:
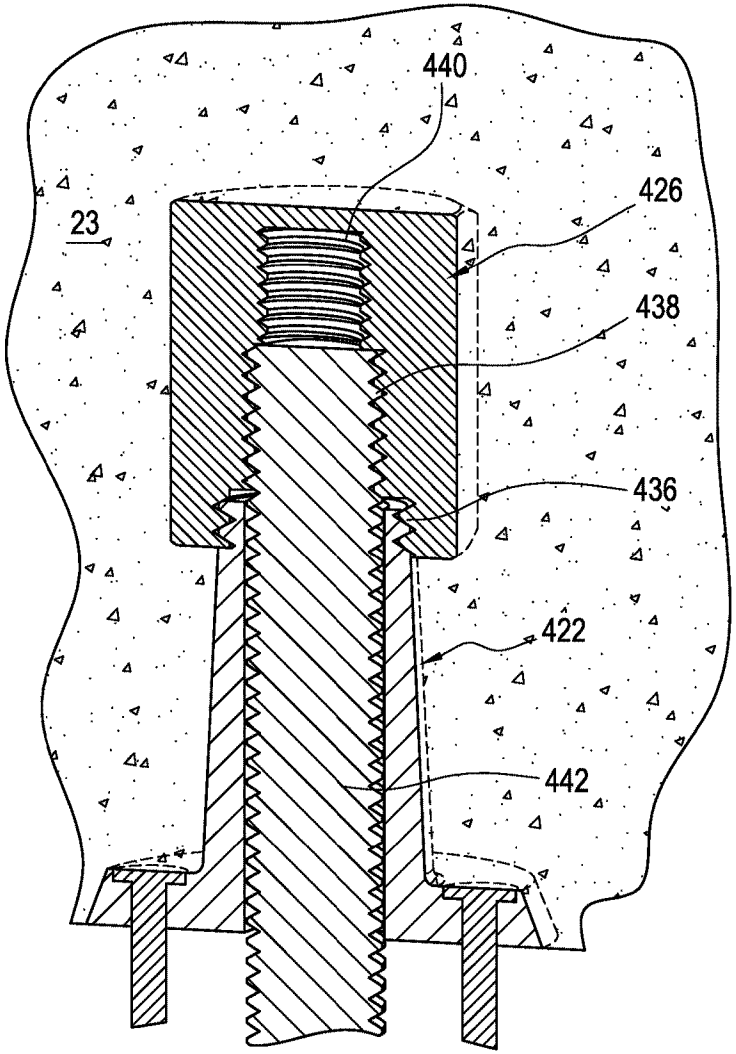
FIG. 75B is perspective cross-sectional view of FIG. 75A, showing a threaded rod extending through the central opening and attached to the anchor body's larger diameter threaded bore.
Figure 75A:
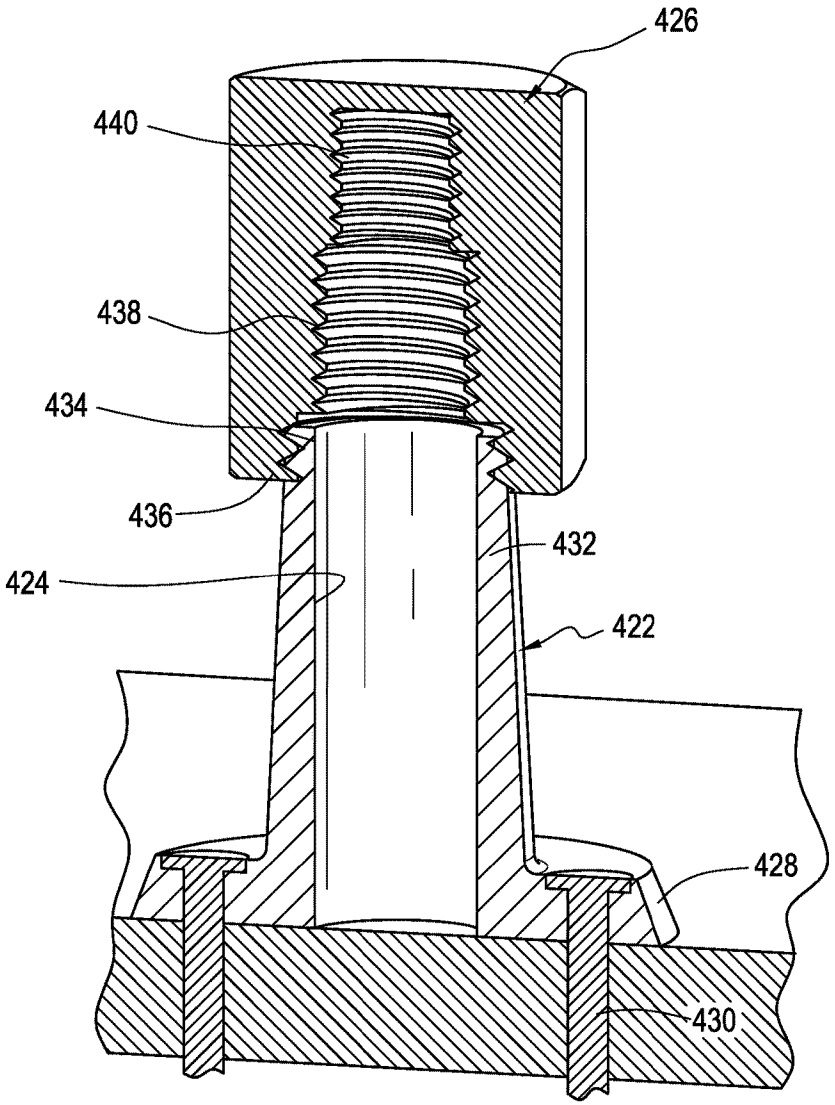
FIG. 75A is a perspective cross-sectional view of a plug attached to an anchor body with multiple diameter threaded bores, the plug including a large central opening configured for a threaded rod to extend therethrough.

FIG. 75A shows a plug 422 with a large diameter central opening 424 sufficient to accommodate the size of a fastener for attachment to the anchor body 426 after the concrete has cured. The plug has a base portion 428 attached to the form board 28 with screws or nails 430. The plug has a main body 432 that is conical in shape. A threaded portion 434 holds the anchor body 426. The anchor body includes multiple diameter threaded bores 436, 438 and 440 for holding a fastener.

FIG. 75B shows a fastener 442 attached to the anchor body 426. The plug 422 does not have to be removed after the concrete 23 has cured since the opening 424 is large enough to allow the fastener 442 to reach the anchor body 426. The plug 422 may be removed to gain access to the threaded bore 436, to which the plug is attached.

Figure 76B:
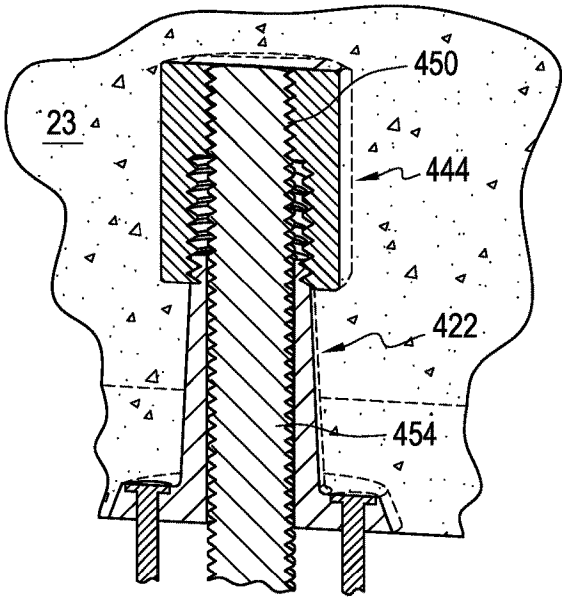
FIG. 76B is a perspective cross-sectional view of FIG. 76A, showing the plug embedded in concrete with a threaded rod attached to the smaller diameter threaded bore of the anchor body.
Figure 76C:
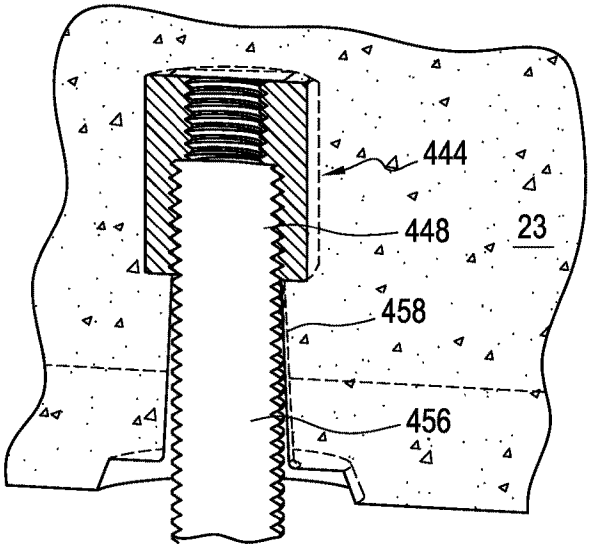
FIG. 76C is perspective a cross-sectional view of FIG. 76A, showing the plug embedded in concrete with a threaded rod attached to the larger diameter threaded bore of the anchor body.
Figure 76A:
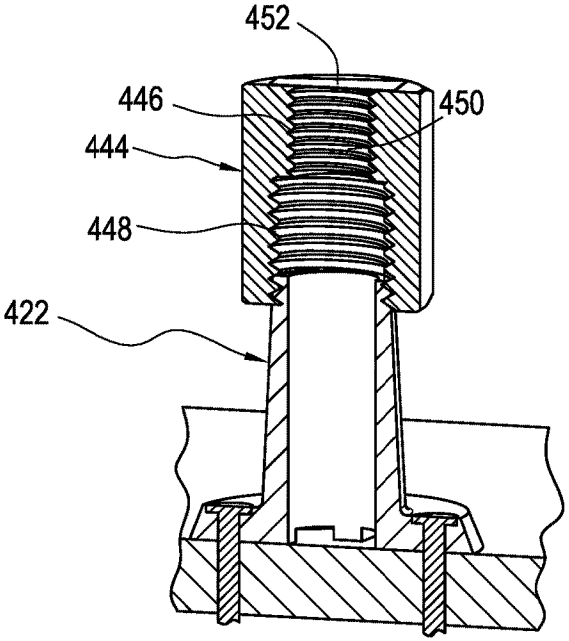
FIG. 76A is a perspective cross-sectional view of the plug of FIG. 75A shown attached to an anchor body with multiple diameter threaded bores, the anchor body having an open top sealed with an adhesive strip.

FIG. 76A shows the plug 422 attached to an anchor body 444 with a through opening 446 with multiple diameter threaded bores 448 and 450. A tape, sticker or other adhesive strip 452 is used to seal the top opening from the concrete.

FIG. 76B shows a fastener 454 attached to the smaller diameter bore 450. The plug 422 may remain in the concrete 23.

FIG. 76C shows a larger diameter fastener 456 attached to the larger diameter bore 448. The plug 422 has been removed, creating a void 458 in the concrete 23 of sufficient diameter to accommodate the larger diameter fastener 456.

Figure 77B:
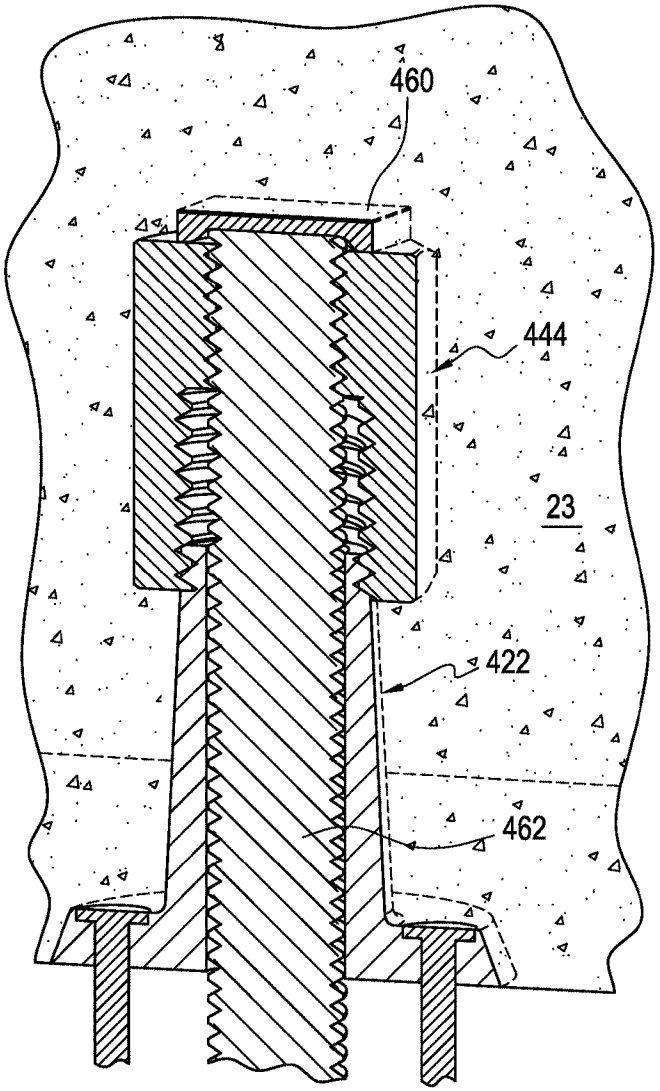
FIG. 77B is a perspective cross-sectional view of FIG. 77A, showing a threaded rod compressing the adhesive foam into the concrete as the threaded rod extends past the top surface of the anchor body at least one thread pitch.
Figure 77A:
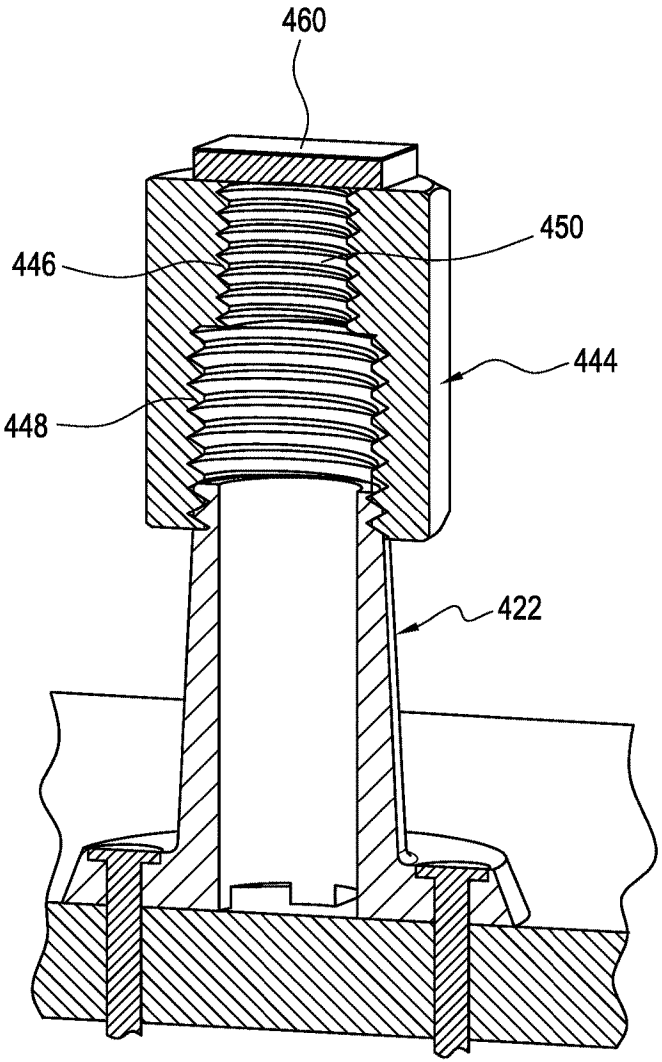
FIG. 77A is a perspective cross-sectional view of the plug of FIG. 76A shown attached to an anchor body with multiple diameter threaded bores, the anchor body having an open top sealed with compressible adhesive foam with a thickness of at least one thread pitch.

FIG. 77A shows the plug 422 with the anchor body 444 provided with a compressible foam adhesive strip 460 to seal the opening 446 from the concrete.

FIG. 77B shows the anchor body 444 attached to a fastener 462. The end of the fastener compresses the foam strip 460 and allows the end of the fastener to extend past the anchor body 444 to ensure complete engagement of the threads. The plug 422 may remain in the concrete 23. The foam adhesive has sufficient thickness of at least one thread pitch to allow the end of the fastener 462 to compress the foam adhesive into the concrete as the fastener extends past the top of the anchor body at least one thread pitch.

Figure 78C:
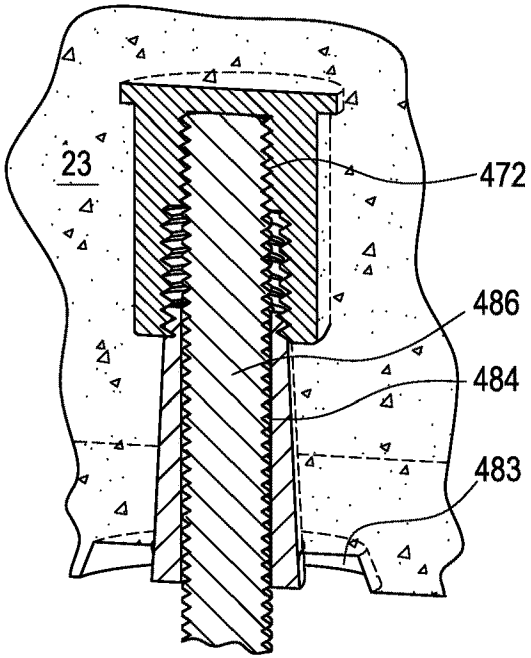
FIG. 78C is a perspective cross-sectional view of FIG. 78B, showing a threaded rod attached to a smaller diameter threaded bore of the anchor body.
Figure 78B:
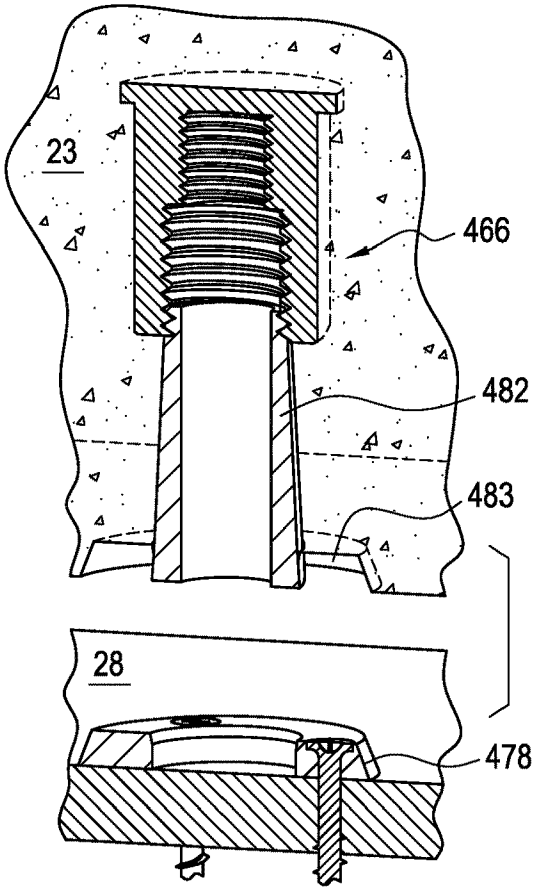
FIG. 78B is a perspective cross-sectional view of FIG. 78A, showing the base portion broken off from the main body portion of the plug and remaining attached to the form board when the form board is removed after the concrete has cured.
Figure 78A:
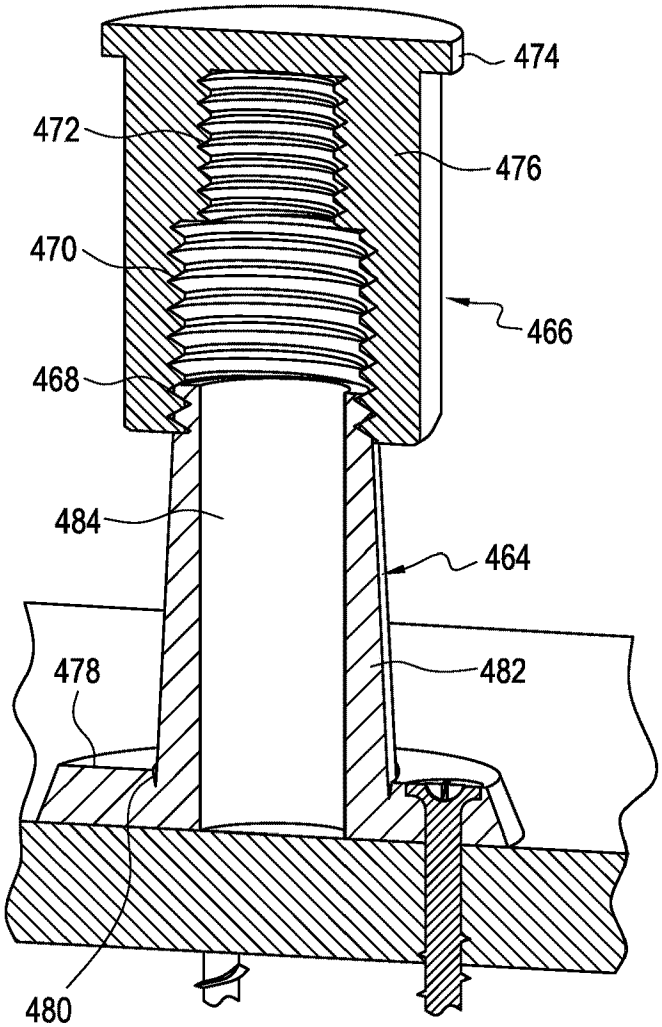
FIG. 78A is a perspective cross-sectional view of a plug attached to an anchor body with multiple diameter threaded bores, the plug including a large central opening configured for a threaded rod to extend therethrough and a base portion with a weakened section to allow the base portion to break off from the main body portion of the plug.

FIG. 78A shows the plug 464 attached to an anchor body 466, which has multiple diameter bores 468, 470 and 472. A flange portion 474 extends radially outwardly from the main body portion 476 to provide an additional bearing area in the concrete. The base portion 478 has a circumferential slit 480 or weakened section at the bottom of the main body portion 482 to allow the base portion to break away from the main body portion when the form board 28 is removed after the concrete has cured. The plug 482 is attached to the form board 28 with screws. The main body portion has a central opening 484 large enough in diameter to allow a fastener access to the threaded bores 470 and 472.

FIG. 78B shows the base portion 478 broken off from the main body portion 482, leaving behind a void 483 in the concrete 23. The base portion 478 is shown still attached to the form board 28 when the form board is removed after the concrete has cured, leaving the main body portion 472 in the concrete 23.

FIG. 78C shows a fastener 486 attached to the threaded bore 472. Access is provide through the opening 484 in the main body portion 482, which may also be removed from the concrete 23 to gain access to the threaded bore 468.

Figure 79B:
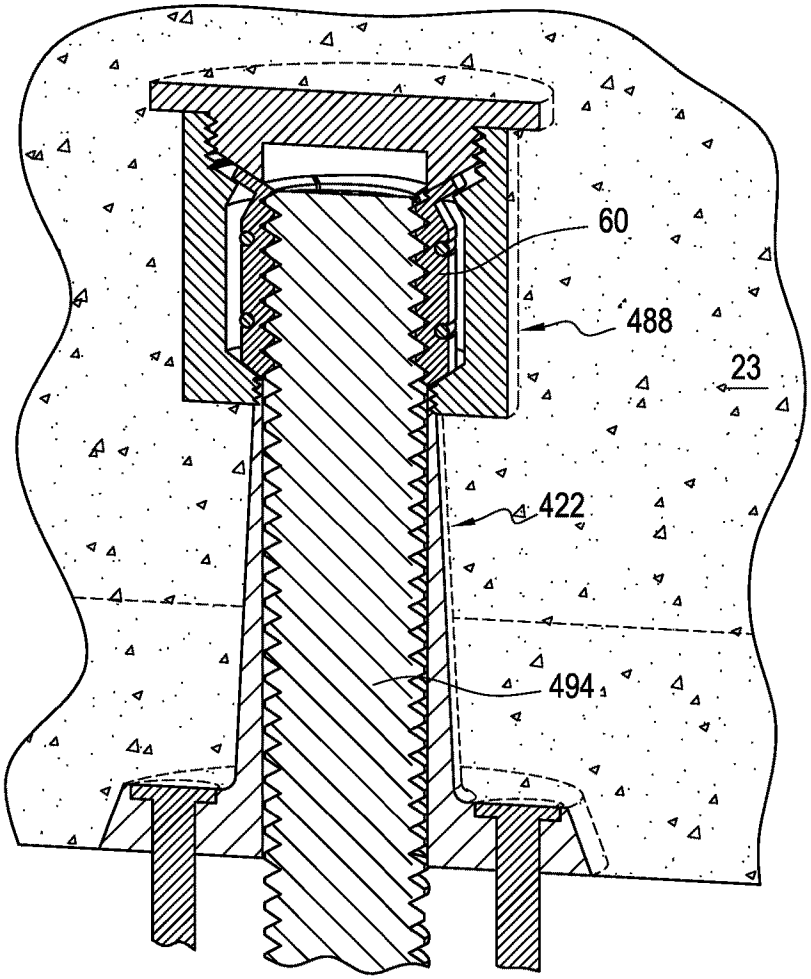
FIG. 79B is a perspective cross-sectional view of plug of FIG. 79A embedded in concrete, showing a threaded rod attached to the split nut.
Figure 79A:
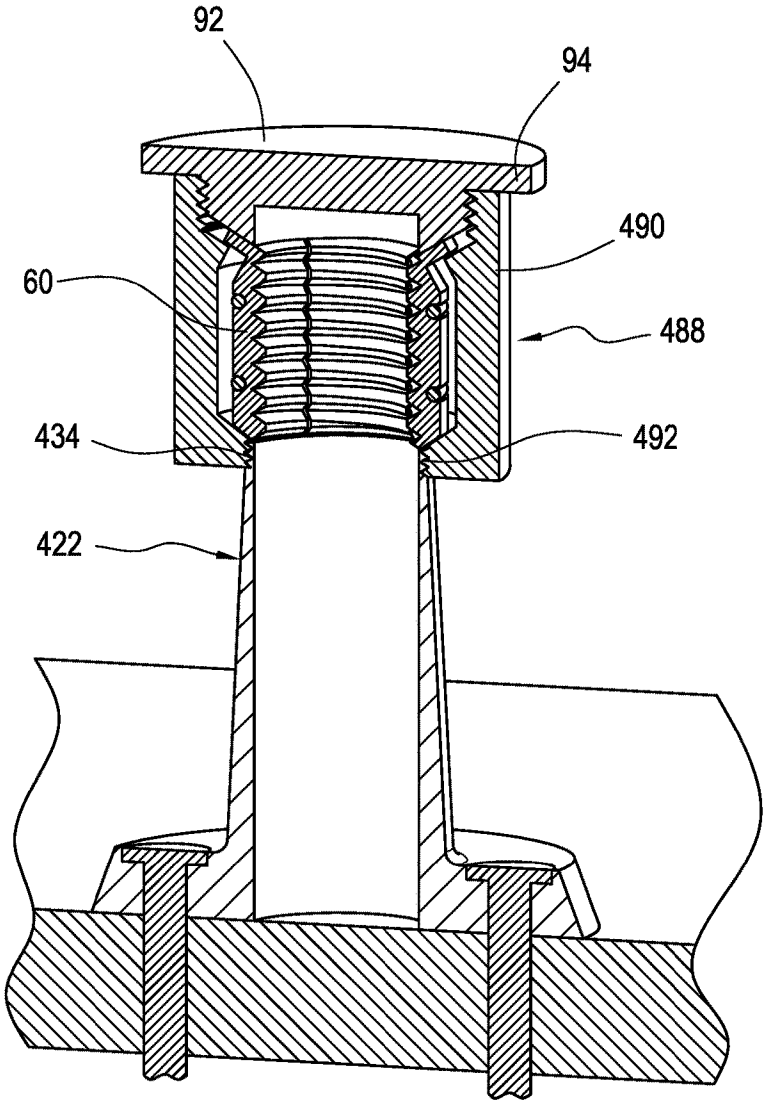
FIG. 79A is a perspective cross-sectional view of the plug of FIG. 75A attached to a split nut.

FIG. 79A shows the plug 422 attached to a split nut 488 at the threaded portion 434. The housing 490 has a threaded opening 492 that screws to the threaded portion 434. The split nut 488 operates in the same way as the split nut 90 shown in FIG. 14B. The cap 92 has shoulder 94 extending radially outwardly to provide additional bearing area positioned deeper into the concrete.

FIG. 79B shows a fastener 494 attached to the split nut sections 60. The plug 422 may remain in the concrete 23.

Figure 80B:
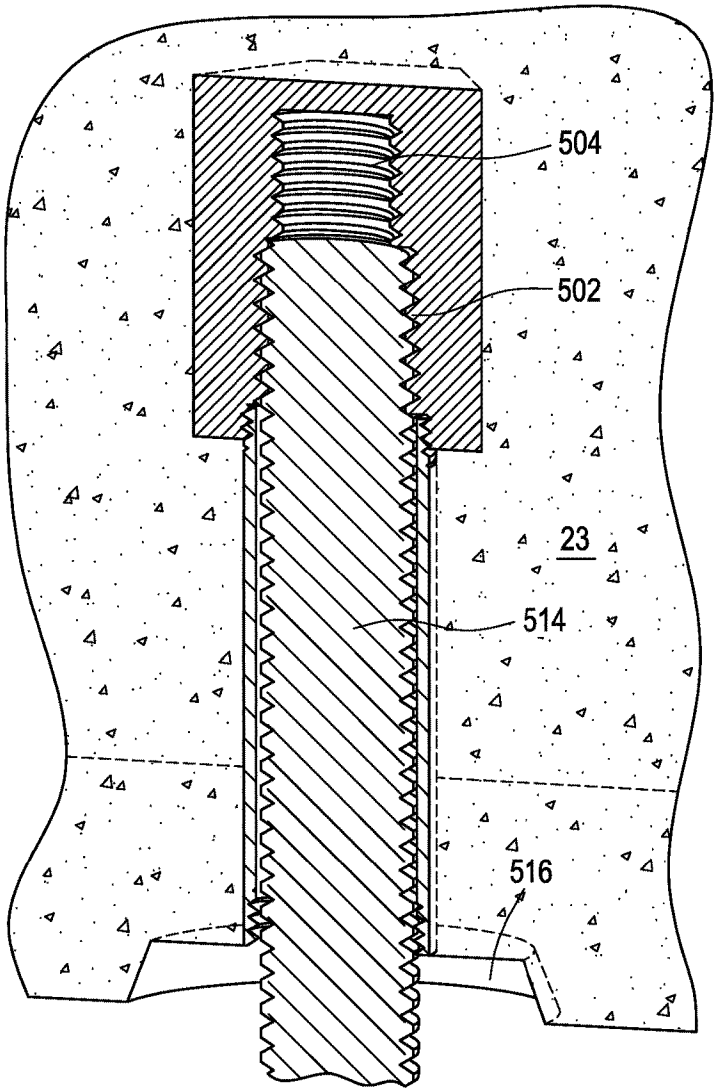
FIG. 80B is a perspective cross-sectional view of the plug of FIG. 80A embedded in concrete, showing the base removed and a threaded rod extending through the extension tube and attached to the larger diameter threaded bore of the anchor body.
Figure 80A:
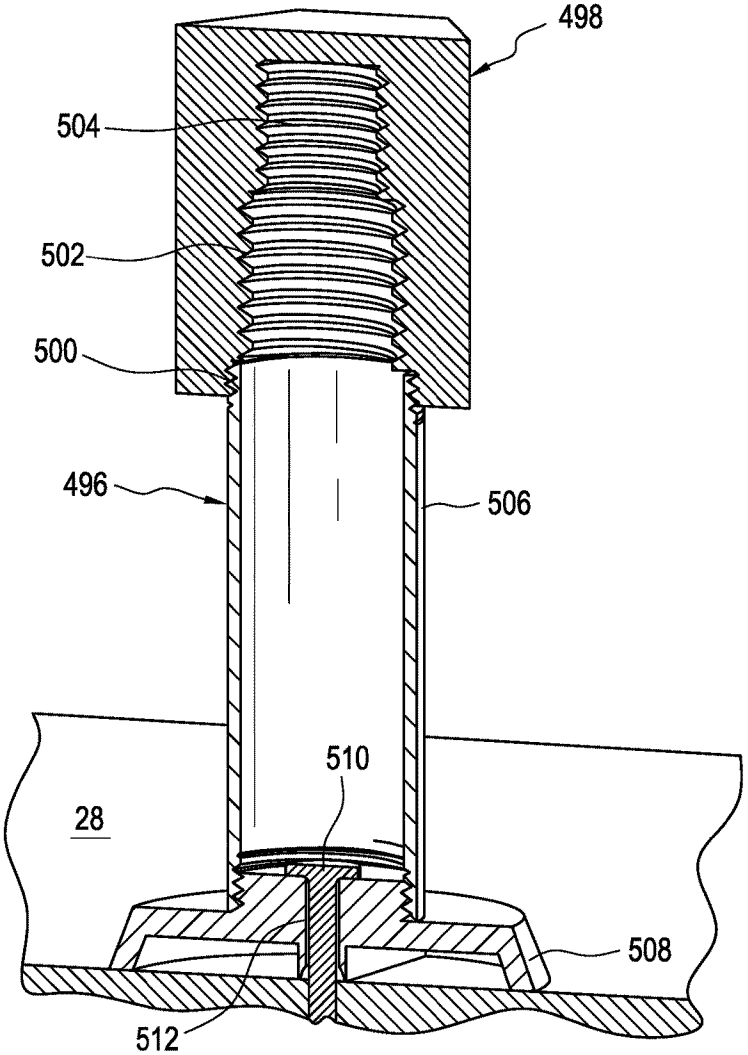
FIG. 80A is a perspective cross-sectional view of a plug with an extension tube threaded to a base and an anchor body with multiple different diameters threaded bores.

FIG. 80A shows the plug 496 attached to an anchor body 498 at the threaded portion 500. The anchor body includes a plurality of threaded bores 502 and 504 with different diameters. An extension tube 506 is threaded to the base 506, which is attached to the form board 28 by a nail 510 through a central opening 512 in the base.

FIG. 80B shows a fastener 514 attached to the larger diameter threaded bore 502. The base 508 has been removed, leaving a void 516 in the concrete 23 after the concrete has cured. The inner diameter of the extension tube 506 is large enough to accommodate the larger diameter threaded rod sized for the larger diameter threaded bore 502.

FIG. 81A shows a plug 518 attached to an anchor body 520. The plug is attached to the form board 28 with a screw 522 through a central opening 524. The anchor body has a cylindrical recess 526 with a circumferential groove 528. The upper portion of the plug 518 is cylindrical and is received within the recess 526. A circumferential groove 530 cooperates with the groove 528 to hold a compressible or elastic ring 532 to hold the anchor body 520 and the plug 518 together.

FIG. 81B shows the plug 518 separated from the anchor body 520 after the concrete 23 has cured, leaving a void 534 in the concrete. The plug 518 remains attached to the form board 28. The ring 532 is squeezed out of the groove 528 during the separation.

FIG. 81C shows a cylindrical nut 536 with a circumferential locking groove 538 holding a locking split ring 540. The cross-sectional shape of the groove 538 is such that when the nut 536 is pushed into the recess 526, the ring 540 retracts into the groove 538, allowing the nut 536 to enter the recess 526. When the groove 538 lines up with the groove 528, the ring 540 expands into the groove 528. When a downward force is applied through the fastener 542, the ring locks between the grooves 528 and 538. The operation of the grooves 528 and 538 with the ring 540 is fully disclosed in U.S. Pat. No. 6,161,350, herein incorporated by reference.

FIG. 81D shows the fastener 542 tight against the top wall 544 of the anchor body, forcing the nut 536 downwardly thereby to lock with the ring 540 between the grooves 528 and 538, removing any looseness between the nut and the anchor body. The downward force exerted by a load attached to the fastener (threaded rod) 542 will further contribute to the tightness of the connection between the nut and the anchor body.

FIG. 81E is an enlarged detail taken from FIG. 81D. Terms referring to "locking geometry" or "geometry" in FIGS. 81C, 81D, 82A-82E and 83A-83D refer to the locking interplay between the grooves 528 and 538 and the ring 540 when there is relative motion in one direction.

Figure 82B:
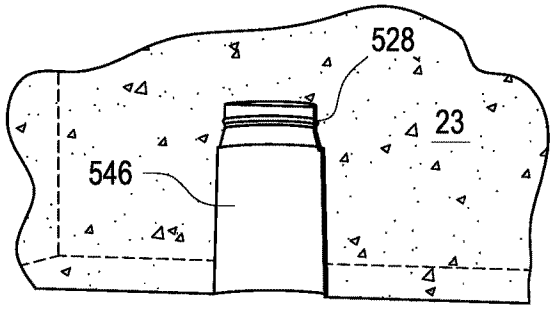
FIG. 82B is a perspective cross-sectional view of the plug of FIG. 82A removed from the concrete, leaving a mold of a groove in the concrete.
Figure 82B:
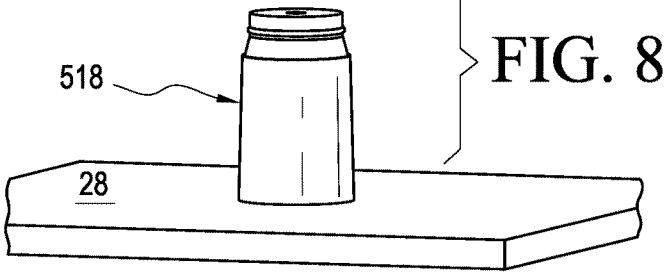
Figure 82E:
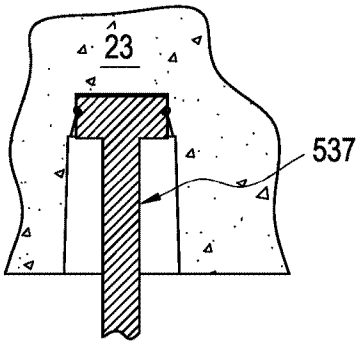
FIG. 82E is a cross-sectional view of a threaded rod with an integrated cylindrical head with a locking groove and ring attached to the groove in the concrete.
Figure 82D:
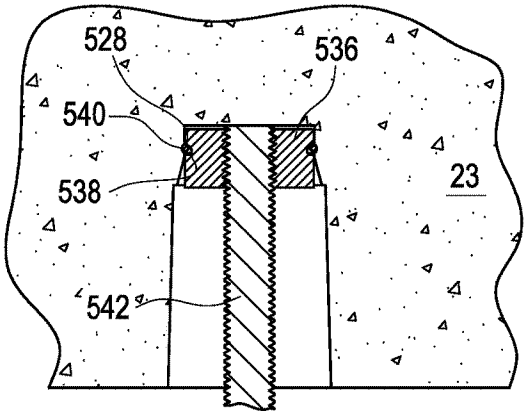
FIG. 82D is a cross-sectional view of the cylindrical nut attached to the groove in the concrete.
Figure 82A:
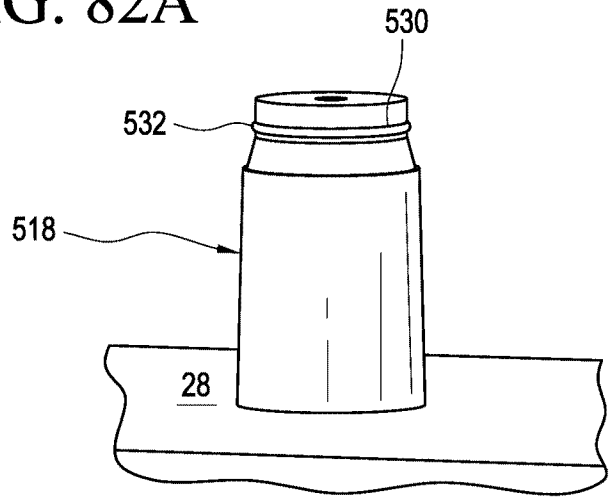
FIG. 82A is a perspective view of a plug with ring partly disposed in a groove to make a mold of a groove in the concrete.

FIG. 82A shows the plug 518 attached to the form board 28 with the screw 522 (shown in FIG. 81A).

FIG. 82B shows the void 546 in the concrete 23 after the plug is removed after the concrete has cured. The ring 532 creates the groove 528 in the concrete.

Figure 82C:
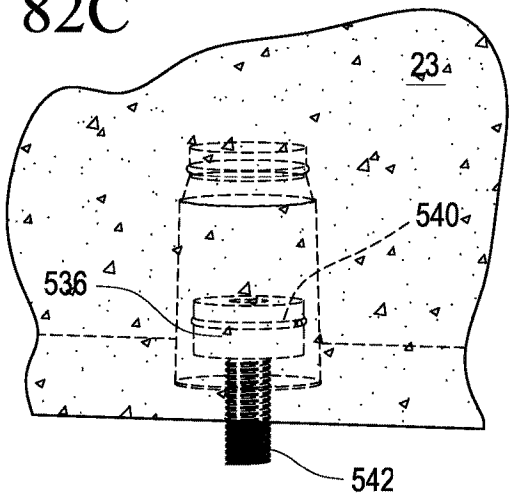
FIG. 82C is a perspective cross-sectional view of a cylindrical nut attached to a threaded rod, the cylindrical nut having a locking groove with a ring.

FIG. 82C shows the nut 536 with the groove 538 and the locking split (C-ring) ring 540. The fastener 542 is attached to the nut 536.

FIG. 82D shows the nut 536 locked in place in the concrete 23, with the groove 528 in the concrete and the groove 538 in the nut in locking position with the split ring 540.

FIG. 82E shows the fastener 542 and the nut 536 made as one-piece unit 537.

Figure 83B:
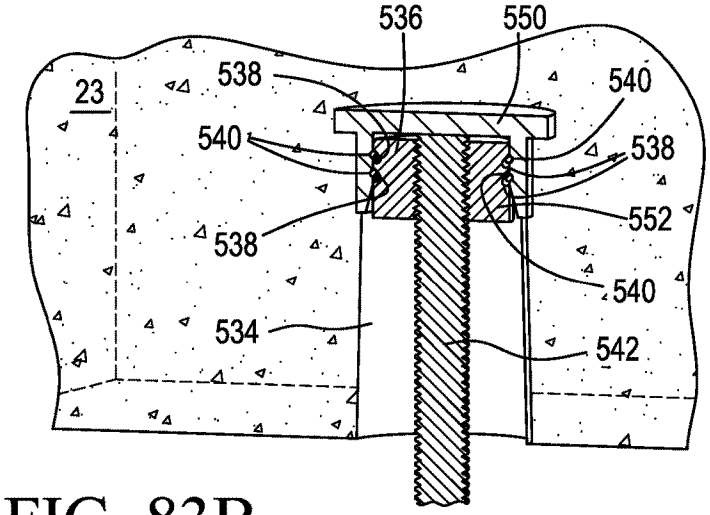
FIG. 83B is a perspective cross-sectional view of the anchor body of FIG. 83A embedded in concrete, showing the plug removed from the concrete and a cylindrical nut with multiple locking grooves and rings attached to the anchor body in the corresponding multiple grooves.
Figure 83D:
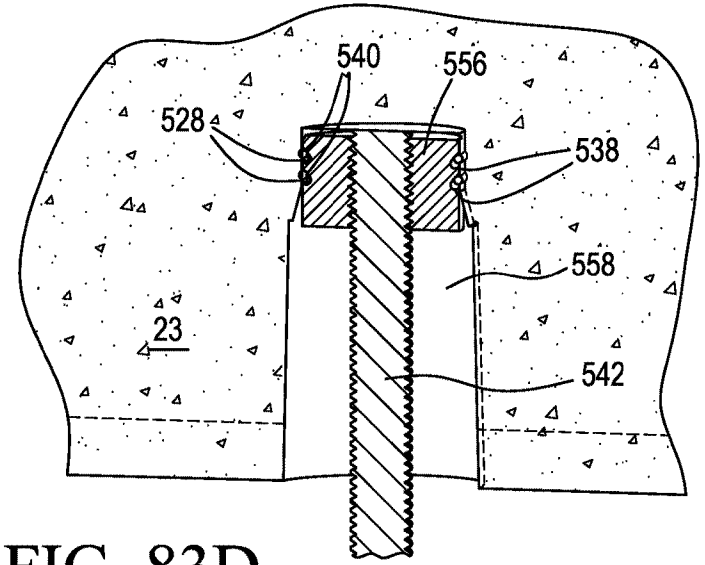
FIG. 83A is perspective cross-sectional view of a plug attached to an anchor body with multiple grooves and compressive rings.
FIG. 83C is a perspective view of a plug with multiple grooves and compressive rings partly disposed in the grooves to make a mold of the grooves in the concrete.
Figure 83A:
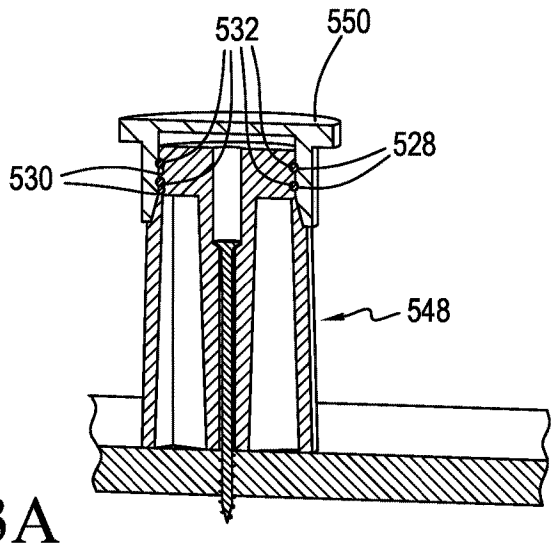

FIG. 83A shows a plug 548 and an anchor body 550 that are identical to the plug 518 and the anchor body 520, except with the addition of another set of grooves 528 and 530 and the compressible ring 532.

FIG. 83B shows a nut 552 received within the anchor body 550. The cylindrical nut 552 is identical to the nut 536, except with the addition of another set of groove 538 and the split ring 540. The nut 552 and the anchor body 550 provide greater load capacity due to the addition of another split ring and the corresponding grooves. The void 534 in the concrete 23 is created when the plug 548 is removed after the concrete has cured.

Figure 83C:
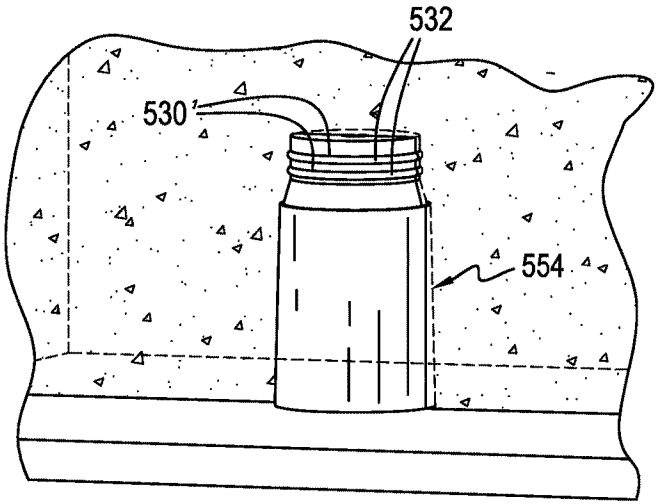

FIG. 83C shows a plug 554, which is identical to the plug 518 except for the addition of another set of groove 528 and the compressible ring 532.

FIG. 83D shows a nut 556, which is identical to the nut 536 except with the addition of one set of except with the addition of another set of groove 538 and the split ring 540. An additional groove 528 is created in the concrete. A void 558 in the concrete 23 is created after the plug 554 is removed when the concrete has cured.

Figure 84B:
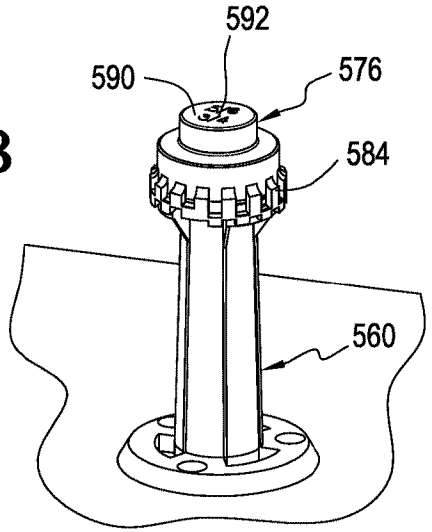
Figure 84C:
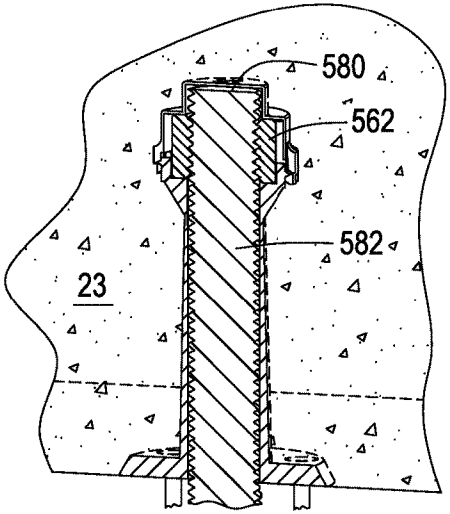
Figure 84A:
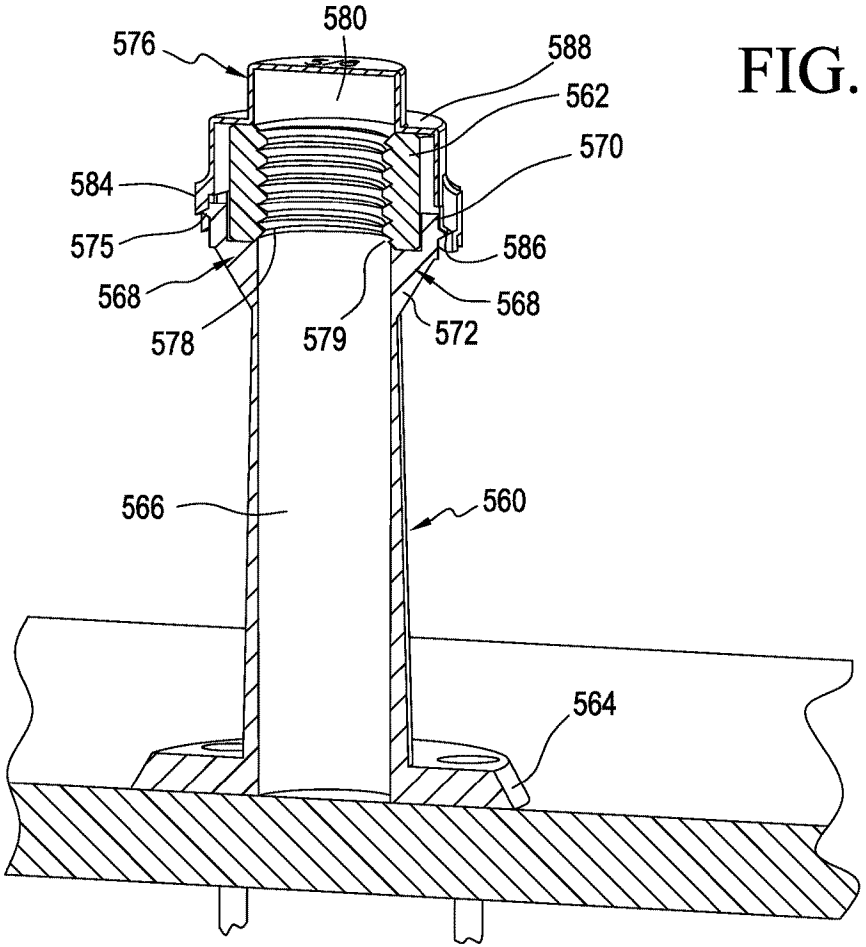

FIG. 84A shows a plug attached to a nut 562. The plug has a base portion 564 attached to the form board 28 with nails. The plug has a central opening 566 with a diameter sufficient for an anchor rod or fastener to pass through to reach the nut 562. An upper portion of the plug includes outwardly extending arms 568 to support the nut 562. The arms 568 are L-shaped with vertical portions 570 that support the nut 562 radially and horizontal portions 572 that support the nut vertically. Partly circular members 574 (see FIG. 84E) join every other pair of the arms 568 and includes a portion of a single revolution male thread 575. A cap 576 seals the upper portion of the nut 562 from the concrete. The lower portion 578 of the nut seals with the upper portion 579 of the plug. The cap includes an upper cavity 580 above the nut to allow a fastener 582 to extend past the top of the nut. The cap includes a plurality of fingers 584 extending downwardly with portions of a single revolution female thread 586 that mate with the male thread 575. Turning the thread 586 in a tightening direction with respect to the thread 575 will force the nut via the radial wall portion 588 to press on the top surface of the nut, causing a seal at the top surface and forcing the lower portion 578 of the nut to press on the upper portion 579 of the plug.

FIG. 84B shows the plug 560 and the cap 576 in perspective view. The nut diameter and thread size may be indicated on the top wall portion 590 as generally indicated at 592. The cap may also be color coded to indicate the size and type of the threads of the anchor body, capacity of the anchor body, intended use of the anchor body (such for supporting HVAC components, plumbing, electrical trays, fire alarm equipment and wiring, etc.), and type of the anchor body.

FIG. 84C shows the fastener 582 screwed to the nut 562 and extends into the cavity 580. This ensures full engagement of the threads of the nut and the fastener.

Figure 84D:
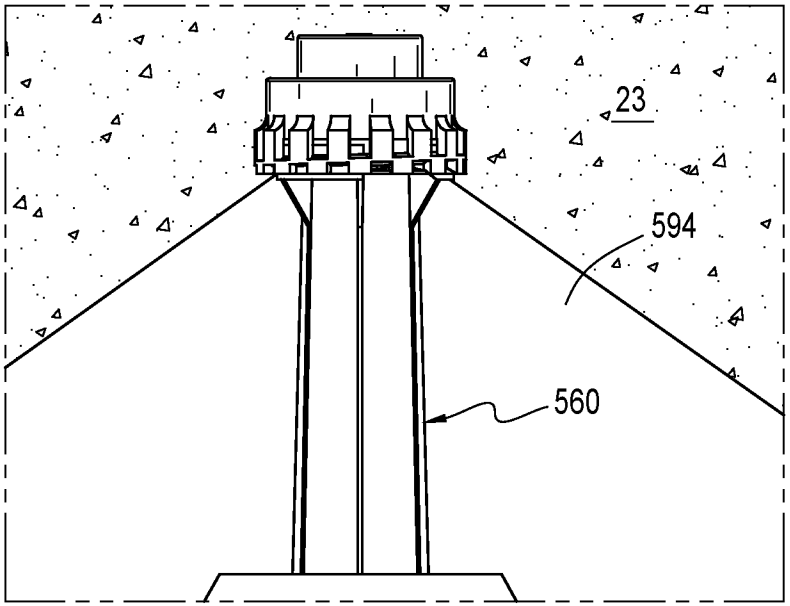

FIG. 84D show a breakout cone 594 in concrete 23 generated by the nut 562 under load.

Figure 84E:
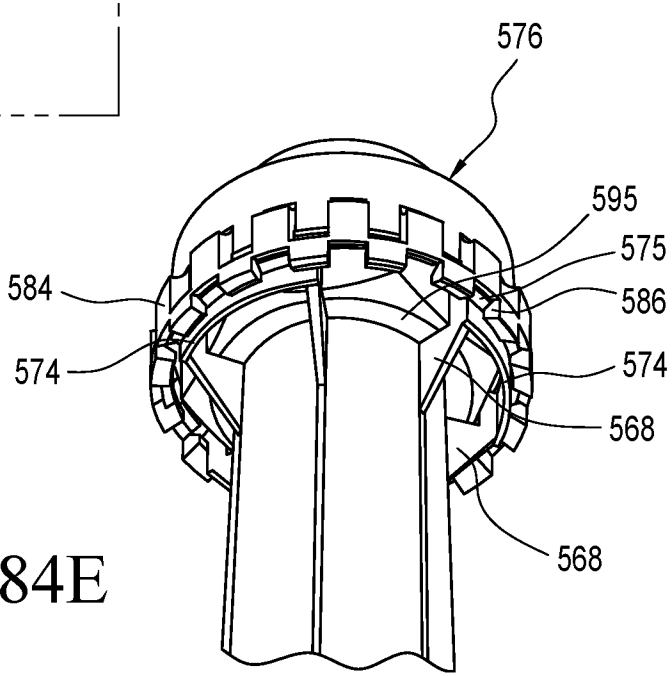

FIG. 84E shows the lower bearing surface 595 of the nut 562 that will be in direct contact with the concrete when embedded in concrete.

Figure 85A:
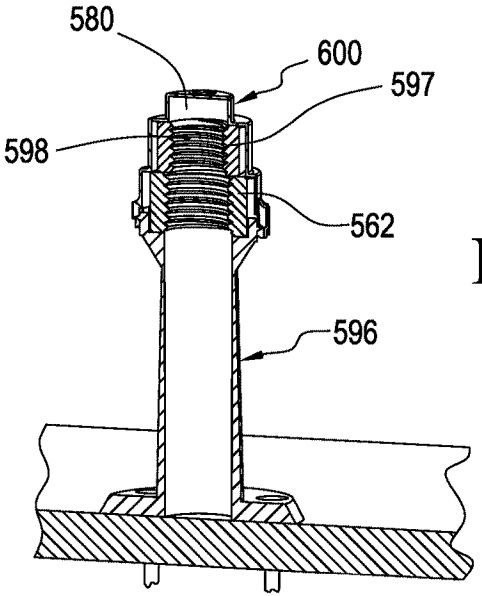

FIG. 85A shows a plug 596 similar to the plug 560 except that two nuts 562 and 597 are attached to the plug 596. The nut 597 has a smaller threaded opening 598 than the nut 562 to provide use for different sized fasteners. A cap 600 is provided to seal the nuts 597 and 562 from the concrete. The cap 600 is structurally the same as the cap 576 in terms of the connection to plug 596. Tightening the cap 600 to the plug 596 presses the upper nut 597 against the lower nut 562 to seal the interior of the nuts from the concrete.

Figure 85B:
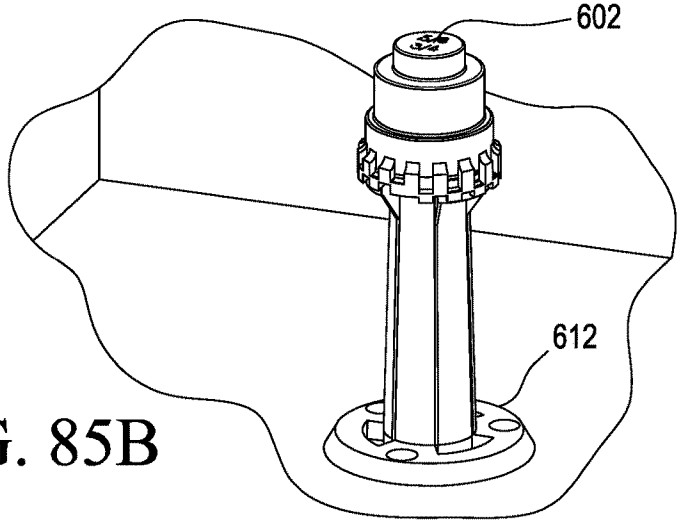

FIG. 85B shows at 602 the diameters and thread sizes of the nuts.

Figure 85C:
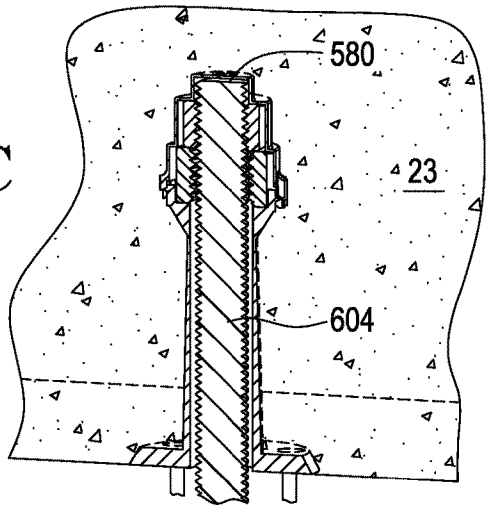

FIG. 85C shows a fastener 604 attached to the smaller diameter nut 598. The end of the fastener extends past the nut 598 into the cavity 580 to ensure complete engagement of the threads of the nut and the fastener.

Figure 85D:
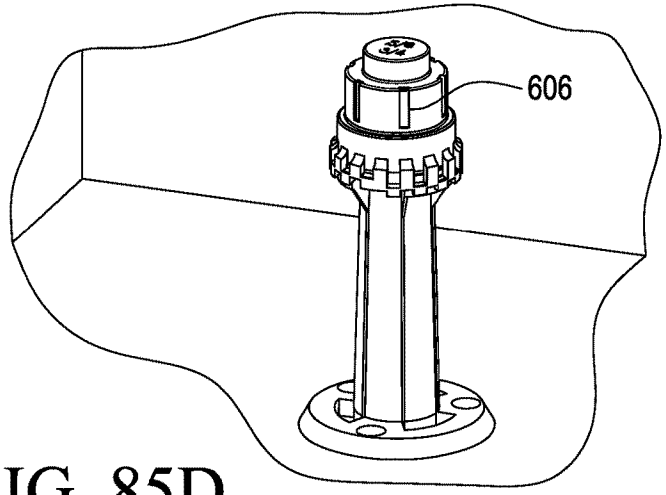

FIG. 85D shows slots 606 in the side wall of the cap next to the flat sides of the nut 596 to allow the concrete to fill the void on the side of the flat faces of the nut to prevent the nut from turning when the fastener is attached.

Figure 86B:
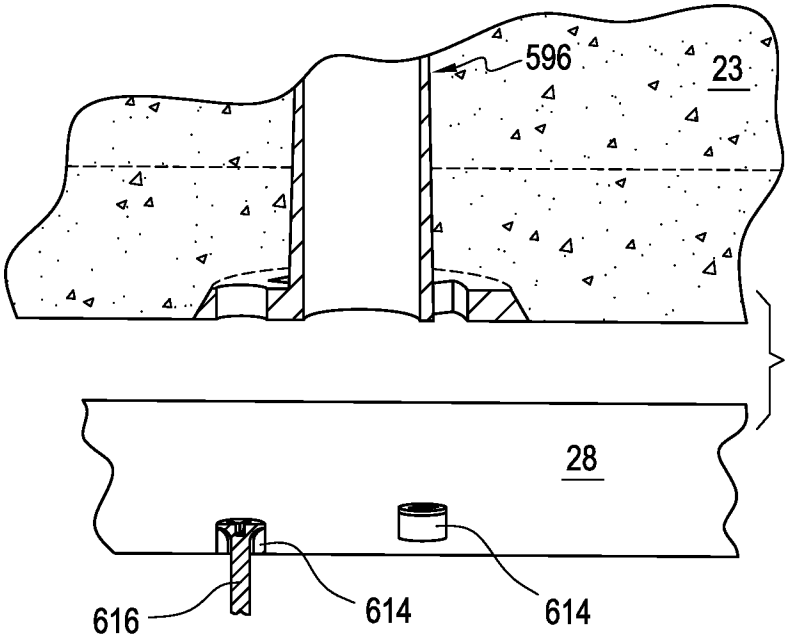
Figure 86A:
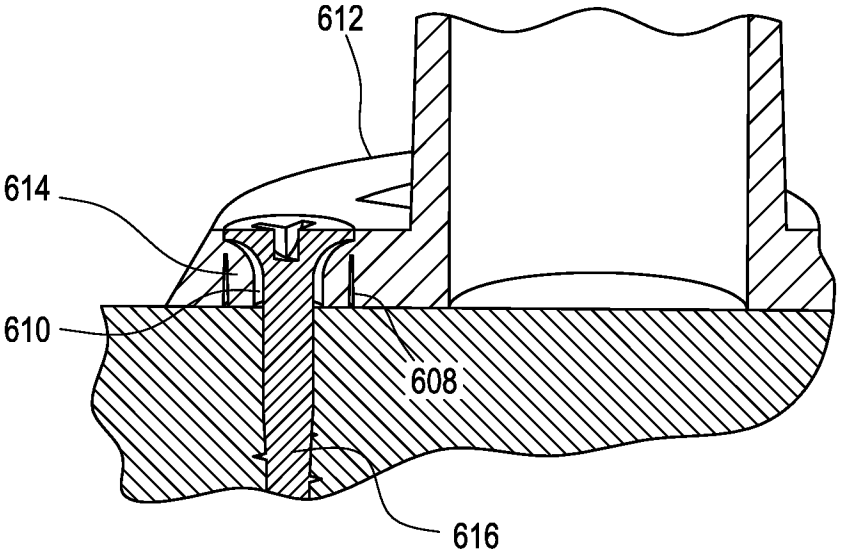

FIG. 86A shows a circumferential slit 608 around the peripheral edge portion 614 of opening 610 in the base portion 612 of the plug 596. The slit 608 is preferably sized the same as the head of the screw or nail 616.

FIG. 86B shows the weakened peripheral portion 614 around the opening 610 that breaks off with the screw 616 when the form board 28 is removed. The weakened portion 614 along with screw 616 stay with the form board 28. The peripheral edge portion 614 is preferably the size of a head of the screw 616 to aid the screw to break through the base portion 612 when the form board is removed from the cured concrete.

FIG. 87A shows a plug 616 similar to the plug 560 except that the base portion 564 is a removable base member 618, which includes a cylindrical portion 620 sealingly received with the opening 566 with a close fit. A screw 622 or nail through a central opening in the cylindrical portion 620 attaches the plug 616 to the form board 28.

FIG. 87B shows the removal of the form board 28 after the concrete 23 has cured. The base member 618 stays attached to the form board 28, leaving the rest of the plug 616 behind in the concrete.

FIG. 88A shows a plug 626 similar to the plug 616 except that the removable base member 618 is a threaded removable base 628, which is threaded to a bottom end portion of the opening 566.

FIG. 88B shows the removal of the form board 28 after the concrete 23 has cured. The base member 628 is then removed by unthreading from the threads 630 at the bottom end portion of the opening 566. The rest of the plug 626 is embedded in concrete.

Figure 89B:
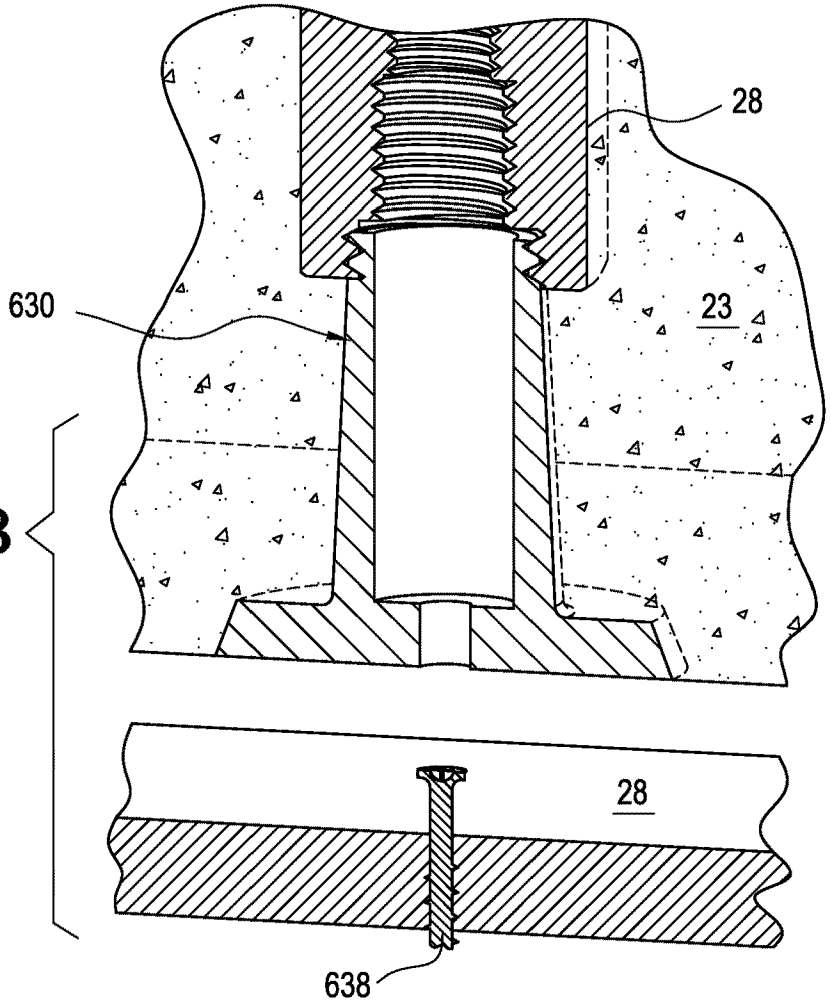
Figure 89A:
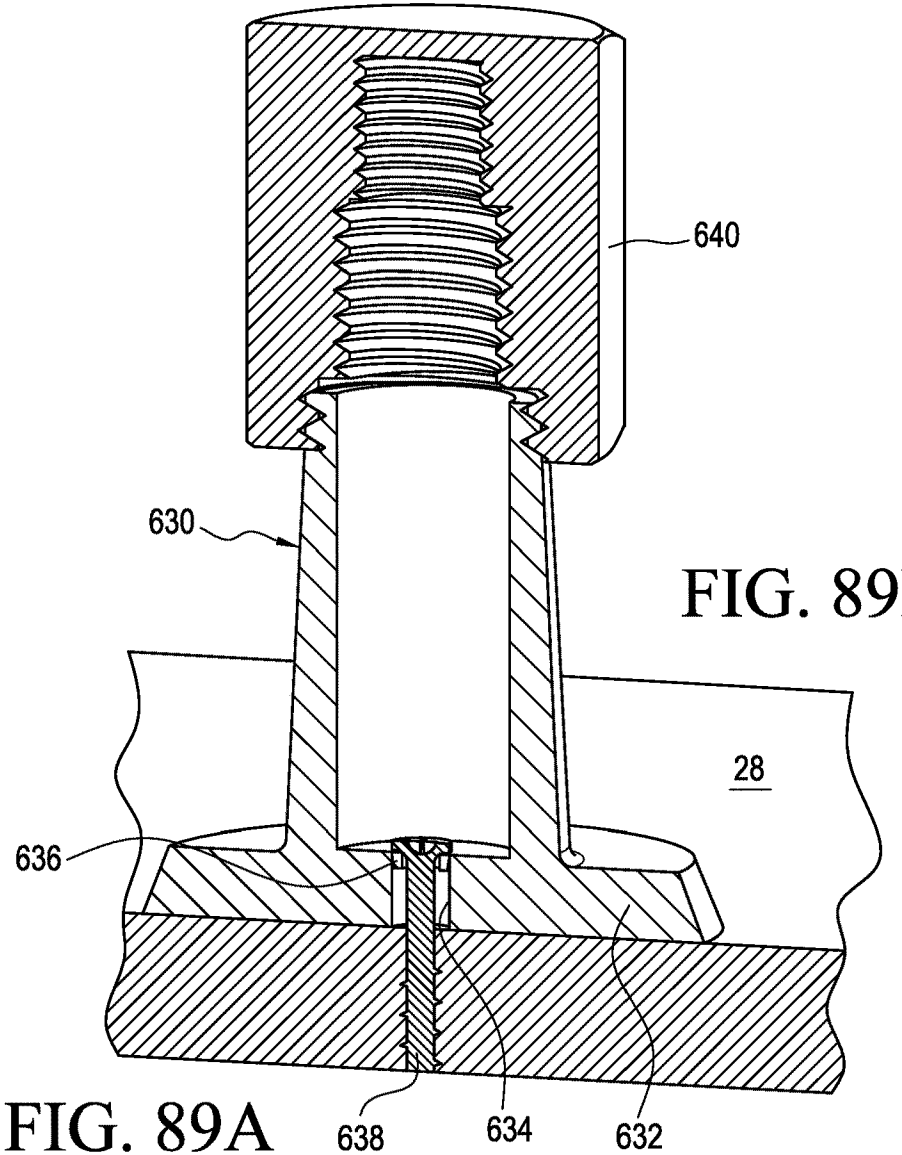

FIG. 89A shows a plug 630 with a base portion 632 with a central opening 634. A weakened circumferential flange 636 supports the head of a screw 638 that attaches the plug to the form board 28. The circumferential flange 636 extends radially into the opening 634. The weakened flange is configured to break to allow the head of the screw or nail 638 to pass through the opening 634 when the form board 28 is removed after the cured has cured. The flange 636 is weakened with a circumferential slit 639 (similar to the slit 608 shown in FIG. 86A) preferably has the same size as the head of the screw.

FIG. 89B shows the plug 630 embedded in the concrete 23. When the form board 28 is removed from the concrete, the weakened circumferential flange 636 gives way to the head of the screw 638, which remains attached to the form board 28. The plug 630 will be removed to gain access to the anchor body 640.

Figure 90B:
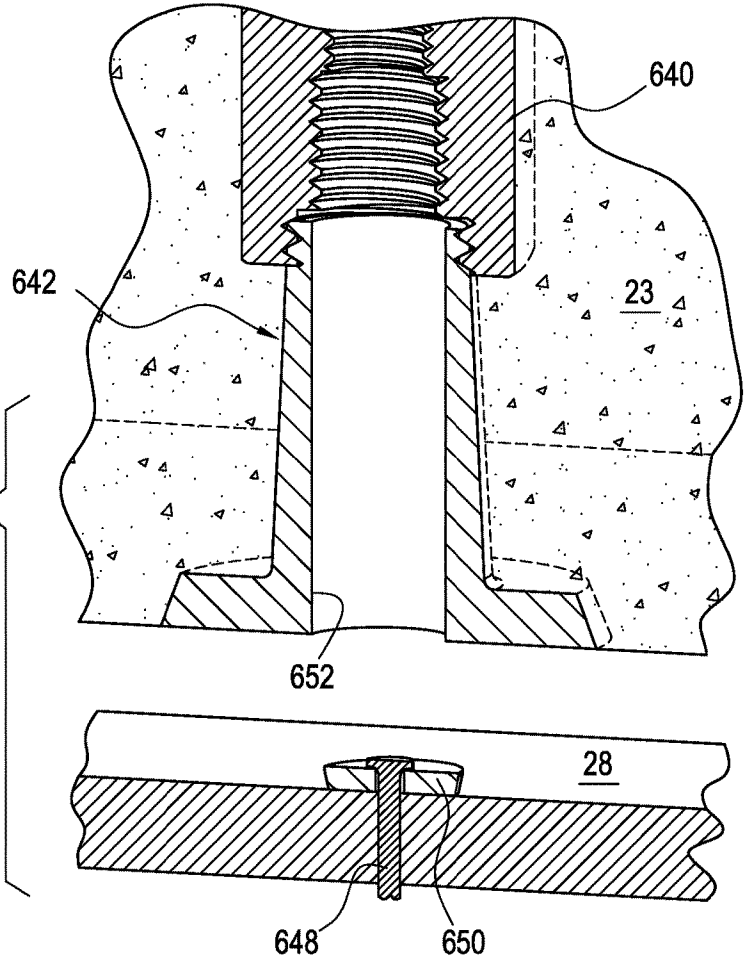
Figure 90A:
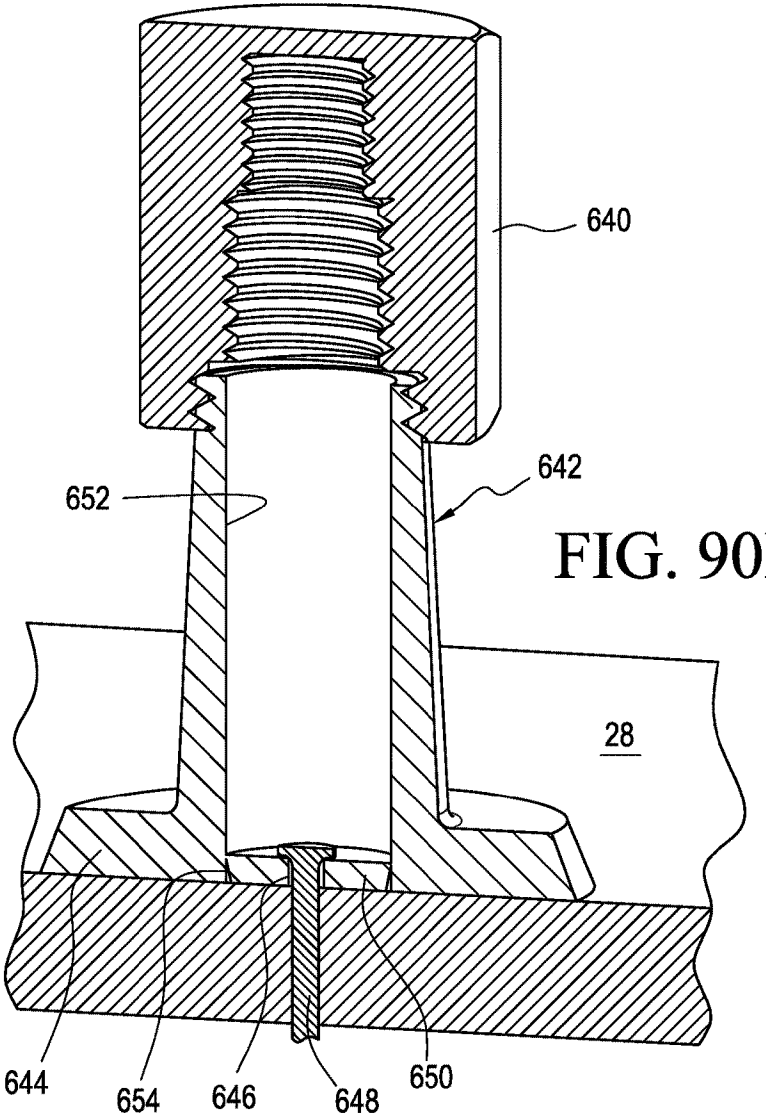

FIG. 90A shows a plug 642 with a base portion 644 with a central opening 646 through which a screw or nail 648 extends to attach the plug to the form board 28. A weakened portion 650 closes the bottom of an opening 652. The weakened portion is configured to break and separate from the plug to open the opening 652 at the bottom to allow the threaded portion of a fastener access to the opening 652 and attach to the anchor body 640. A circular slit 654 having the same diameter as the opening 652 that extends partway into the thickness of the portion 650 may be used to weaken the portion and thus facilitate the breaking of the weakened portion from the plug to expose the opening 652 when the form board is removed.

FIG. 90B shows the plug 652 embedded in the concrete 23 with the form board 28 separated from the concrete with the weakened portion 650 remaining attached to the form board with the screw 648. The opening at the bottom of the opening 652 is cleared of the weakened portion 650, allowing a threaded rod to enter and attach to the anchor body without removing the plug from the concrete.

Figure 91B:
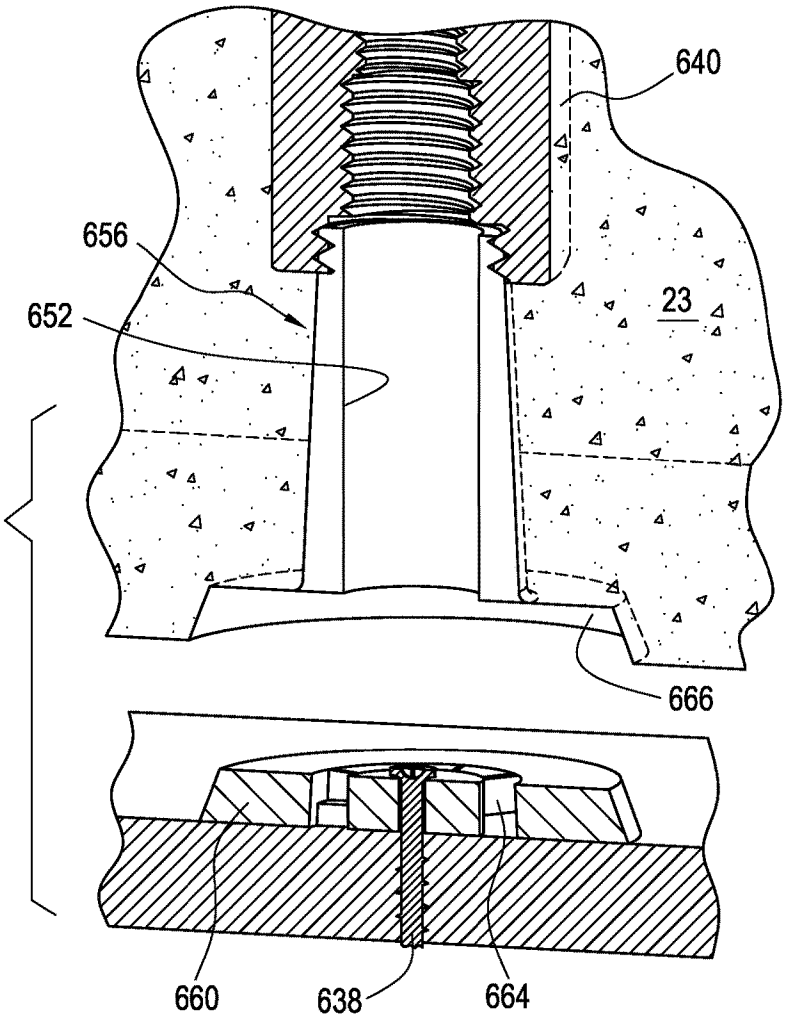
Figure 91A:
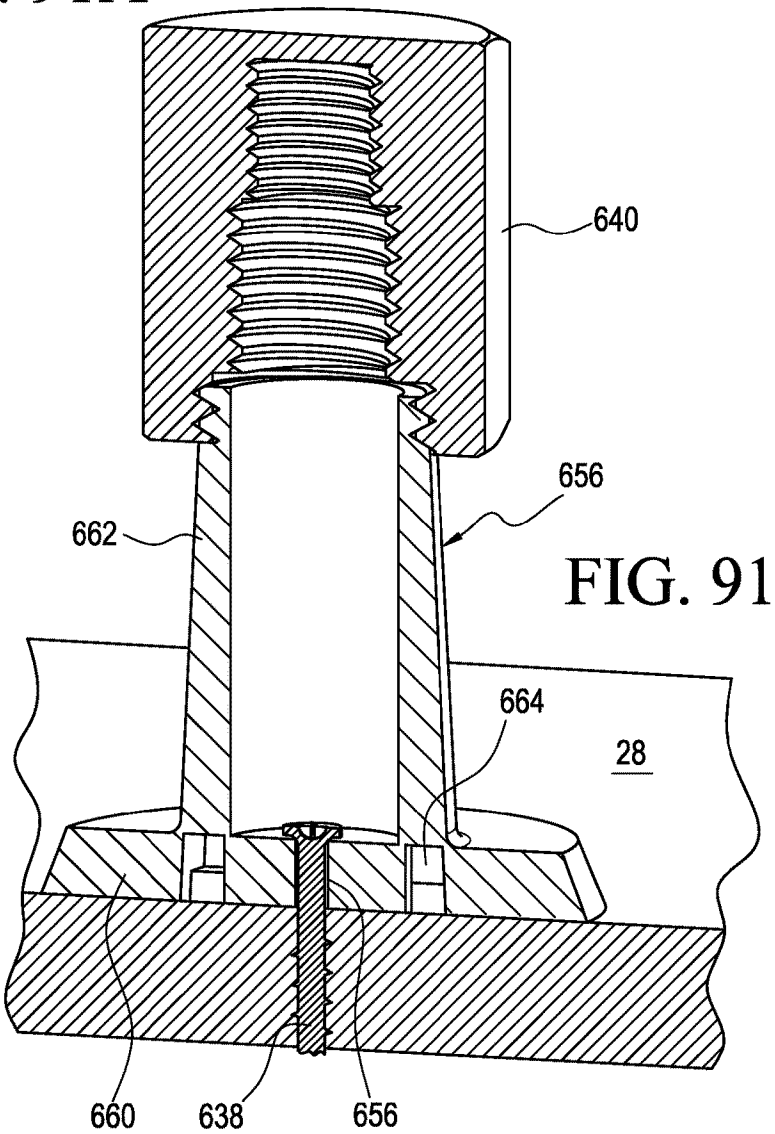

FIG. 91A shows a plug 656 attached to the form board 28 through a central opening 658 in the base portion 660, which is attached to main body portion 662 of the plug with thin members 664 configured to break and separate from the plug when the form board 28 is removed from the concrete after the concrete has cured. The connection between the main body portion 662 and the base portion 660 is through the edges of the thin members 664.

FIG. 91B shows the plug 656 embedded in the concrete 23 with the base portion 660 broken off from the plug 656 when the form board 28 is removed from the concrete. The base portion 660 remains attached to the form board 28 with the screw 638. The separation of the base portion 660 from the plug clears the bottom of the opening 652, providing access to the anchor body 640 to a threaded rod, bolt, fastener, etc. A void 666 corresponding to the outside shape of the base portion 660 is created in the concrete 23 when the base portion 660 is broken off and separated from the plug 653. Since access to the opening 652 is provided after the from board 28 is removed, the plug 656 does not have to be removed from the concrete 23 so that the main body portion 662 of the plug does not have to be conical or tapered. The color of the main body portion 662 may be color coded to indicate the size and type of the threads of the anchor body 640, capacity of the anchor body 640, intended use of the anchor body (such for supporting HVAC components, plumbing, electrical trays, fire alarm equipment and wiring, etc.), and type of the anchor body.

The various features disclosed herein with particular embodiments of the plugs and the anchor bodies should be understood to be equally applicable to all other embodiments even though not specifically disclosed in combination with those embodiments.

The various embodiments of the plugs disclosed herein are means for positioning anchor bodies in concrete and providing an access opening to the anchor bodies.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A plug for creating a passageway in concrete, comprising:

a) a main body portion extending upwardly from a base portion, the plug for being attached to a form board with a nail or screw prior to pouring of concrete;

b) the main body portion including a central opening for providing access into the concrete;

c) the main body including an end portion disposed a distance from the base portion, the end portion for supporting a first anchor body such that a bottom portion of the first anchor body is exposed to direct contact with the concrete; and d) a cap for being disposed over the first anchor body.

2. The plug as in claim 1, wherein:

a) the base portion includes an edge portion with a base opening for receiving the nail or screw; and b) the base opening is configured to allow the nail or screw to separate from the base portion and remain attached to the form board when the form board is removed.

3. The plug as in claim 2, wherein the base opening includes a peripheral edge portion with a circumferential slit partway into a thickness of the base portion.

4. The plug as in claim 1, wherein:

a) the base portion includes a base opening within the central opening, the base opening for receiving the nail or screw; and b) the base opening is configured to allow the nail or screw to separate from the base portion and remain attached to the form board when the form board is removed.

5. The plug as in claim 4, wherein the base opening includes a peripheral edge portion with a circumferential slit partway into a thickness of the base portion.

6. The plug as in claim 1, wherein:

a) the base portion includes a central portion disposed at a bottom portion of the central opening;

b) the central portion is for being attached to the form board with the nail or screw; and c) the central portion is configured to separate from the central opening and remain attached to the form board when the form board is removed.

7. The plug as in claim 6, wherein:

a) the central portion includes a thickness; and b) the central portion includes a circular slit partway into the thickness around the base opening.

8. The plug as in claim 1, wherein:

a) the base portion includes a base opening for receiving the nail or screw within the central opening; and b) the base portion is configured to separate from the main body portion and remain attached to the form board when the form board is removed.

9. The plug as in claim 8, wherein the base portion is attached to the main body portion with breakable members.

10. The plug as in claim 1, wherein:

a) the base portion includes an edge portion with a base opening for receiving the nail or screw; and b) the base portion is configured to separate from the main body portion and remain attached to the form board when the form board is removed.

11. The plug as in claim 10, wherein:

a) base portion includes a thickness; and b) the base portion includes a circumferential slit partway into the thickness adjacent a bottom portion of the main body portion.

12. The plug as in claim 1, wherein:

a) the base portion includes a central portion removably received within the central opening;

b) the central portion includes a base opening for receiving the nail or screw.

13. The plug as in claim 1, wherein the main body portion is separable from the concrete when the form board is removed.

14. The plug as in claim 1, and further comprising a first anchor body supported by the end portion.

15. The plug as in claim 14, wherein a first opening of the first anchor body is sealed by the end portion.

16. The plug as in claim 14, and further comprising a second anchor body operably supported by the end portion.

17. The plug as in claim 16, wherein:

a) the second anchor body includes a second threaded opening with a second diameter; and b) the second anchor body is disposed above the first anchor body.

18. The plug as in claim 17, wherein the cap is disposed over the second anchor body.

19. The plug as in claim 18, wherein the cap provides a space above the second anchor body.

20. The plug as in claim 14, wherein the first anchor body includes a threaded opening with a first diameter and a second diameter.

21. The plug as in claim 1, wherein the end portion of the main body portion is threaded.

22. The plug as in claim 1, wherein the base portion remains attached to the form board when the form board is removed.

23. The plug as in claim 1, wherein:

a) the base portion includes a central portion disposed at a bottom portion of the central opening; and b) the central portion remains attached to the form board when the form board is removed.

24. The plug as in claim 14, wherein the cap includes a marking indicating the diameter and thread size of the first anchor body.

25. The plug as in claim 14, wherein the end portion includes outwardly extending arms for supporting the anchor body.

26. The plug as in claim 25, wherein:

a) partly circular members are attached to adjacent arms; and b) the cap is threaded to the partly circular members.

* * * * *